US007592133B2

(12) United States Patent
Miki et al.

(10) Patent No.: US 7,592,133 B2
(45) **Date of Patent: *Sep. 22, 2009**

(54) SILVER HALIDE PHOTOGRAPHIC MATERIAL AND IMAGE FORMING METHOD USING THE SAME

(75) Inventors: Masaaki Miki, Minami-Ashigara (JP); Hideyuki Shirai, Minami-Ashigara (JP); Junichiro Hosokawa, Minami-Ashigara (JP); Tetsuo Kikuchi, Minami-Ashigara (JP); Yoichi Hosoya, Minami-Ashigara (JP); Katsuyuki Nukui, Minami-Ashigara (JP); Ryoji Nishimura, Minami-Ashigara (JP); Kouichi Yokota, Minami-Ashigara (JP)

(73) Assignee: Fujifilm Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/081,239

(22) Filed: Apr. 11, 2008

(65) Prior Publication Data

US 2008/0268385 A1 Oct. 30, 2008

(30) Foreign Application Priority Data

Apr. 13, 2007 (JP) ..... P2007-106169

(51) Int. Cl.

| | |
|---|---|
| ***G03C 1/46*** | (2006.01) |
| ***G03C 1/494*** | (2006.01) |
| ***G03C 1/08*** | (2006.01) |
| ***G03C 7/26*** | (2006.01) |
| ***G03C 7/32*** | (2006.01) |

(52) U.S. Cl. ..... 430/544; 430/502; 430/503; 430/504; 430/505; 430/506; 430/567; 430/517; 430/559; 430/558; 430/554; 430/555; 430/570

(58) Field of Classification Search ..... 430/502–506, 430/567, 517, 559, 558, 554, 555, 570, 544
See application file for complete search history.

(56) References Cited

U.S. PATENT DOCUMENTS

| | | | | |
|---|---|---|---|---|
| 3,953,215 | A | 4/1976 | Hinata et al. | |
| 7,368,230 | B2 * | 5/2008 | Hosokawa et al. | 430/506 |

FOREIGN PATENT DOCUMENTS

| | | | |
|---|---|---|---|
| EP | 1 227 365 | A1 | 7/2002 |
| FR | 2 238 168 | A | 2/1975 |
| JP | 62-284344 | A | 12/1987 |
| JP | 64-20461 | A | 1/1989 |
| JP | 02 181140 | A | 7/1990 |
| JP | 7-12879 | A | 5/1995 |

* cited by examiner

*Primary Examiner*—Geraldina Visconti
(74) *Attorney, Agent, or Firm*—Birch, Stewart, Kolasch & Birch, LLP

(57) ABSTRACT

A silver halide photographic material, includes transparent support having provided thereon a blue-sensitive silver halide emulsion layer, a green-sensitive silver halide emulsion layer and a red-sensitive silver halide emulsion layer, wherein the average equivalent-sphere diameter of the silver halide grains contained in each layers is 0.35 μm or less, and an upper layer of the green-sensitive emulsion layer contains a fixed magenta dye, an upper layer or the red-sensitive emulsion layer contains a fixed cyan dye, and the green-sensitive layer contains a pyrazolotriazole, pyrazolopyrrole or 4-thio-pyrazolo-5-one coupler having a specific structure, and an image-recording method uses the photographic material.

9 Claims, 1 Drawing Sheet

FIGURE
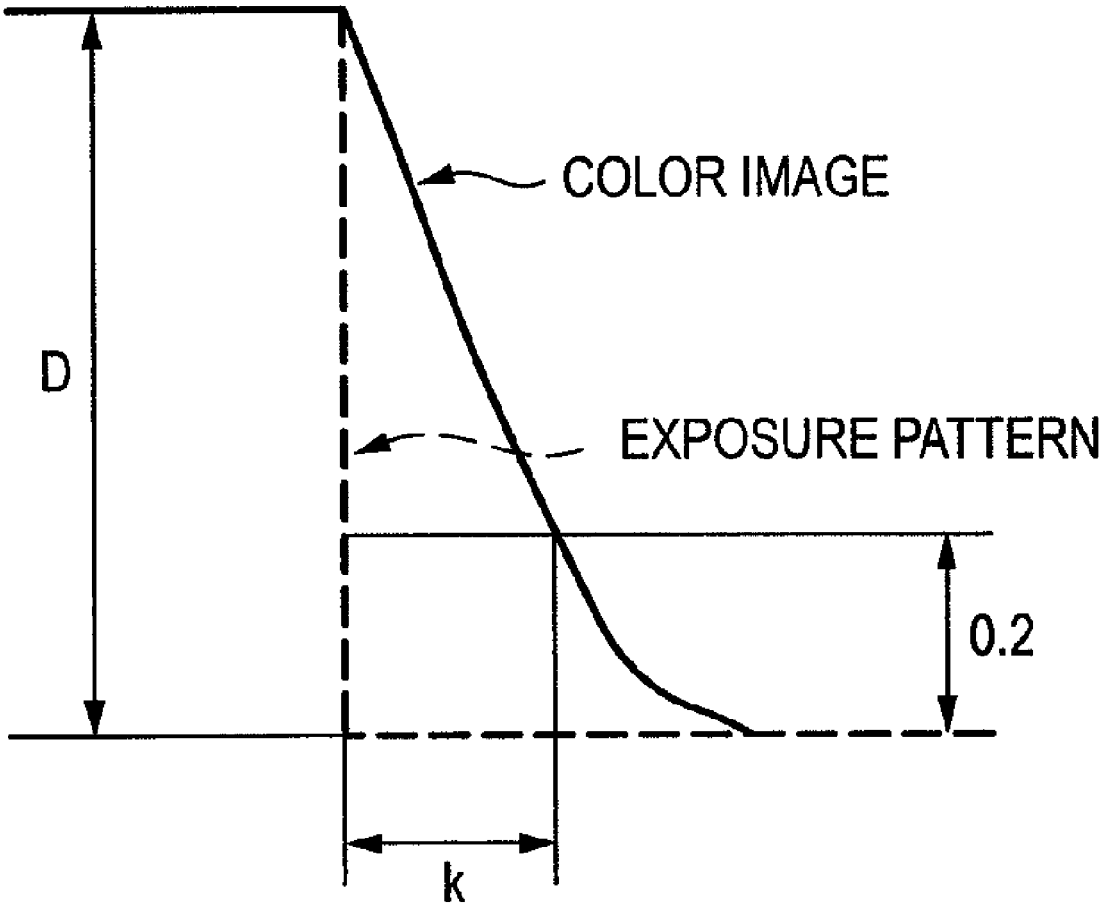

SILVER HALIDE PHOTOGRAPHIC MATERIAL AND IMAGE FORMING METHOD USING THE SAME

BACKGROUND OF THE INVENTION

1. Field of the Invention

The present invention relates to an image-forming method using a silver halide photographic material, specifically an image-forming method of recording a digital data on a silver halide photographic material with little deterioration. The invention further relates to a silver halide photographic material capable of realizing the image-forming method.

2. Description of the Related Art

In the manufacture of a movie, a method of making a duplicate by printing on an intermediate film an image data photographed with a negative film for photographing as the original image, and further printing the duplicate on a positive film for motion picture to use it for projection has been conventionally used.

In many cases, an intermediate film for the manufacture of a duplicate is used two times. An original negative film is printed on a negative type intermediate film to make a master positive film. The master positive image is then again printed on the intermediate film to make a duplicate negative film. Lastly the duplicate negative image is printed on a positive film for motion picture to make a print for screening.

In recent years in the manufacture of movies, a method of converting an original image to a film again as an analog image by digital synthesis and edition with a film recorder has been rapidly prevailing. This is for the reason that the degree of freedom of presentation of screen image can be enlarged by the creation of an image that is impossible in the actual world by synthesis and edition with the computer. Various image data can be used as original images, for example, image data obtained by digitizing the image data photographed with a negative film for photographing with a film scanner, image data photographed with an HD video camera, image data obtained by computer graphics and the like.

As the number of pixels of an original image, for example, when a negative film for photographing is digitized with a film scanner to make an image data of 2,048×1,556, the number of pixels is 3,190,000 pixels.

When an original image is conveniently made in a digital data and screened by conventional analog projection as described above, processes such that the original image made as a digital data is printed on an intermediate film and then this duplicate image data is printed on a positive film for motion picture similarly to the conventional method are taken.

However, when such a method is used, a problem has newly arisen with the increase in resolution of digital data. When an original image is printed on a silver halide photographic material, the image quality is deteriorated and sufficient image quality for screening cannot be secured. There are problems of the improvement of the deterioration of image qualities ascribable to photographic characteristics of analog silver halide photographic materials, such as the occurrence of blur, the deterioration of sharpness, and the reduction of color reproduction. JP-A-10-20461 (The term "JP-A" as used herein refers to an "unexamined published Japanese patent application".) discloses a silver halide color photographic material that is characterized in that the N value of a magenta image by laser scanning exposure is from 100 to 200 μm. The N value is the amount corresponding to the blur of an image, which patent discloses the decrement of blur of letters in printing on color photographic paper. However, a pixel size is 12 μm or smaller in resolution of 2,000 dpi or more used in recent years in the field of manufacture of movies, so that such an N value is apparently inappropriate in resolving a precise image data.

JP-A-62-284344 discloses that, in laser film recording with argon (Ar) laser (wavelength: 514.5 nm) as the green light source, little color mixing and improvements in graininess and resolution can be achieved by making coincide the peak wavelength of spectral sensitivity of the green-sensitive emulsion layer of a silver halide color photographic material with the wavelength 514.5 nm of argon (Ar) laser.

However, there are no descriptions relating to image recording in high resolution in JP-A-7-128791. Further, green light source apparatus used in the field of manufacture of movies in recent years is a small size and solid state lasers are mainly used for electric power conservation, and the wavelength of the light sources is 532.0 nm, so that such a silver halide photographic material as disclosed in JP-A-7-128791 is apparently inappropriate in recording a precise digital image data.

Blur and sharpness can be improved by the prevention of light scattering. It has been thought that the greater the surface area of silver halide grains of the constituent of photographic material, in particular tabular grains having a greater surface area, the greater is light scattering. For example, JP-A-7-128791 discloses a technique and examples to improve sharpness by containing a fixed magenta dye on a further side from the support of a green-sensitive layer containing tabular silver halide grains.

As described above, conventional intermediate films are used for duplication by printing thereon with an image data photographed by using a negative film for photographing as an original image, so that it is sufficient for conventional intermediate films to use fine silver halide grains having an average equivalent-sphere diameter of 0.35 μm or less that are almost free from light scattering and capable of highly precise recording.

However, when a digital data highly increased in resolution that is different from conventional use is recorded on a limited recording area, occurrence of blur, reduction of sharpness, and deterioration of color reproduction are conspicuous, so that conventional intermediate films are insufficient in recording precise images.

Accordingly, a silver halide photographic material capable of recording a digital data with little deterioration, that is, a silver halide photographic material capable of preventing occurrence of blur, reduction of sharpness and deterioration of color reproduction, and capable of recording a digital data is strongly desired.

Further, when digital image data are recorded with a film recorder, recording time of 10 hours or longer is required in many cases from the beginning to the end of recording. In this case, there is a problem of the fluctuation of photographic performances due to aging from exposure to development process of films, i.e., conservation of latent images. There is a difference in time lapsing from exposure to development process between the first part and the last part of recording data, and a problem that the tints of images deviate from each other arises. Therefore, photographic materials little in the fluctuation of latent image conservation have been strongly desired.

SUMMARY OF THE INVENTION

An object of the invention is to provide an image-forming method capable of recording a digital data on a silver halide photographic material in high resolution with little deterioration. A further object is to provide a silver halide photographic material capable of realizing the image-forming method with little deterioration and having an excellent conservation property of latent images not influenced by aging from exposure to development processing.

The terminology of "recording with little deterioration" in the invention means to suppress vanishing of the image structure contained in a digital image data at the time of recording as far as possible and suppress the fluctuation of color data at the time of recording as far as possible.

As a result of eager investigations for solving the above problems, it has been found that a photographic material free from blur and little in the deterioration of sharpness and color reproduction can be obtained by using fixable dyes and couplers according to the invention in recording highly precise digital data.

That is, the invention is as follows.

(1) A silver halide photographic material, comprising:

a transparent support; and a plurality of layers comprising a first photosensitive layer, a second photosensitive layer and a third photosensitive layer directly or indirectly fin the transparent support, the first photosensitive layer consisting of at least one blue-sensitive layer, the second photosensitive layer consisting of at least one green-sensitive layer and the third photosensitive layer consisting of at least one red-sensitive layer, wherein all silver halide grains contained in the first, second and third photosensitive layers each has an average equivalent-sphere diameter of 0.35 μm or less, and wherein at least one layer that is a layer on the opposite side to the transparent support with the at least one green-sensitive layer as a center and not the at least one green-sensitive layer contains a fixed magenta dye, at least one layer that is a layer on the opposite side to the transparent support with the at least one red-sensitive layer as a center and not the at least one red-sensitive layer contains a fixed cyan dye, and at least one layer of the at least one green-sensitive layer contains a coupler represented by formula (I) or formula (Z):

Formula (I)

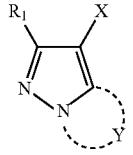

wherein $R_1$ represents a hydrogen atom or a substituent;

Y represents a nonmetallic atomic group containing 1 or 2 nitrogen atom(s) and necessary to form a 5-membered azole ring containing 2 or 3 nitrogen atoms, which azole ring may contain a substituent that may form a condensed ring with the azole ring; and X represents a hydrogen atom or a group capable of elimination at a time of coupling reaction with an oxidant of a developing agent:

Formula (Z)

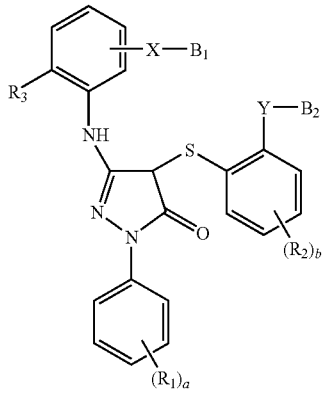

wherein a represents an integer of from 0 to 3, b represents an integer of from 0 to 2;

$R_1$ and $R_2$ each independently represents a hydrogen atom, an alkyl group, an alkoxyl group, a halogen group, an aryl group, an aryloxy group, an acylamino group, a sulfonamido group, a sulfamoyl group, a carbamoyl group, an arylsulfonyl group, an aryloxycarbonyl group, an alkoxycarbonyl group, an alkoxysulfonyl group, an aryloxysulfonyl group, an alkylureido group, an arylureido group, a nitro group, a cyano group, a hydroxyl group or a carboxyl group;

$R_3$ represents a halogen atom, an alkyl group or an aryl group;

X and Y each independently represents a direct bond or a bonding group; and $B_1$ and $B_2$ each independently represents a stabilizing group not to diffuse a coupler.

(2) The silver halide photographic material as described in (1) above, wherein at least one layer of the at least one green-sensitive layer contains sensitizing dyestuffs represented by formula (A) and formula (B):

Formula (A)

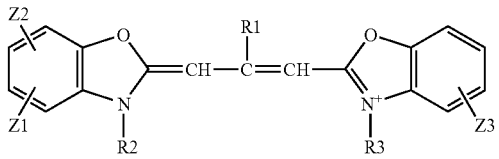

(X1)

wherein R1 represents a hydrogen atom, an alkyl group or an aryl group;

R2 and R3 each independently represents an alkyl group which may have a substituent;

Z1 and Z2 each independently represents a hydrogen atom, a halogen atom, a hydroxyl group, an alkoxyl group, an amino group, an acyl group, an acylamino group, an acyloxy group, an alkoxycarbonyl group, an alkoxycarbonylamino group, an aryl group, an aryloxy group, an aryloxycarbonyl group, a sulfonyl group, a carbamoyl group, an alkyl group or a cyano group, and Z1 and Z2 may be linked to each other to form a ring;

Z3 represents a halogen atom; and

X1 represents a cationic counter ion for neutralizing a charge according to necessity;

Formula (B)

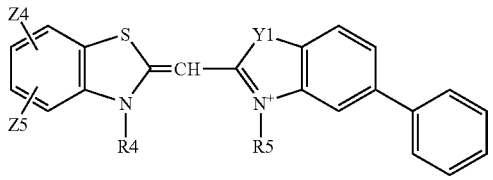

(X2)

wherein Y1 represents a sulfur atom or an oxygen atom;

R4 and R5 each independently represents an alkyl group that may have a substituent;

Z4 and Z5 each independently represents a hydrogen atom, a halogen atom, a hydroxyl group, an alkoxyl group, an amino group, an acyl group, an acylamino group, an acyloxy group, an alkoxycarbonyl group, an alkoxycarbonylamino group, an aryl group, an aryloxy group, an aryloxycarbonyl group, a sulfonyl group, a carbamoyl group, an alkyl group or a cyano group, and Z4 and Z5 may be linked to each other to form a ring; and X2 represents a cationic counter ion for neutralizing a charge according to necessity.

(3) The silver halide photographic material as described in (1) or (2) above, wherein at least one layer of the first, second and third photosensitive layers contains reduction sensitized silver halide grains and at least one compound selected from the group consisting of the following type 1 and type 2:

type 1: a compound in which one electron oxidant formed by oxidation of one electron is capable of further releasing one electron or more electrons followed by subsequent bond cleavage reaction; and type 2: a compound in which one electron oxidant formed by oxidation of one electron is capable of further releasing one electron or more electrons after having been subjected to subsequent bond-forming reaction.

(4) The silver halide photographic material as described in any of (1) to (3) above, which is capable of recording digital image data with little deterioration at image-recording time of the digital image data in resolution of 2,000 dpi or more.

(5) The silver halide photographic material as described in any of (1) to (4) above, which is capable of recording digital image data of 3,000,000 pixels or more with little deterioration.

(6) The silver halide photographic material as described in any of (1) to (5) above, wherein blur k of a recorded image at a time of digital image recording satisfies the following expression (K):

$$k \leqq 4.5\ \mu m \times (D-0.2)^2 \quad \text{(K)}$$

wherein D is a coloring density of the silver halide photographic material; and blur k is a blur (μm) in coloring density D.

(7) The silver halide photographic material as described in any of (1) to (6) above, wherein a color purity factor of a recorded image is 80% or more at digital image recording time.

(8) An image-forming method, comprising: recording a digital image data which is recorded on the silver halide photographic material as described in any of (1) to (7) above on another silver halide photographic material by an analog method.

BRIEF DESCRIPTION OF THE DRAWING

FIG. 1 is a typical drawing showing the density profile and blur k of the pattern edge part of a rectangular wave pattern formed in coloring density D on the image plane of a photographic material, wherein D denotes coloring density of a rectangular wave pattern formed on a photographic material, and k denotes blurring in coloring density D.

DETAILED DESCRIPTION OF THE INVENTION

The invention will be described in detail below.

The digital image data in the invention will be described. The digital image data in the invention mean image data obtained by digitizing image data photographed on a negative film for photographing with a film scanner, image data photographed with an HD video camera, image data obtained by computer graphics and the like. In the manufacture of movies in recent years, images of high resolution of 2,000 dpi or so have been used, but digital images of resolution as high as 4,000 dpi or more are used in some cases. The silver halide photographic material in the invention can be preferably used in recording of digital image data of from 2,000 to 6,000 dpi.

The number of pixels in the invention will be described. The number of pixels in the invention means the total number of pixels contained in the digital image data in the invention for use in recording on silver halide photographic materials. For example, when a negative film for photographing is digitized with a film scanner to make an image data of 2,048×1,556, the number of pixels is 3,190,000 pixels. The silver halide photographic material in the invention can be preferably used in digital image data of from 3,000,000 to 27,000,000 pixels.

Evaluating Method of Blur:

In the invention, for recording with little deterioration, it is preferred for blur k of an image at image recording time to satisfy the following expression (K).

$$k \leqq 4.5\ \mu m \times (D-0.2)_2 \quad \text{(K)}$$

In expression (K), D is the coloring density of the silver halide photographic material, and blur k is the blur (μm) in coloring density D.

It is preferred that expression (K) is satisfied in all the exposure light sources that are used in image recording. For example, in the case where light sources of three colors of red, green and blue are used monochromatic exposure of each color is performed and it is preferred that coloring density D at that time and blur k in density D satisfy expression (K).

Further, it is preferred for expression (K) to be satisfied in all the region of from Dmin+0.2 to Dmax, but in practice evaluation is carried out at two points of coloring densities Dmin+1 and Dmin+2, and it is an appropriate and preferred condition to satisfy expression (K) in each density. Here, Dmin is a minimum value of coloring density in a photographic material, which is equivalent to the density after processing of an unexposed film. Dmax is a maximum value of coloring density in a photographic material. The maximum value of coloring density is equivalent to the maximum value of the density of digital image data. In a case of widely used Cineon system, the maximums density is a value between Dmin+2 and Dmin+2.2.

FIG. 1 is a typical drawing showing the density profile and blurring k of the pattern edge part of a rectangular wave pattern recorded on a photographic material.

As shown in FIG. 1, when stepwise exposure is performed by adjusting the exposure quantity to the photographic material so that the pattern develops color in density D, the width of diffusion of blurred part of the color image in the areal direction of the image in density of Dmin+0.2 is measured, and this is taken as k, the index of blurring. The axis of abscissa in FIG. 1 is a distance.

For recording with little deterioration in the invention, it is preferred for blur k in image recording to satisfy the above expression (K). It is more preferred to satisfy the following expression (K-2), and especially preferred to satisfy expression (K-3).

$$k \leqq 4.0\ \mu m \times (D-0.2)^2 \quad \text{(K-2)}$$

$$k \leqq 3.5\ \mu m \times (D-0.2)^2 \quad \text{(K-3)}$$

Evaluating Method of Color Purity Factor:

When sensitometry exposure is carried out by monochromaticity of each of red, green and blue, and the image density obtained to main coloring density in monochromatic exposure is taken as a, and other coloring mixed in the color of the density and different from the main coloring density, and the coloring density of a color showing high density is taken as b, a color purity factor in the invention is expressed by the following expression (B):

$$\text{Color purity factor}(\%) = (a-b)/a \times 100 \quad \text{(B)}$$

It is preferred the condition that the color purity factor expressed by expression (B) is 80% or more is obtained in all the region of from Dmin+0.1 to Dmax of the main coloring density, and it is preferred that the condition is obtained in every case of monochromatic exposure of red, green and blue. Dmin is a minimum value of coloring density in a photographic material, which is equivalent to the density after processing of an unexposed film. Dmax is a maximum value of coloring density in a photographic material. The maximum value of coloring density is equivalent to the maximum value of the density of digital image data. In the case of widely used Cineon system, the maximum density is a value between Dmin+2 and Dmin+2.2.

In the invention, for recording with little deterioration, a color purity factor is preferably 80% or more, more preferably 85% or more, and still more preferably 90% or more.

Apparatus that can be used in the invention in recording digital image data on a silver halide photographic material, what is called film recorders are not especially restricted and commercially available apparatus can be used.

As commercially available apparatus, for example, ARRILASER and ARRILASER HD using BGR laser as a eight source system (manufactured by ARRI), FURY and FIRESTORM using a CRT system (manufactured by CELCO), IMAGICA realtime and HSR high speed recorder using an LCOS system (manufactured by IMAGICA CORP.), and Cinevator One and Cinevator Five (manufactured by CINEVATION) are exemplified.

For achieving the above objects of the invention, it has been apparent from the results of eager examinations that the use of a silver halide photographic material designed so as to lessen the deterioration of an image at recording time is extremely effective. A major cause of the occurrence of blur of an image is in scattering of recording light on the inside of a photographic material, and the blur of an image can be conspicuously improved by the reduction of scattered light. Light scattering is largely influenced by silver halide fine grains contained in a photographic material, so that it is effective to lessen the use amount of silver halide fine grains as far as possible, and to make the size of silver halide fine grains smaller is also effective. Since any of these means results in the reduction of sensitivity of a photographic material, it is preferred to heighten the sensitivity of silver halide fine grains in advance. It is known to use a dye to absorb scattered light and this means can be preferably used. There are water-soluble dyes and fixable dyes (oil-soluble dyes or solid dispersible dyes) in the dyes, and water-soluble dyes are conventionally widely used in photographic materials, but it has been apparent from the results of our examinations that surprising effects can be obtained by suitable use of fixable dyes (oil-soluble dyes or solid dispersible dyes). For example, in a case where a fixable cyan dye absorbing red light (an oil-soluble cyan dye or a solid dispersible cyan dye) is used, it is effective to use the dye in an upper layer nearer to a red color-sensitive layer as far as possible. This is presumably due to the fact that the influence of scattered light can be minimized by the elimination of red light having been subjected to scattering in the photographic material just before arriving the red color-sensitive layer. Further, for increasing color purity, it is effective to prevent color mixture. When the use amount of a color mixing preventive used in the intermediate layer between each color-sensitive layer is insufficient, color mixture by processing occurs, while when an excess amount is used, the sensitivity of the photographic material is reduced, so that it is effective to optimize the amount. It is also important to reduce spectral color mixture by photosensitization of color-sensitive layers different from exposure color. For example, spectral color mixture can be reduced by making differences between green sensitivity, blue sensitivity and red sensitivity in a red color-sensitive layer great, and it is very effective for that purpose for the wavelengths of red light at the time of recording and red sensitivity of a photographic material to coincide.

Fixable dyes for use in the invention will be described in further detail.

It is sufficient for a magenta dye in the invention to have spectral absorption maximum wavelength substantially in the range of from 500 to 600 nm in the dry film of a photographic material to which the dye has been added, and dyes may be used by one kind alone or two or more dyes may be used in combination.

It is sufficient for a cyan dye in the invention to have spectral absorption maximum wavelength substantially in the range of from 600 to 700 nm in the dry film of a photographic material to which the dye has been added, and dyes may be used by one kind alone or two or more dyes may be used in combination.

In the invention, the terminology "dye is fixed" means that a dye added to an objective layer in preparation of the layer during the manufacture of a photographic material is substantially present in the objective layer without being diffused to layers other than the objective layer even after manufacture. A means to fix a dye in an objective layer may be any means, for example, the following methods are known.

As the addition methods of a dye to an objective layer, a method of directly dyeing gelatin, an oil-in-water dispersion method as described later, that is, a method of adding a dye by dissolving the dye with a high boiling point organic solvent having a boiling point of 175° C. or higher under normal pressure and, if necessary, using an organic solvent having a boiling point of from 50 to 160° C., and emulsifying and dispersing the dye in a gelatin aqueous solution containing a surfactant, a method of adding a dye of solid dispersion as disclosed in WO 88/4974, JP-T-1-502912 (the term "JP-T" as used herein refers to a "published Japanese translation of a PCT application"), and EP 0 456 148, and a method of preventing a dye from diffusion via a polymer mordant are exemplified. Representative polymer mordants are disclosed, e.g., in JP-A-5-188548, [chemical 9]. Any of the above methods can be used in the invention.

In the invention, dyes are added so as to reach the average optical density of preferably from 0.005 to 0.50, and more preferably from 0.02 to 0.30, in the region of from 500 to 600 nm with a magenta dye, and in the region of from 600 to 700 nm with a cyan dye, respectively, in the dry film of an objective layer. The density is found as follows. A dye is coated with gelatin on a transparent support and dried to prepare a sample, and the density of the sample in wavelengths of from 500 to 600 nm, or from 600 to 700 nm, is measured with a spectrophotometer. An average optical density in the region of 500 to 600 nm, or from 600 to 700 nm, is found from the integrated value.

The specific examples of magenta dyes and cyan dyes for use in the invention are shown below, but the invention is not restricted thereto.

D-1

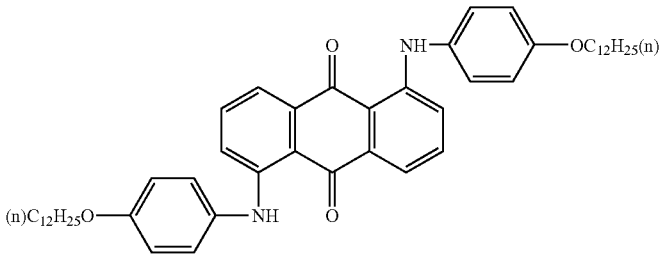

D-2

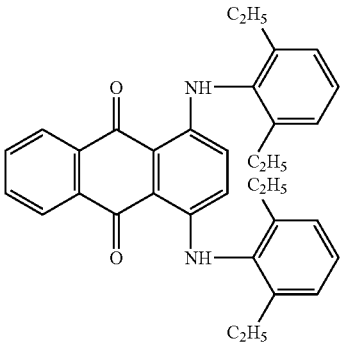

D-3

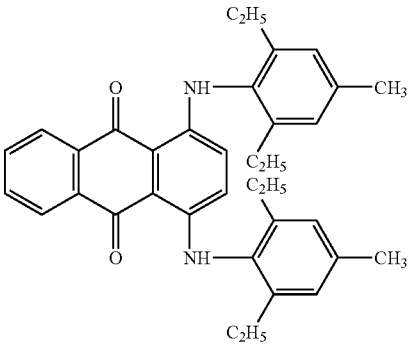

D-4

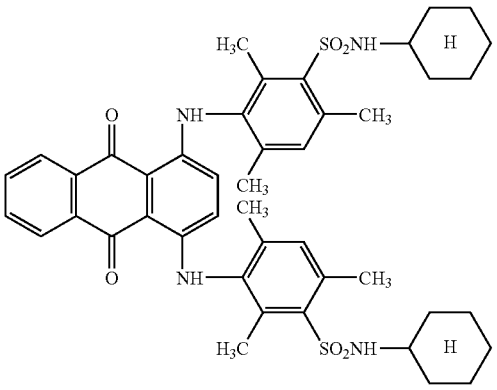

D-5

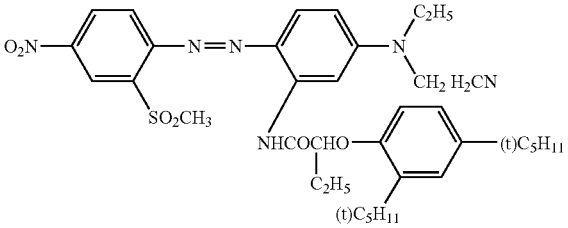

D-6

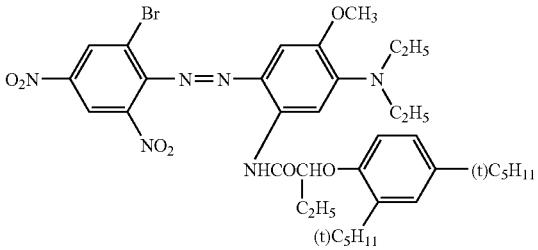

D-7

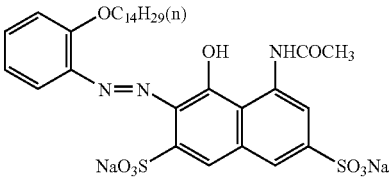

-continued
D-8
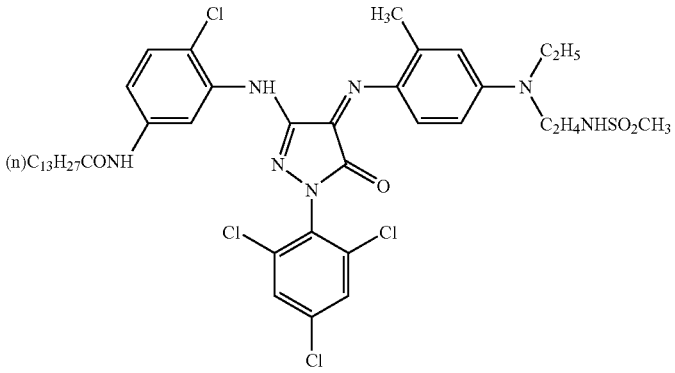
D-9
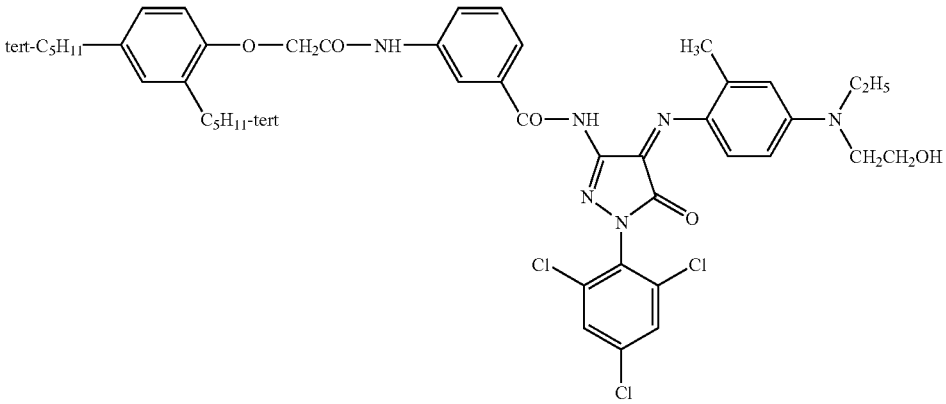
D-10
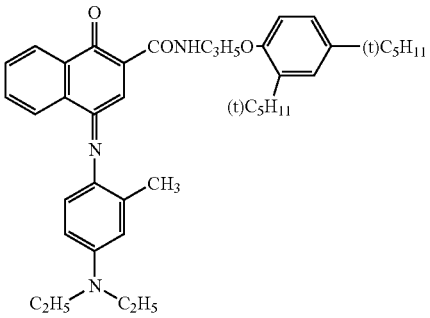
D-11
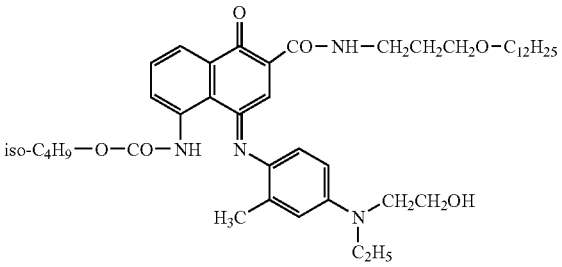
D-12
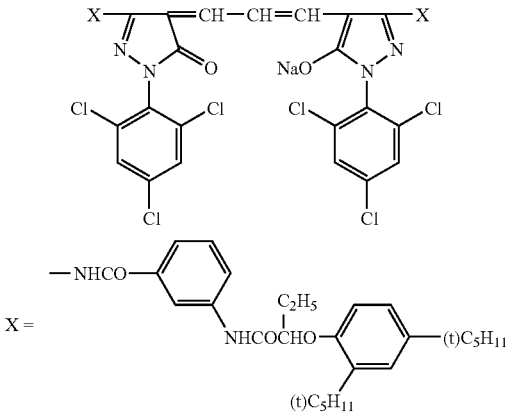
D-13
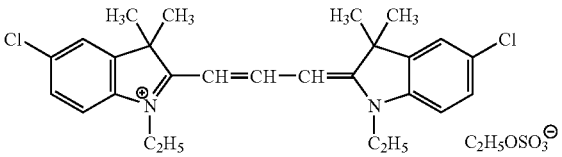

-continued
D-14
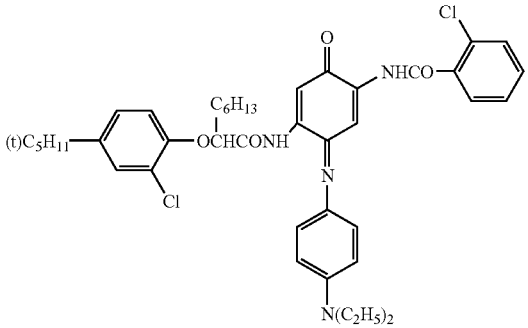
D-15
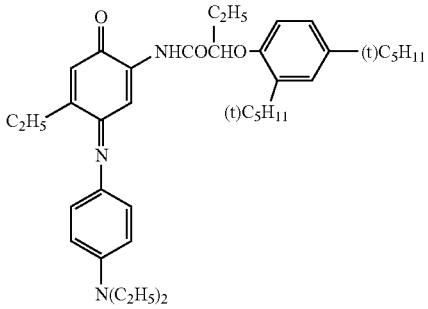
D-16
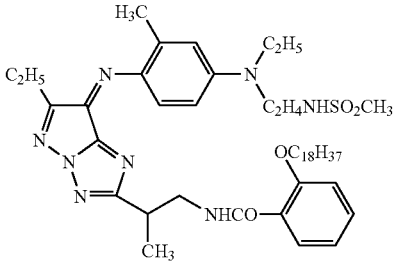
D-17
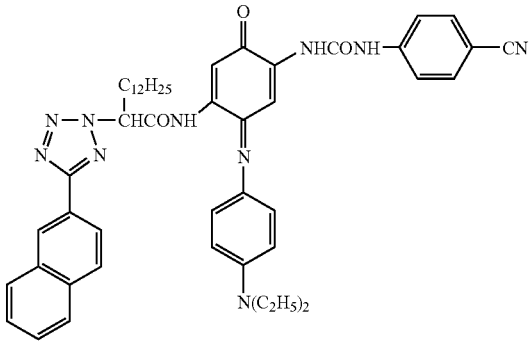
D-18
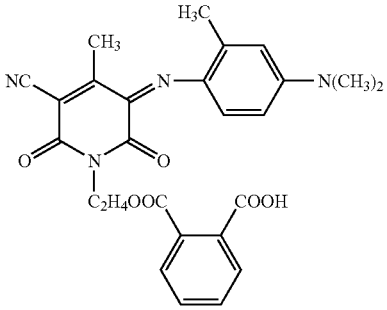
D-19
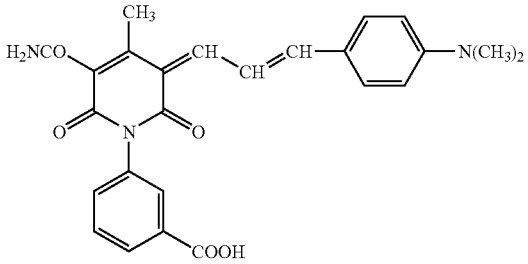
D-20
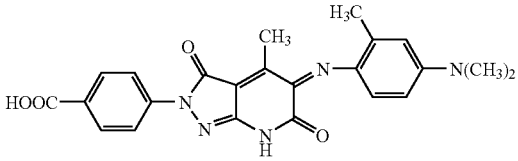
D-21
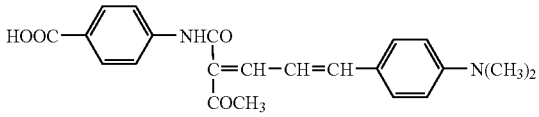
D-22
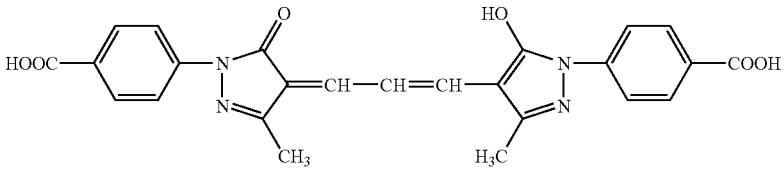
D-23
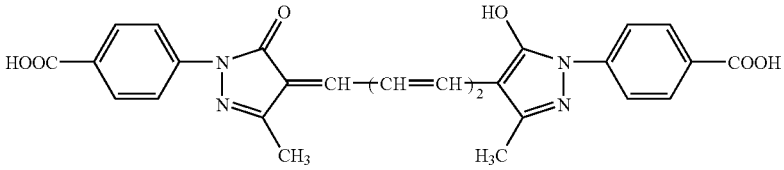

-continued
D-24
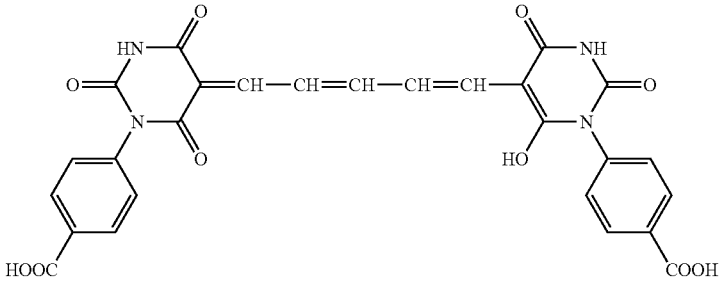
D-25
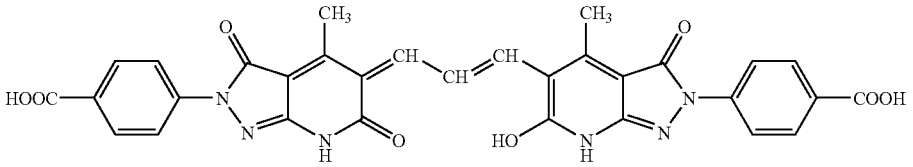
D-26
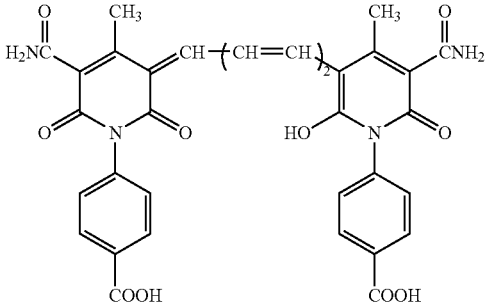
D-27
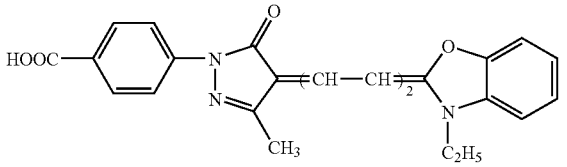
D-28
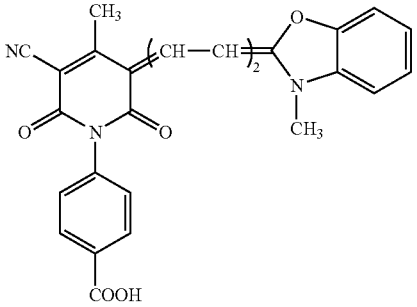
D-29
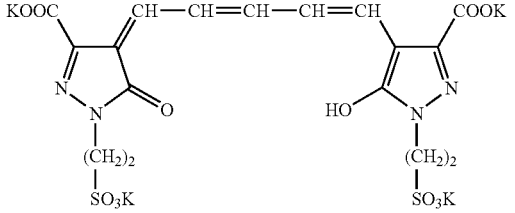
D-30
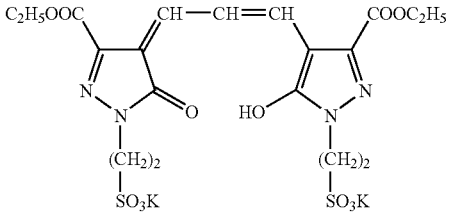
D-31
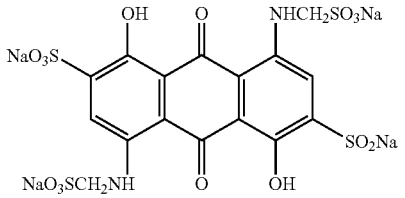
D-32
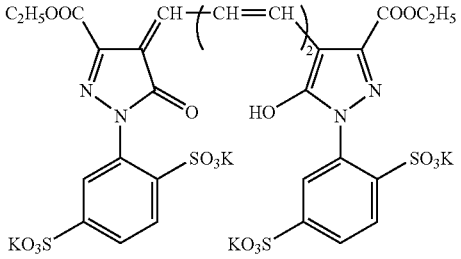
D-33
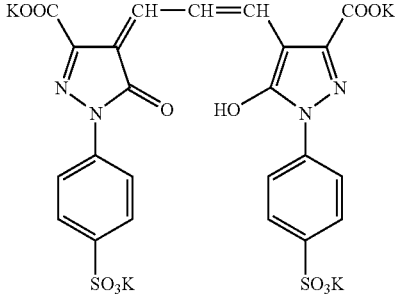

-continued

D-34

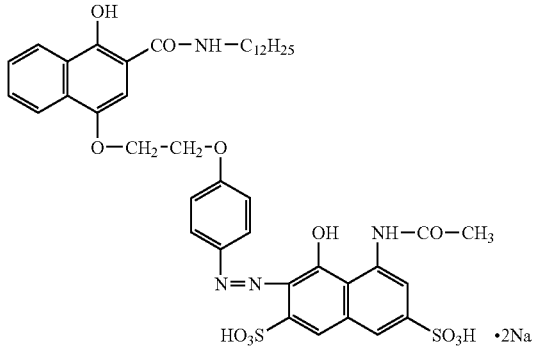

The above-exemplified compounds are disclosed in JP-A-61-48854, JP-A-61-7838. JP-A-60-243654, JP-A-60-32851, JP-A-62-276539, JP-A-52-92716, WO 88/04794, JP-A-3-7931. JP-A-4-45436, and JP-A-5-43809, or they can be synthesized according to the methods disclosed in these patents.

Couplers represented by formula (I) for use in the invention will be described in detail below.

Formula (I)

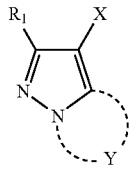

In formula (I), $R_1$ represents a hydrogen atom or a substituent; Y represents a nonmetallic atomic group necessary to form a 5-membered azole ring containing 2 or 3 nitrogen atoms, which azole ring may have a substituent (including a condensed ring); and X represents a hydrogen atom or a group capable of elimination at the time of coupling reaction with the oxidant of a developing agent.

Of the coupler skeletons represented by formula (I) for use in the invention, preferred skeletons are 1H-imidazo-[1,2-b] pyrazole, 1H-pyrazolo[1,5-b][1,2,4]triazole, and 1H-pyrazolo[5,1-c][1,2,4]triazole, and they are respectively represented by the following formula (M-I), (M-II) and (M-III).

(M-I)

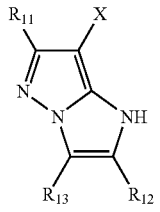

D-35

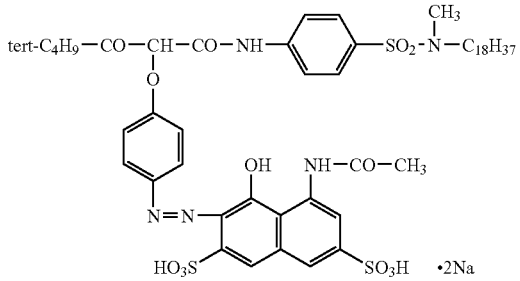

-continued (M-II)

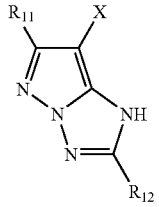

(M-III)

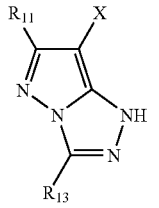

Substituents $R_{11}$, $R_{12}$, $R_{13}$ and X in the above formulae are described in detail below.

$R_{11}$ represents a hydrogen atom, a halogen atom, an alkyl group, an aryl group, a heterocyclic group, a cyano group, a hydroxyl group, a nitro group, a carboxyl group, an amino group, an alkoxyl group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonyl-amino group, an imido group, a heterocyclic thio group, a sulfinyl group, a phosphonyl group, an aryloxycarbonyl group, an acyl group, or an azolyl group. $R_{11}$ may form a bis group by a divalent group.

More specifically describing, $R_{11}$ represents a hydrogen atom, a halogen atom (e.g., a chlorine atom, a bromine atom), an alkyl group (e.g., a straight or branched chain alkyl group having from 1 to 32 carbon atoms, an aralkyl group, an alkenyl group, an alkynyl group, a cycloalkyl group, or a cycloalkenyl group, and specifically, e.g., methyl, ethyl, propyl, isopropyl, t-butyl, tridecyl, 2-methanesulfonylethyl, 3-(3-pentadecylphenoxy)propyl, 3-{4-{2-[4-(4-hydroxyphenyl-sulfonyl)phenoxy]dodecanamido}phenyl}propyl, 2-ethoxy-tridecyl, trifluoromethyl, cyclopentyl, 3-(2,4-di-t-amyl-phenoxy)propyl), an aryl group (e.g., phenyl 4-t-butylphenyl, 2,4-di-t-amylphenyl, 4-tetradecanamidophenyl), a hetero-cyclic group (e.g., 2-furyl, 2-thienyl, 2-pyrimidinyl, 2-benzothiazolyl), a cyano group, a hydroxyl group, a nitro group a carboxyl group, an amino group, an alkoxyl group (e.g., methoxy, ethoxy, 2-methoxyethoxy, 2-dodecylethoxy, 2-methanesulfonylethoxy), an aryloxy group (e.g., phenoxy, 2-methylphenoxy, 4-L-butylphenoxy 3-nitrophenoxy, 3-t-butyloxycarbamoylphenoxy, 3-methoxycarbamoyl), an acylamino group (e.g., acetamido, benzamido, tetradecanamido, 2-(2,4-di-t-amylphenoxy)butanamido, 4-(3-t-butyl-4-hydroxy-phenoxy)butanamido, 2-[4-(4-hydroxyphenylsulfonyl)phenoxy]-decanamido), an alkylamino group (e.g., methylamino, butylamino, dodecylamino, diethylamino-methylbutylamino), an amino group (e.g., phenylamino, 2-chloroamino, 2-chloro-5-tetradecanaminoanilino, 2-chloro-5-dodecyloxy-carbonylanilino, N-acetylanilino, 2-chloro-5-[α-(3-t-butyl-4-hydroxyphenoxy)dodecanamido]anilino), a ureido group (e.g., phenylureido, methylureido, N,N-dibutylureido), a sulfamoyl-amino group (e.g., N,N-dipropylsulfamoylamino, N-methyl-N-decylsulfamoylamino), an alkylthio group (e.g., methylthio, octylthio, tetradecyl-thio, 2-phenoxyethylthio, 3-phenoxypropylthio, 3-(4-t-butyl-phenoxy)propylthio), an arylthio group (e.g., phenylthio, 2-butoxy-5-t-octylphenylthio, 3-pentadecylphenylthio, 2-carboxyphenylthio, 4-tetradecanamidophenylthio), an alkoxycarbonylamino group (e.g., methoxycarbomylamino, tetradecyloxycarbonylamino), a sulfonamido group (e.g., methanesulfonamido, hexadecanesulfonamido, benzenesulfonamido, p-toluenesulfonamido, octadecanesulfonamido, 2-methyloxy-5-t-butylbenzenesulfonamido), a carbamoyl group (e.g., N-ethylcarbamoyl, N,N-dibutylcarbamoyl, N-(2-dodecyl-oxyethyl)carbamoyl, N-methyl-N-dodecylcarbamoyl, N-[3-(2,4-di-t-amylphenoxy)propyl]carbamoyl, a sulfamoyl group (e.g., N-ethylsulfamoyl, N,N-dipropylsulfamoyl, N-(2-dodecyloxy-ethyl) sulfamoyl, N-ethyl-N-dodecylsulfamoyl, N,N-diethylsulfamoyl), a sulfonyl group (e.g., methanesulfonyl, octanesulfonyl, benzenesulfonyl, toluenesulfonyl), an alkoxycarbonyl group (e.g., methoxycarbonyl, butyloxycarbonyl, dodecyloxycarbonyl, octadecyloxycarbonyl), a heterocyclic oxy group (e.g. 1-phenyltetrazol-5-oxy, 2-tetrahydro-pyranloxy), an azo group (e.g., phenylazo, 4-methoxyphenyl-azo, 4-pivaloylaminophenylazo, 2-hydroxy-4-propanoylphenylazo), an acyloxy group (e.g., acetoxy), a carbamoyloxy group (e.g., N-methylcarbamyloxy, N-phenylcarbamoyloxy), a silyloxy group (e.g. trimethylsilyloxy, dibutylmethylsilyloxy), an aryloxycarbonylamino group (e.g., phenoxycarbonyl-amino), an imido group (e.g., N-succinimido, N-phthalimido, 3-octadecenylsuccinimido), a heterocyclic thio group (e.g., 2-benzothiazolylthio, 2,4-diphenoxy-1,3,5-triazole-6-thio, 2-pyridylthio), a sulfinyl group (e.g., dodecanesulfinyl, 3-pentadecylphenylsulfinyl, 3-phenoxypropylsulfinyl), a phosphonyl group (e.g. phenoxyphosphonyl, octyloxy-phosphonyl, phenylphosphonyl), an aryloxycarbonyl group (e.g., phenoxycarbonyl), an acyl group (e.g., acetyl, 3-phenyl-propanoyl, benzoyl, 4-dodecyloxybenzoyl), or an azolyl group (e.g., imidazolyl, pyrazolyl, 3-chloro-pyrazol-1-yl, triazolyl). Of these substituents, groups capable of having a further substituent may further have an organic substituent linking by a carbon atom, an oxygen atom, a nitrogen atom or a sulfur atom; or a halogen atom.

Of these substituents, $R_{11}$ preferably represents an alkyl group, an aryl group, an alkoxyl group, an aryloxy group, an alkylthio group, a ureido group, a urethane group, or an acylamino group.

$R_{12}$ represents the same group as the substituents represented by $R_{11}$ exemplified above, and preferably represents a hydrogen atom, an alkyl group, an aryl group, a heterocyclic group, an alkoxycarbonyl group, a carbamoyl group, a sulfamoyl group, a sulfinyl group, an acyl group, or a cyano group.

$R_{13}$ represents the same group as the substituents represented by $R_{11}$ exemplified above, and preferably represents a hydrogen atom, an alkyl group, an aryl group, a heterocyclic group, an alkoxyl group, an aryloxy group, an alkylthio group, an arylthio group, an alkoxycarbonyl group, a carbamoyl group, or an acyl group, and more preferably an alkyl group, an aryl group, a heterocyclic group, an alkylthio group, or an arylthio group.

X represents a hydrogen atom or a group capable of elimination in the reaction with the oxidant of an aromatic primary amine developing agent. Specifically describing the eliminable groups, a halogen atom, an alkoxyl group, an aryloxy group, an acyloxy group, an alkyl- or aryl-sulfonyloxy group, an acylamino group, an alkyl- or aryl-sulfonamido group, an alkoxycarbonyloxy group, an aryloxycarbonyloxy group, an alkyl-, aryl-, or heterocyclic thio group, a carbamoylamino group, a 5- or 6-membered nitrogen-containing heterocyclic group, an imido group, and an arylazo group are exemplified. These groups may further be substituted with a substituent represented by $R_{11}$.

More specifically describing the eliminable groups, a halogen atom (e.g., a fluorine atom, a chlorine atom, a bromine atom), an alkoxyl group (e.g., ethoxy, dodecyloxy, methoxyethylcarbamoylmethoxy, carboxypropyloxy, methylsulfonyl-ethoxy, ethoxycarbonylmethoxy), an aryloxy group (e.g., 4-methylphenoxy, 4-chlorophenoxy, 4-methoxyphenoxy, 4-carboxy-phenoxy, 3-ethoxycarboxyphenoxy, 3-acetylaminophenoxy, 2-carboxyphenoxy), an acyloxy group (e.g., acetoxy, tetra-decanoyloxy, benzoyloxy), an alkyl- or aryl-sulfonyloxy group (e.g., methanesulfonyloxy, toluenesulfonyloxy), an acylamino group (e.g., dichloroacetylamino, heptafluorobutyrylamino), an alkyl- or aryl-sulfonamido group (e.g., methanesulfonamino, trifluoromethanesulfonamino, p-toluenesulfonylamino), an alkoxycarbonyloxy group (e.g., ethoxycarbonyloxy, benzyloxy-carbonyloxy), an aryloxycarbonyloxy group (e.g., phenoxy-carbonyloxy), an alkyl-, aryl-, or heterocyclic thio group (e.g., dodecylthio, 1-carboxydodecylthio, phenylthio, 2-butoxy-5-t-octylphenylthio, tetrazolylthio), a carbamoyl-amino group (e.g. N-methylcarbamoylamino, N-phenyl-carbamoylamino), a 5- or 6-membered nitrogen-containing heterocyclic group (e.g., imidazolyl, pyrazolyl, triazolyl, tetrazolyl, 1,2-dihydro-2-oxo-1-pyridyl), an imido group (e.g., succinimido, hydantoinyl), and an arylazo group (e.g., phenylazo, 4-methoxyphenylazo) are exemplified. In addition to these groups, as eliminable groups bonded via a carbon atom, X in some cases takes the form of a bis-type coupler obtained by condensation of a 4-equivalent coupler with aldehydes or ketones. Further, X may contain photographically useful groups such as a development inhibitor and a development accelerator. X preferably represents a halogen atom, an alkoxyl group, an aryloxy group, an alkyl- or aryl-thio group, or a 5- or 6-membered nitrogen-containing heterocyclic group bonding, to a coupling active site via a nitrogen atom.

The examples of magenta couplers represented by formula (I) are shown below, but the invention is not restricted to these compounds.

[M-1]
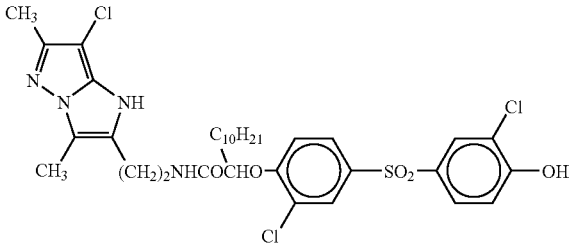
[M-2]
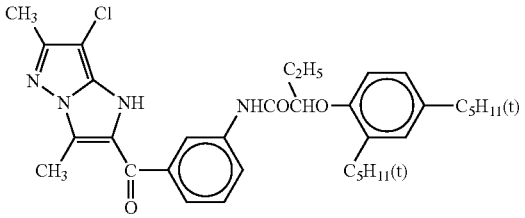
[M-3]
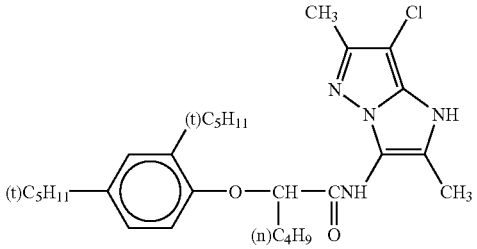
[M-4]
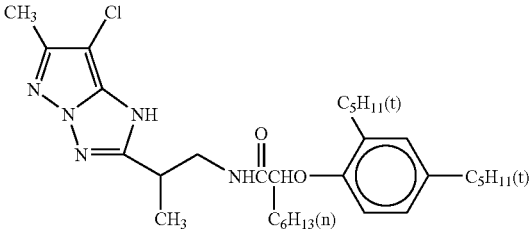
[M-5]
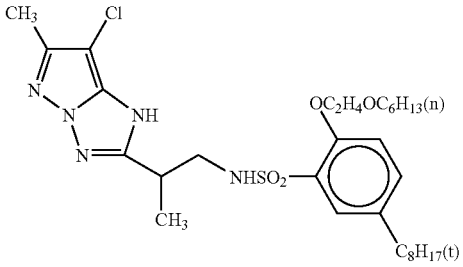
[M-6]
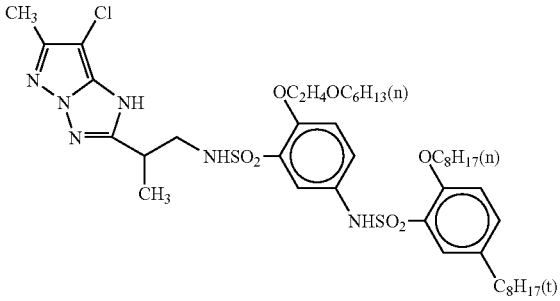

-continued
[M-7]
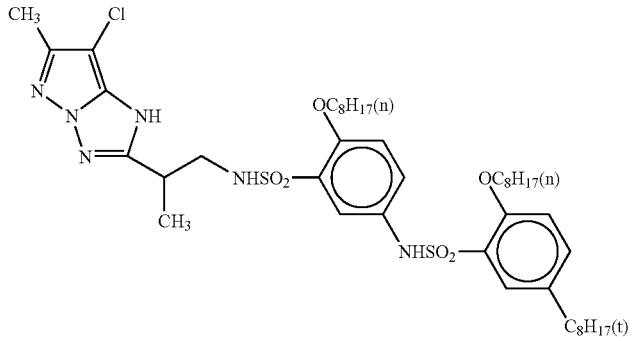
[M-9]
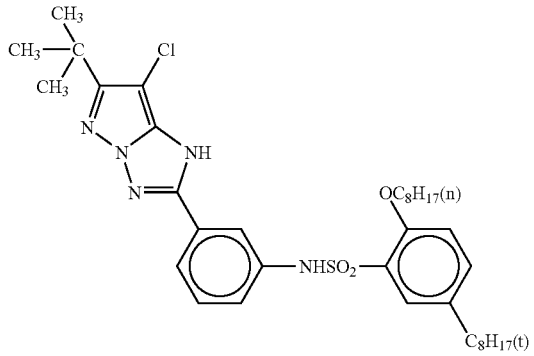
[M-8]
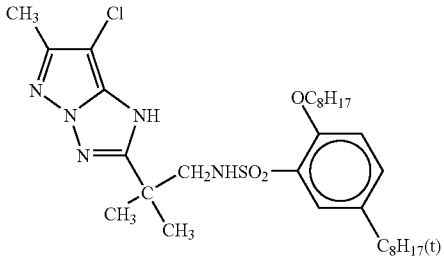
[M-10]
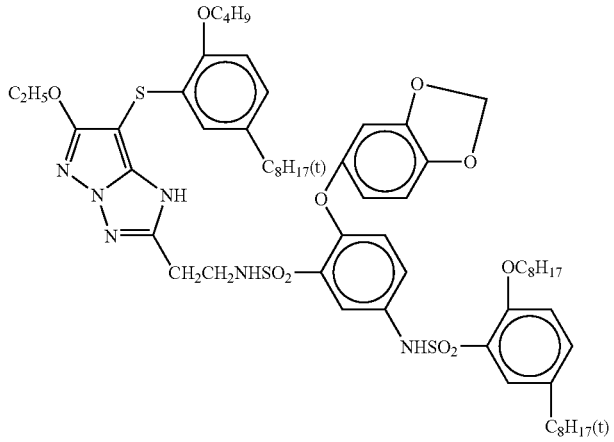
[M-11]
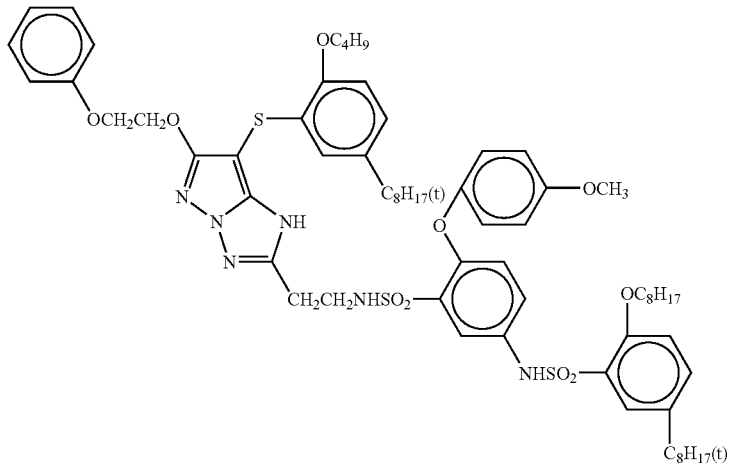

-continued
[M-12]
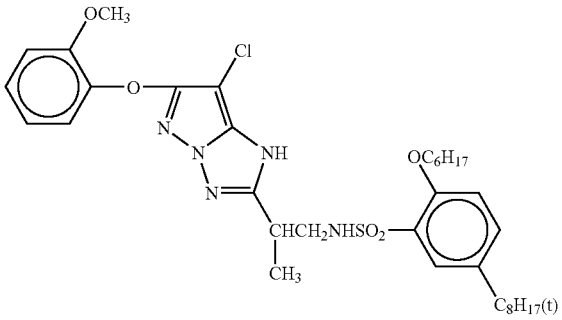
[M-13]
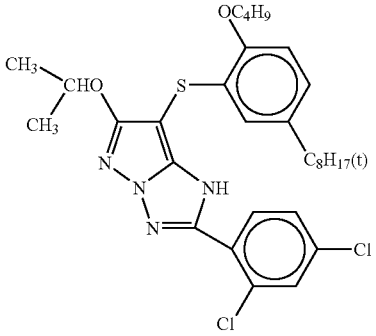
[M-14]
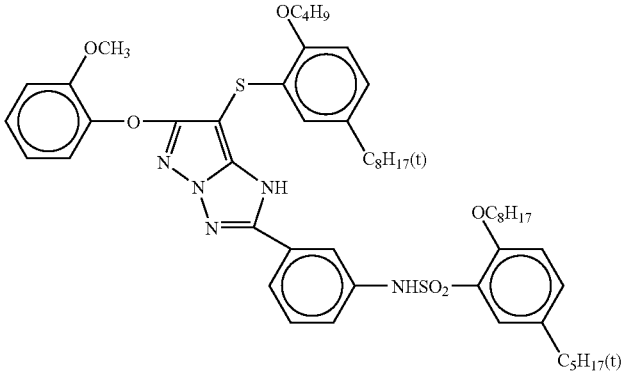
[M-15]
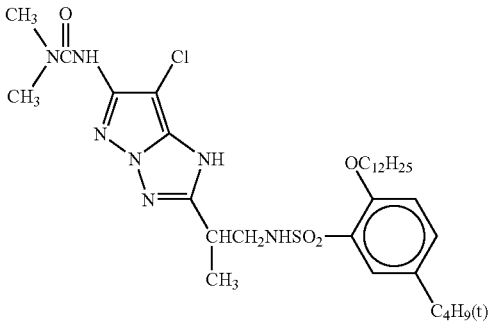
[M-16]
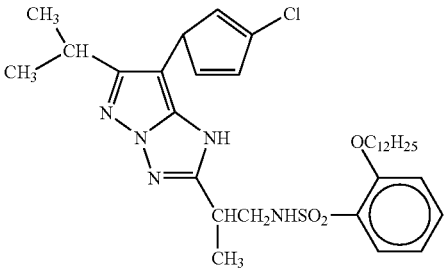

-continued
[M-17]
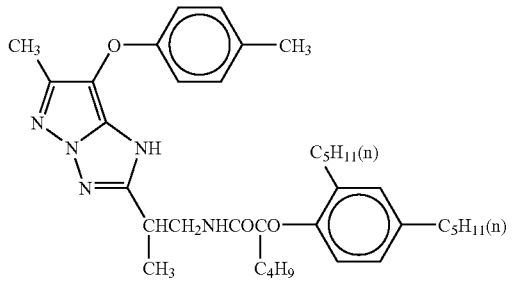
[M-18]
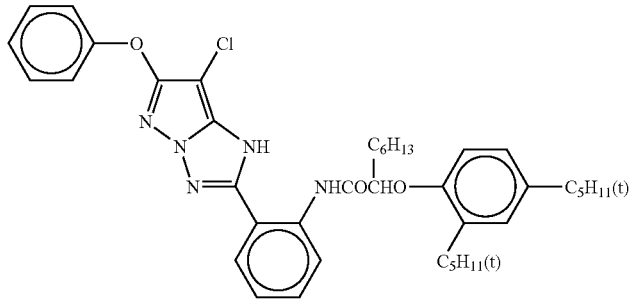
[M-19]
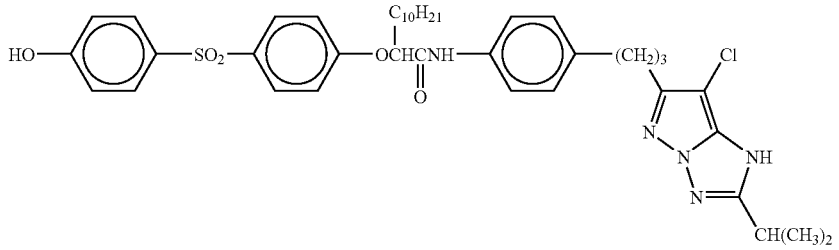
[M-20]
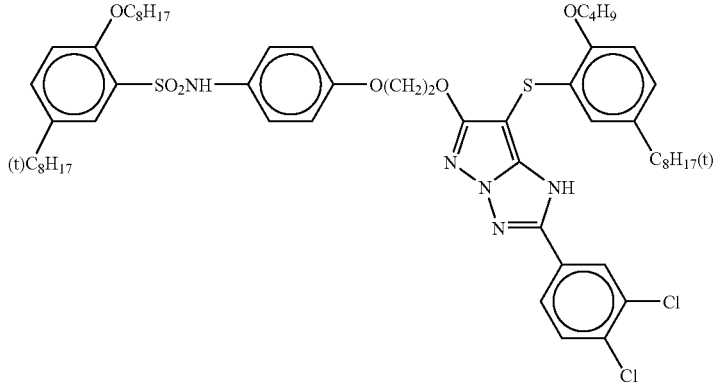
[M-21]
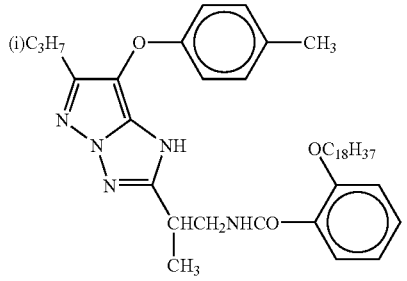
[M-22]
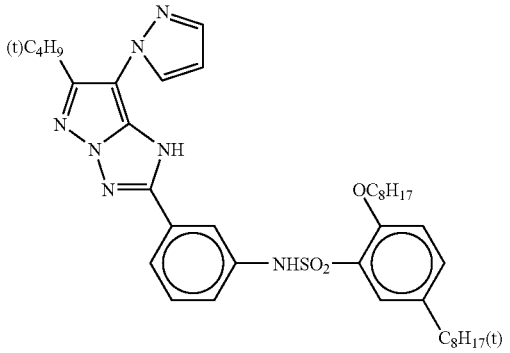

-continued
[M-23]
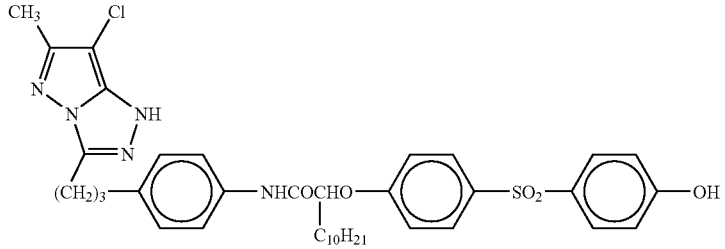
[M-24]
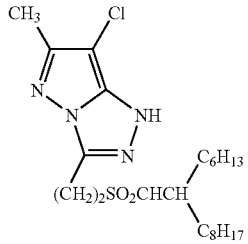
[M-25]
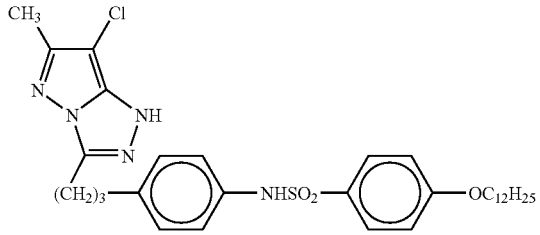
[M-26]
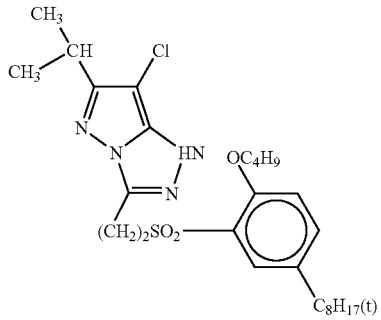
[M-27]
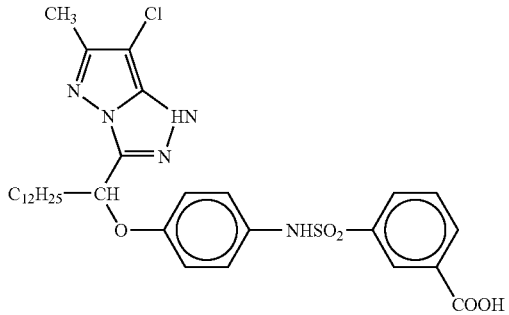
[M-28]
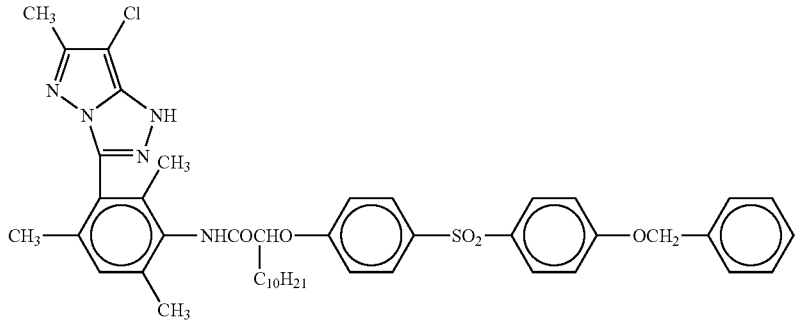
[M-29]
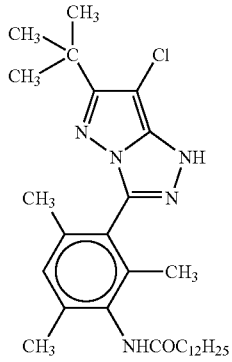
[M-30]
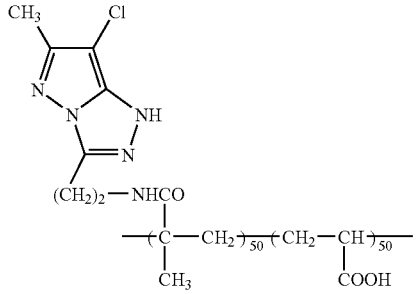

-continued
[M-31]
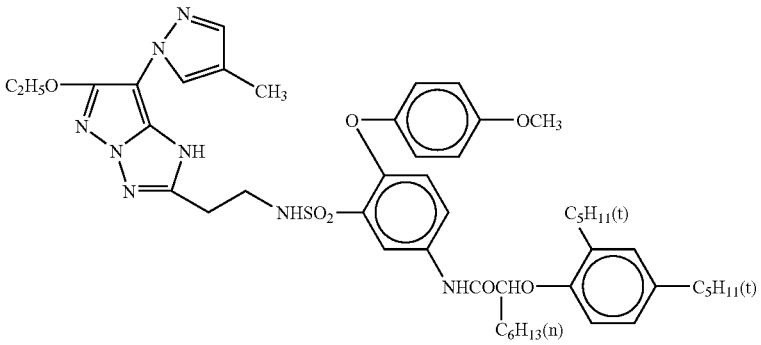
[M-32]
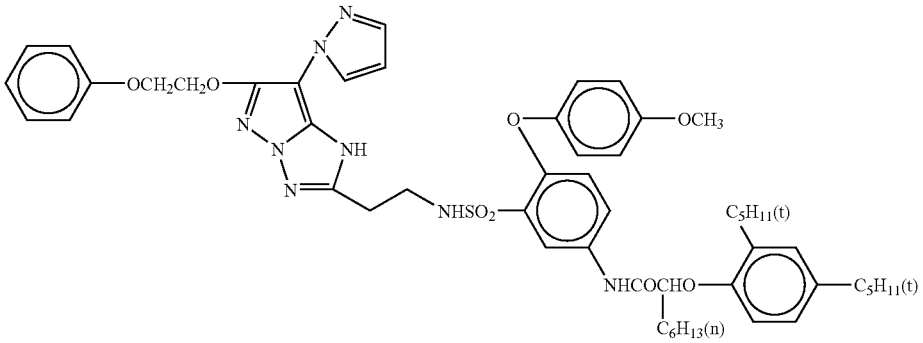
[M-33]
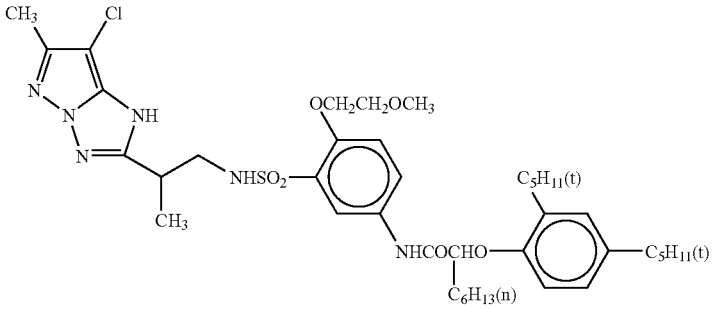
[M-34]
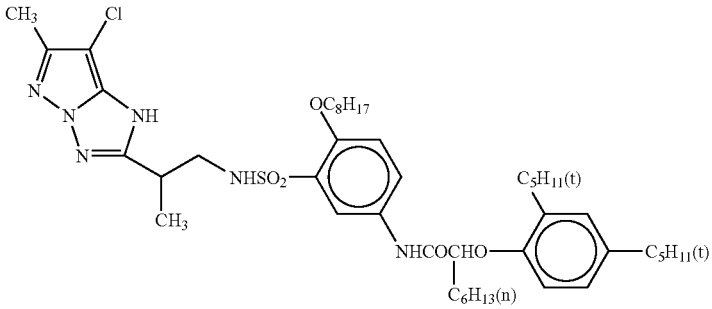
[M-35]
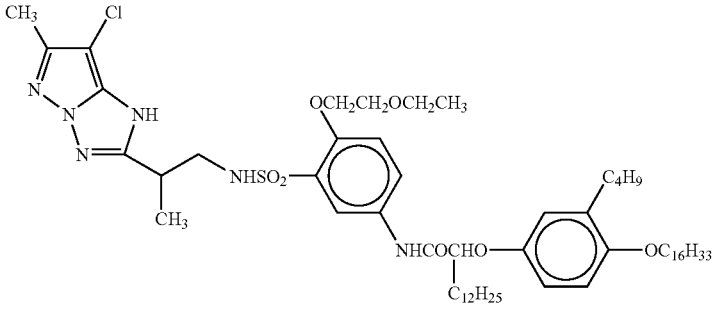

-continued

[M-36]

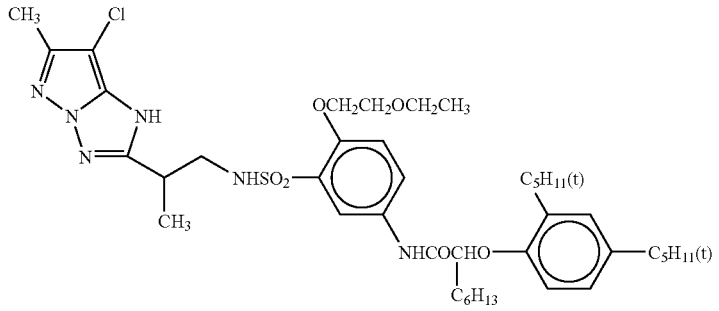

[M-37]

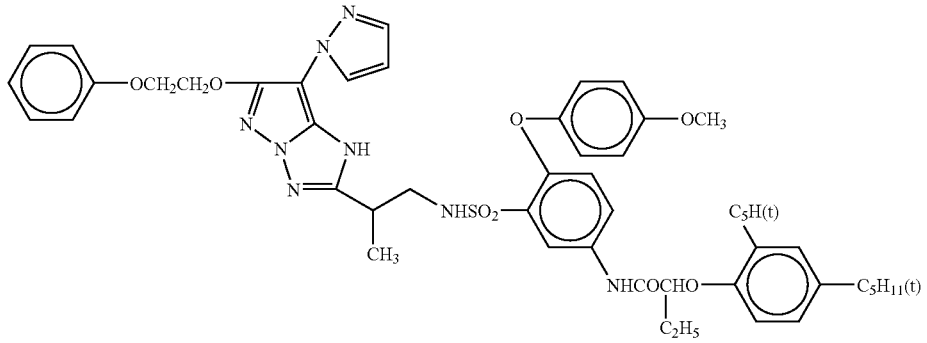

The couplers represented by formula (I) can be synthesized according to the synthesizing methods disclosed in the following patent documents.

The synthesizing method of the compounds represented by formula (M-I) is disclosed in U.S. Pat. No. 4,500,630; the compounds represented by formula (M-II) in U.S. Pat. Nos. 4,540,654, 4,705,863, JP-A-61-65245, JP-A-62-209457, and JP-A-62-249155; the compounds represented by formula (M-III) in JP-B-47-27411 (the term "JP-B" as used herein refers to an "examined Japanese patent publication"), and U.S. Pat. No. 3,725,067; and the compounds represented by formula (M-IV) are disclosed in JP-A-60-33552.

Couplers represented by formula (Z) for use in the invention will be described in detail below.

Formula (Z)

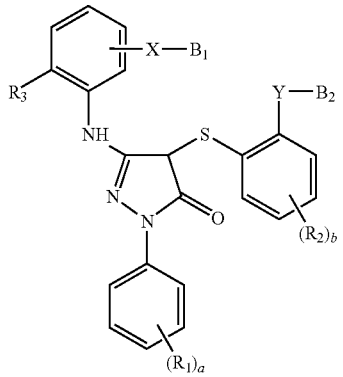

In formula (Z), a represents an integer of from 0 to 3; b represents an integer of from 0 to 2; $R_1$ and $R_2$ each represents a hydrogen atom, an allyl group, an alkoxyl group, a halogen atom, an aryl group, an aryloxy group, an acylamino group, a sulfonamido group, a sulfamoyl group, a carbamoyl group, an arylsulfonyl group, an aryloxycarbonyl group, an alkoxycarbonyl group, an alkoxysulfonyl group, an aryloxysulfonyl group, an alkylureido group, an arylureido group, a nitro group, a cyano group, a hydroxyl group, or a carboxyl group; $R_3$ represents a halogen atom, an alkyl group, or an aryl group; X and Y each represents a direct bond or a bonding group; and $B_1$ and $B_2$ each represents a stabilizing group not to diffuse a coupler.

In formula (Z), the examples of $R_1$ and $R_2$ include a hydrogen atom, an alkyl group including a straight chain or branched chain alkyl group such as an alkyl group having from 1 to 8 carbon atoms (e.g., a methyl group, a trifluoromethyl group, an ethyl group, a butyl group, and an octyl group), an alkoxyl group such as an alkoxyl group having from 1 to 8 carbon atoms (e.g., a methoxy group, an ethoxy group, a propoxy group, a 2-methoxyethoxy group, and a 2-ethylhexyloxy group), a halogen atom (e.g., a chlorine atom, a bromine atom, and a fluorine atom), an aryl group (e.g., a phenyl group, a naphthyl group, and a 4-tolyl group), an aryloxy group (e.g., a phenoxy group, a p-methoxyphenoxy group, a naphthyloxy group, and a tolyloxy group), an acylamino group (e.g., an acetamido group, a benzamido group, a butylamido group, and a t-butylcarbonamido group), a sulfonamido group (e.g., a methylsulfonamido group, a benzenesulfanamido group, and a p-toluoylsulfonamido group), a sulfamoyl group (e.g., an N-methylsulfamoyl groups an N,N-diethylsulfamoyl group, and an N,N-dimethylsulfamoyl group), a carbamoyl group (e.g., an N-methylcarbamoyl group and an N,N-dimethylcarbamoyl group), an arylsulfonyl group (e.g., a tolylsulfonyl group), an aryloxycarbonyl group (e.g., a phenoxycarbonyl group), an alkoxycarbonyl group such as an alkoxycarbonyl group having from 2 to 10 carbon atoms (e.g., a methoxycarbonyl group, an ethoxycarbonyl group, and a benzyloxycarbonyl group), an alkoxysulfonyl group such as an alkoxysulfonyl group having from 2 to 10 carbon atoms (e.g., a methoxysulfonyl group, an octyloxysulfonyl group, and a 2-ethylhexylsulfonyl group), an aryloxysulfonyl group (e.g., a phenoxysulfonyl group), an alkylureido group (e.g., an N-methylureido group, an N,N-dimethylureido group, and an N,N-dibutylureido group), an arylureido group (e.g., a phenylureido group), a nitro group, a cyano group, a hydroxyl group, and a carboxyl group.

The examples of $R_3$ include a halogen atom (e.g., a chlorine atom, a bromine atom, and a fluorine atom), an alkyl group including a straight chain or branched chain alkyl group such as an alkyl group having from 1 to 8 carbon atoms (e.g., a methyl group, a trifluoromethyl group, an ethyl group, a butyl group, and an octyl group), and an aryl group (e.g., a phenyl group, a naphthyl group, and a 4-tolyl group).

$B_1$ and $B_2$ each represents a stabilizing group, i.e., an organic group not to diffuse a coupler from the layer where the coupler is present. As such a stabilizing group, an organic hydrophobic group having from 8 to 32 carbon atoms bonded to a coupler directly or via a divalent bonding group X or Y (e.g., an alkylene group, an imino group, an ether group, a thioether group, a carbonamido group, a sulfonamido group, a ureido group, an ester group, an imido group, a carbamoyl group, or a sulfamoyl group) can be exemplified. As the specific examples of preferred stabilizing groups, an alkyl group (a straight chain, branched or cyclic alkyl group), an alkylene group, an alkoxyl group, an alkylaryl group an alkylaryloxy group, all acylamidoalkyl group, an alkoxyalkyl group, an alkoxyaryl group, an alkyl group substituted with an aryl group or a heterocyclic group, an aryl group substituted with an aryloxyalkoxycarbonyl group, and a residue contain both an alkenyl group or an alkenyl long chain aliphatic group and a carboxy group or a water-soluble sulfo group as disclosed in U.S. Pat. Nos. 3,337,344, 3,418,129, 3,892,572, 4,138,258, 4,451,559 and British Patent 1,494,777 are exemplified.

In the case of describing a compound or a substituent by using the term of "group" or "residue" in the invention, the described chemical substance includes a fundamental group or residue and a group or a residue having an ordinary substituent. In the case of describing a compound or a substituent by using the term of "site", the described chemical substance includes an unsubstituted chemical substance alone. "An alkyl group" includes not only an alkyl site such as each group of methyl, ethyl, butyl, octyl, or stearyl, but also a site having a substituent such as a halogen atom, a cyano group, a hydroxyl group, a nitro group, an amino group, or a carboxylate group. On the other hand, "an alkyl site" means each core group alone of methyl, ethyl, stearyl, or cyclohexyl.

The specific examples of the magenta couplers represented by formula (Z) for use in the invention are shown below, but the invention is not restricted to these compounds.

Z-1

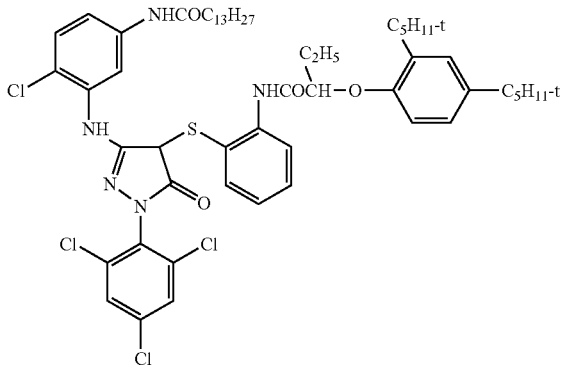

Z-2

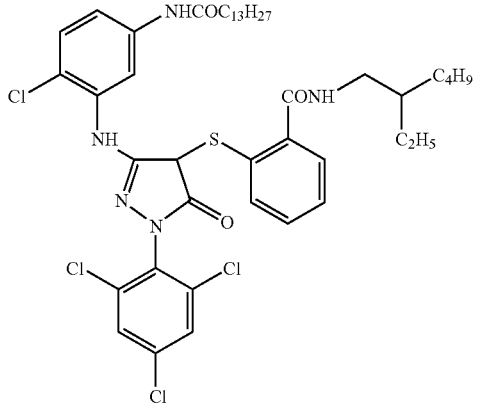

Z-3

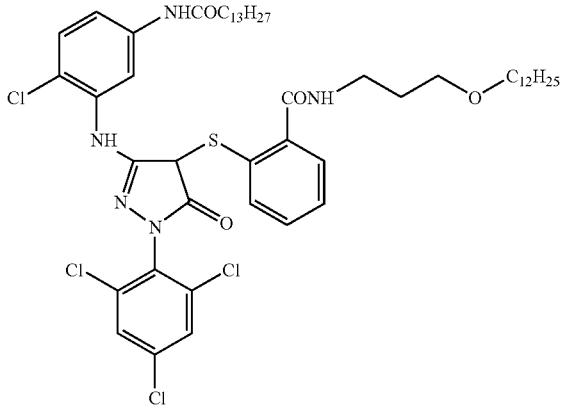

-continued

Z-4

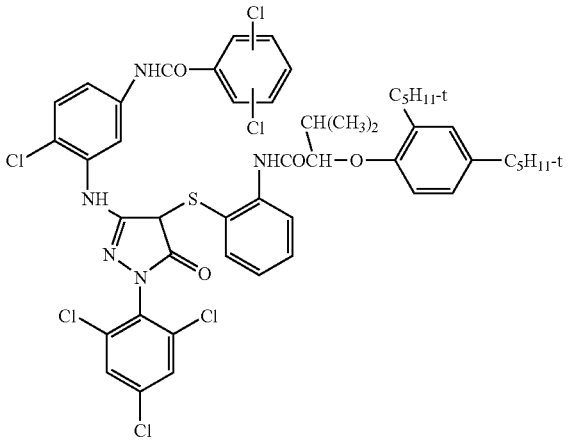

The coupler represented by formula (I) or (Z) in the invention can be used generally in the range of from $1\times10^{-3}$ to 1 mol per mol of silver halide in the layer where the coupler is used, and preferably in the range of from $1\times10^{-3}$ to $8\times10^{-1}$ mol. The coating amount is preferably from 0.01 to 1.0 g/m$^2$, more preferably from 0.05 to 0.8 g/m$^2$, and still more preferably from 0.1 to 0.5 g/m$^2$. When two or more green-sensitive layers where the coupler is used, are coated, the coupler in the invention is used at least in one layer, and more preferably the coupler is used in all the green-sensitive layers.

Couplers for use in the invention can be introduced into at photographic material by various well-known dispersing methods. The dispersion of the coupler in the invention can be prepared by dissolving the coupler in a low boiling point or partially water-soluble auxiliary organic solvent. As one embodiment of the invention, the coupler dispersion can be prepared with or without using a high boiling point organic solvent. An obtained organic solution can be mixed with a gelatin aqueous solution, and the resulting mixture can be dispersed through a mechanical stirrer having high shearing generally suited for preparing emulsion dispersion for photographic use, or suited for turbulent mixing, e.g., a colloid mill, a homogenizer, a micro-fluidizer, a high speed mixer, an ultrasonic disperser, a blade mixer, an apparatus of pumping a liquid flow under high pressure through an orifice or an interaction chamber, a Gaulin mill, or a blender, to obtain small grains of an organic phase suspended in an aqueous phase, thus emulsified dispersion for photographic use can be prepared.

The dispersion may be prepared with one or more apparatus. The auxiliary organic solvent is removed by evaporation, noodle washing, or membrane dialysis. The dispersion grains have an average grain size of preferably less than 2 μm, generally from 0.02 to 2 μm or so, and more preferably from 0.02 to 0.5 μm or so. These methods are disclosed in detail in U.S. Pat. Nos. 2,322,027, 2,787,544, 2,801,170, 2,801,171, 2,949,360 and 3,396,027.

The examples of high boiling point organic solvents for use in water-in-oil dispersing methods are disclosed in U.S. Pat. No. 2,322,027 and the like. The specific examples of high boiling point organic solvents having a boiling point of 175° C. or higher tinder normal pressure that are used in water-in-oil dispersing methods include phthalates (e.g., dibutyl phthalate, dicyclohexyl phthalate, di-2-ethylhexyl phthalate, decyl phthalate, bis(2,4-di-t-amylphenyl)phthalate, bis-(2,4-di-t-amylphenyl)isophthalate, and bis(1,1-diethyl-propyl)phthalate), phosphates or phosphonates (triphenyl phosphate, tricresyl phosphate, 2-ethylhexyl-diphenyl phosphate, tricyclohexyl phosphate, tri-2-ethyl-hexyl phosphate, tridodecyl phosphate, tributoxyethyl phosphate, trichloropropyl phosphate, and di-2-ethylhexyl-phenyl phosphonate), benzoates (e.g., 2-ethylhexyl benzoate, dodecyl benzoate, and 2-ethylhexyl-p-hydroxy benzoate), amides (e.g. N,N-diethyldodecanamide N,N-diethyllauryl-amide, and N-tetradecylpyrrolidone), alcohols or phenols (e.g., isostearyl alcohol, and 2,4-di-t-amylphenol), aliphatic carboxylates (e.g., bis(2-ethylhexyl) sebacate, dioctyl azelate, glycerol tributyrate, isostearyl lactate, and trioctyl citrate), aniline derivatives (e.g., N,N-dibutyl-2-butoxy-5-t-octylaniline), and hydrocarbons (e.g., paraffin, dodecylbenzene, and diisopropyl naphthalene). As auxiliary solvents, organic solvents having a boiling point of about 30° C. or higher, preferably 50° C. or higher and about 160° C. or lower can be used, and ethyl acetate, butyl acetate, ethyl propionate, methyl ethyl ketone, cyclohexanone, 2-ethoxyethyl acetate, and dimethylformamide are exemplified as representative examples.

The aqueous phase of coupler dispersion for use in the invention preferably contains gelatin as hydrophobic colloid. The hydrophobic colloid may be gelatin or modified gelatins such as acetylated gelatin phthalated gelatin, and gelatin oxide. Gelatin may be processed with a base such as line-processed gelatin, or with art acid such as acid-processed ossein gelatin. Further, other hydrophilic colloids such as water-soluble polymers or copolymers may be used. Although not limitative, they include polyvinyl alcohol, partially hydrolyzed polyvinyl acetate-co-vinyl alcohol, hydroxyethyl cellulose, polyacrylic acid, poly(1-vinylpyrrolidone), sodium polystyrenesulfonate, poly(2-acrylamido-2-methane-sulfonic acid), and polyacrylamide. Copolymers of these polymers having hydrophobic monomers may be used.

Surfactants may be present in the aqueous phase or organic phase, or dispersion can be prepared without using a surfactant. Surfactants that can be used in the invention are cationic, anionic, amphoteric and nonionic surfactants. The proportion of surfactant to a liquid organic solution is generally in the range of from 0.5 to 25 mass % in the case where small grain dispersion for photographic use is prepared. In a preferred embodiment of the invention, an anionic surfactant is contained in a gelatin aqueous solution. (In this specification, mass ratio is equal to weight ratio.)

Surfactants especially preferably use in the invention include alkali metal salt of alkylenesulfonic acid, e.g., sodium dodecylbenzenesulfonate, sodium isopropylnaphthalenesulfonate, and mixtures of sodium diisopropyl- and triisopropyl-naphthalenesulfonate; alkali metal salt of alkylsulfonic acid, e.g., sodium dodecylsulfate; and alkali metal salt of alkylsulfosuccinate, e.g., sodium bis(2-ethyl-hexyl)sulfosuccinate.

Spectral sensitizing dyestuffs (A) and (B) for use in the invention are described in detail below.

It is preferred for spectral sensitizing dyestuffs (A) and (B) for use in the invention to have proper difference in hydrophilic-hydrophobic property. It is known that generally the higher the hydrophobic property of a spectral sensitizing dyestuff, the higher is the adsorption energy of the dyestuff onto silver halide grains, and the lower, the lower. It is also known that the hydrophilic-hydrophobic property of a spectral sensitizing dyestuff can be generally controlled by the selection of the nucleus substituent, the number of methine chains, and the kind of substituents on the N-position.

As an index of the hydrophilic-hydrophobic property of a compound, e.g., ClogP is used. Hydrophilic-hydrophobic property can be generally found by a distribution coefficient of octanol/water of a compound (logP). Specifically, hydrophilic-hydrophobic property can be obtained by practical measurement according to the flask shaking method described in the following literature (1).

Literature 1: Yakubutsu no Kozo Kassei Sokan-Drug Design to Sayokiko Kenkyu eno Shishin (Correlation of Structure and Activity of Chemicals-Index to Study of Drug Design and Mechanism of Action), Kagaku no Ryoiki (Chemical Region), compiled by Toshio Fujita (the representative of Kozo Kassei Sokan Kondankai (Social Gathering of Correlation of Structure and Activity)), Extra Number, No. 122, Chapter 2, pages 43 to 203, published by Nankodo Co., Ltd. (1979). The flask shaking method is in particular described on pages 86 to 89.

However, there are cases where measurement is difficult when logP is 3 or more, therefore, measurement is regulated by using a model for computing logP. For example, there is CLOGP program of Hansch-Leo (Daylight Chemical Information Systems, U.S.A.) (ClogP can be computed with the version of algorithm of 4.01, and fragment data base of 17. Herein, P represents a distribution coefficient of octanol/water of a compound, and logP is the logarithm thereof. ClogP is logP found by computation, and in the invention ClogP is found by computation according to CLOGP program (C means that it is found by "computation".))

In the above computation, ClogP of the spectral sensitizing dyestuff (A) according to the invention is preferably the case of −0.5 or less, more preferably −1.7 or less, and most preferably −1.9 or less. ClogP of the spectral sensitizing dyestuff (B) according to the invention is preferably the case of −1.0 or more, more preferably −0.9 or more, and most preferably −0.8 or more.

By appropriately controlling the difference in hydrophilic-hydrophobic property of spectral sensitizing dyestuffs (A) and (B) for use in the invention, it is possible to cause difference in adsorption energy onto the surface of silver halide. Further, the higher the adsorption energy, the higher is the forming efficiency of J association on the surfaces of silver halide grains. Accordingly, spectral sensitizing dyestuff (B) according to the invention high in adsorption energy forms stronger J association on the surfaces of silver halide grains as compared with spectral sensitizing dyestuff (A) according to the invention does. On the other hand, spectral sensitizing dyestuff (A) according to the invention is taken into J association of spectral sensitizing dyestuff (B) according to the invention, since there is difference in adsorption energy, so that mixed J association can be found. That is, according to the difference in hydrophilic-hydrophobic property between spectral sensitizing dyestuffs (A) and (B) for use in the invention, it is possible to control the peak wavelength of spectral sensitivity to arbitrary peak wavelength.

Spectral sensitizing dyestuff (B) taken in which is used in the invention shows stronger adsorptivity as compared with the case where spectral sensitizing dyestuff (B) is present alone on the surfaces of silver halide grains, since spectral sensitizing dyestuff (A) for use in the invention serves for as an anchor. Therefore, starting of the spectral sensitizing dyestuff in the silver halide photographic material can be remarkably improved, and color mixture ascribable to transfer of a spectral sensitizing dyestuff to other photosensitive layers can be conspicuously restrained.

That is, as is known in the field of the industry, two or more kinds of different spectral sensitizing dyestuffs are used in combination to obtain spectral wavelength peak that cannot be obtained by one kind of spectral sensitizing dyestuff alone, and it is important to appropriately select spectral sensitizing dyestuffs different in ClogP value for obtaining desired wavelength peak and from the point of prevention of color mixture.

It is preferred to use Compound ExS-21 described in Example 1 of the invention as spectral sensitizing dyestuff (A) for use in the invention and Compound ExS-22 shown below as spectral sensitizing dyestuff (B) for use in the invention. By combining these sensitizing dyestuffs, it has become possible to obtain spectral sensitivity having absorption maximum in the vicinity of 530 nm suitable for a solid state laser for a green light source used in recent years in the field of manufacture of movies. However, it should not be construed that the invention is limited thereto.

ExS-21

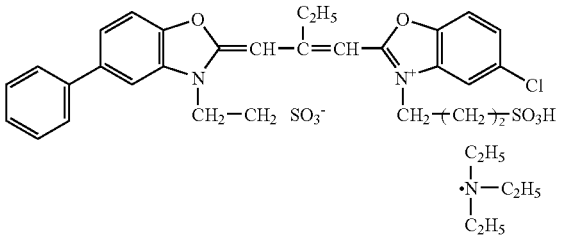

ExS-22

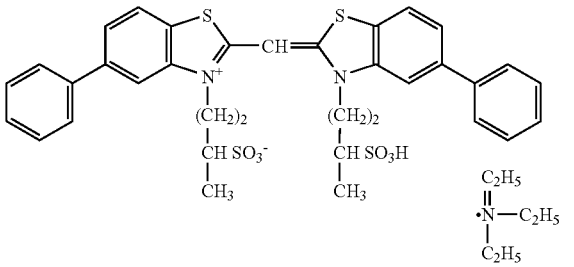

In general, when adsorption energy of a spectral sensitizing dyestuff onto the surfaces of silver halide grains is high the spectral sensitizing dyestuff remains in the silver halide photographic material after processing and causes color residue. Further, when the adsorption energy is low, color mixture ascribable to starting of the spectral sensitizing dyestuff to other photosensitive layers occurs.

Accordingly, it is important to appropriately set the use ratio of spectral sensitizing dyestuffs different in the hydrophilic-hydrophobic property from the viewpoint of prevention of color residue and color mixture.

That is, in the invention, for recording with little deterioration and free from color mixture and color residue, it is preferred for the addition amounts of spectral sensitizing dyestuffs (A) and (B) to the emulsions of photosensitive layers to satisfy the following expression (II-1), and it is more preferred to satisfy the following expression (II-2).

$$0.6 \leqq \text{formula } (A)(\text{mol/mol Ag})/\text{formula } (B)(\text{mol/mol Ag}) \leqq 1.6 \quad \text{(II-1)}$$

$$0.8 \leqq \text{formula } (A)(\text{mol/mol Ag})/\text{formula } (B)(\text{mol/mol Ag}) \leqq 1.2 \quad \text{(II-2)}$$

Silver halide grains of the emulsion) to which spectral sensitizing dyestuffs (A) and (B) are added are preferably cubic grains having (100) faces as external surfaces. A spectral sensitizing dyestuff is generally thermodynamically more stabilized by external surfaces of silver halide grains of (100)

faces than (111) faces. Seeing a silver halide rain from the external surface, as to (100) face, halogen ion sites on which a spectral sensitizing dyestuff is to be adsorbed are in a row in an orderly way in (110) direction, but as to (111) face, it is said that silver ion accounts for 3/7 of the lattice points on the uppermost layer, so that it can be said that it is relatively difficult for a spectral sensitizing dyestuff to form an association.

Accordingly, for recording free from color mixture, the silver halide grains are preferably cubic grains having (100) faces as external surfaces Compounds of type 1 and type 2 to be contained in a silver halide photographic material for use in the invention will be described below.

Compound of Type 1:

A compound in which one electron oxidant formed by oxidation of one electron is capable of further releasing one electron or more electrons followed by subsequent bond cleavage reaction Compound of Type 2:

A compound in which one electron oxidant formed by oxidation of one electron is capable of further releasing one electron or more electrons after having been subjected to subsequent bond-forming reaction Compounds of type 1 are described in the first place.

In compound of type 1, as compounds in which one electron oxidant formed by oxidation of one electron is capable of further releasing one electron followed by subsequent bond cleavage reaction, "1 photon 2 electron sensitizers" and compounds called "deprotonated electron donating sensitizers" as described in JP-A-9-211769 (specific examples: Compounds PMT-1 to S-37 described in Table E and Table F on pages 28 to 32), JP-A-9-211774 and JP-A-11-95355 (specific examples: Compounds INV 1 to 36), JP-T-2001-500996 (specific examples: Compounds 1 to 74, 80 to 87, 92 to 122), U.S. Pat. Nos. 5,747,235, 5,747,236, EP 786,692A1 (specific examples: Compound INV 1 to 35), EP 893,732A1, U.S. Pat. Nos. 6,054,260 and 5,994,051 are exemplified. The preferred ranges of these compounds are the same as the preferred ranges cited in respective patents.

Further, in compound of type 1, as compounds in which one electron oxidant formed by oxidation of one electron is capable of further releasing one electron or more electrons followed by subsequent bond cleavage reaction, the compound represented by the following formula (1) (the same meaning as formula (1) disclosed in JP-A-2003-114487), the compound represented by the following formula (2) (the same meaning as formula (2) in JP-A-2003-114487), the compound represented by the following formula (3) (the same meaning as formula (1) in JP-A-2003-114488), the compound represented by the following formula (4) (the same meaning as formula (2) in JP-A-2003-114488), the compound represented by the following formula (5) (the same meaning as formula (3) in JP-A-2003-114488), the compound represented by the following formula (6) (the same meaning as formula (1) in JP-A-2003-75950), the compound represented by the following formula (7) (the same meaning as formula (2) in JP-A-2003-75950), the compound represented by the following formula (8) (the same meaning as formula (1) in JP-A-2004-239943), and of the compounds capable of causing the reaction represented by the following chemical reaction formula (1) (the same meaning as chemical reaction formula (1) disclosed in JP-A-2004-245929), the compound represented by the following formula (9) (the same meaning as chemical reaction formula (3) in JP-A-2004-245929) are exemplified. The preferred ranges of these compounds are the same as the preferred ranges cited in respective patents.

Formula (1)

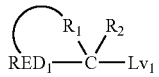

Formula (2)

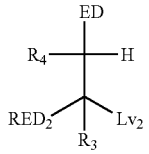

In formulae (1) and (2), $RED_1$ and $RED_2$ each represents a reducing group; $R_1$ represents a nonmetallic atomic group capable of forming a cyclic structure corresponding to a tetrahydro form or a hexahydro form of a 5- or 6-membered aromatic ring (including an aromatic heterocyclic ring) together with carbon atom (C) and $RED_1$; $R_2$, $R_3$ and $R_4$ each represents a hydrogen atom or a substituent; $Lv_1$ and $Lv_2$ each represents an eliminable group; and ED represents an electron donating group.

Formula (3)

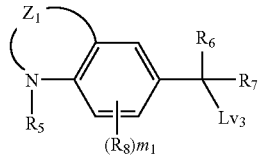

Formula (4)

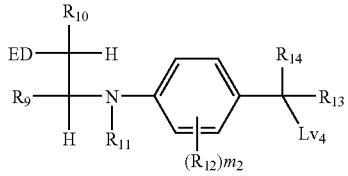

Formula (5)

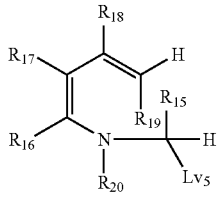

In formulae (3), (4) and (5), $Z_1$ represents an atomic group capable of forming a 6-membered ring together with a nitrogen atom and two carbon atoms of the benzene ring, $R_5$, $R_6$, $R_7$, $R_9$, $R_{10}$, $R_{11}$, $R_{13}$, $R_{14}$, $R_{15}$, $R_{16}$, $R_{17}$, $R_{18}$ and $R_{19}$ each represents a hydrogen atom or a substituent; $R_{20}$ represents a hydrogen atom or a substituent, but when $R_{20}$ represents a group other than an aryl group, $R_{16}$ and $R_{17}$ are bonded to each other to form an aromatic ring or an aromatic heterocyclic ring; $R_8$ and $R_{12}$ each represents a substituent capable of substituting with a benzene ring; m1 represents an integer of from 0 to 3; m2 represents an integer of from 0 to 4; and $Lv_3$, $Lv_4$ and $Lv_5$ each represents an eliminable group.

Formula (6)

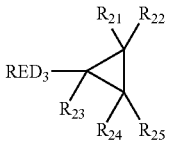

Formula (7)

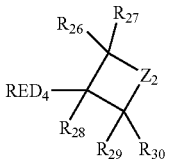

In formulae (6) and (7), $RED_3$ and $RED_4$ each represents a reducing group; $R_{21}$ to $R_{30}$ each represents a hydrogen atom or a substituent; $Z_2$ represents —$CR_{111}$, $R_{112}$-, —$NR_{113}$— or —O—; $R_{111}$ and $R_{112}$ each represents a hydrogen atom or a substituent; and $R_{113}$ represents a hydrogen atom, an alkyl group, an aryl group, or a heterocyclic group.

Formula (8)

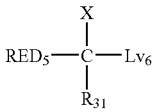

In formula (8), $RED_5$ is a reducing group and represents an arylamino group or a heterocyclic amino group; $R_{31}$ represents a hydrogen atom or a substituent; X represents an alkoxyl group, an aryloxy group, a heterocyclic oxy group, an alkylthio group, an arylthio group, a heterocyclic thio group, an alkylamino group, an arylamino group, or a heterocyclic amino group; and $Lv_6$ is an eliminable group and represents a carboxyl group or a salt thereof or a hydrogen atom.

Chemical Reaction Formula (1)

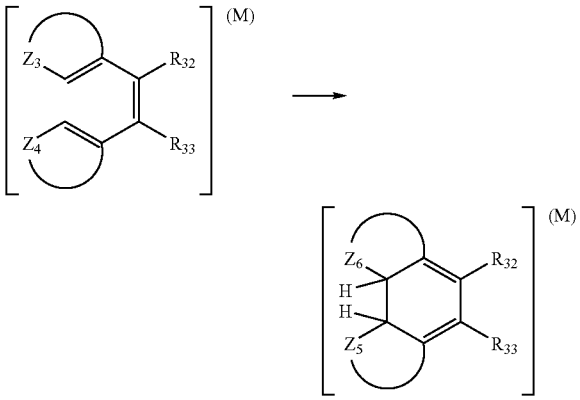

Formula (9)

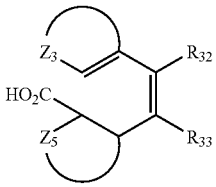

The compound represented by formula (9) is a compound that further causes bond-forming reaction represented by formula (1) by oxidation after 2 electron oxidation accompanied by decarboxylation. In formula (9). $R_{32}$ and $R_{33}$ each represents a hydrogen atom or a substituent; $Z_3$ represents a group forming a 5- or 6-membered heterocyclic ring together with C═C; and $Z_5$ represents a group forming a 5- or 6-membered cyclic aliphatic hydrocarbon group or a heterocyclic group together with C—C. In chemical reaction formula (1), $R_{32}$, $R_{33}$ and $Z_3$ respectively have the same meaning as those in formula (9). $Z_4$ represents a group forming a 5- or 6-membered aryl group or a heterocyclic group together with C═C; $Z_6$ represents a group forming a 5- or 6-membered heterocyclic group together vital C—C; and M represents a radical, a radical cation, or a cation.

Chemical Reaction Formula (1)

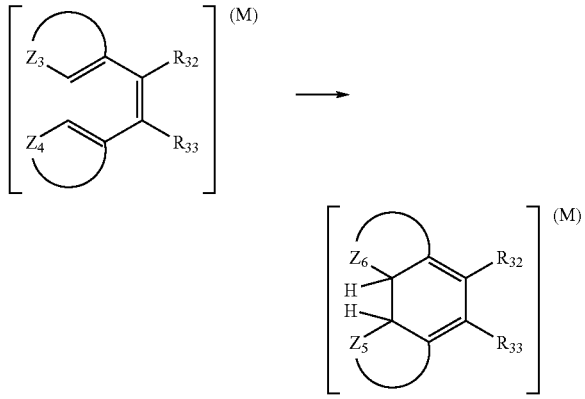

Compounds of type 2 are described in the next place.

In compound of type 2, as compounds in which one electron oxidant formed by oxidation of one electron is capable of further releasing one electron or more electrons after having been subjected to subsequent bond-forming reaction, the compound represented by the following formula (10) (the same meaning as formula (1) disclosed in JP-A-2003-140287), and the compound capable of causing the reaction represented by chemical reaction formula (1) (the same meaning as chemical reaction formula (1) disclosed in JP-A-2004-245929) and represented by the following formula (11) (the same meaning as formula (2) disclosed in JP-A-2004-245)-29) are exemplified. The organic compound capable of forming an (n+m)-valent cation (n and m each represents an integer of 1 or more) from an n-valent cation radical followed by intramolecular cyclization reaction as disclosed in JP-A-2003-121954 is also included in the compound of type 2. The preferred ranges of these compounds are the same as the preferred ranges cited in respective patents.

$RED_6$-Q-Y Formula (10)

In formula (10), $RED_6$ represents one electron oxidized reducing group; Y represents a carbon-carbon double bonding site, a carbon-carbon triple bonding site, and an aromatic group site capable of forming a new bond by reaction with one electron oxidant formed by one electron oxidation of $RED_6$, or a reactive group containing a non-aromatic heterocyclic site of benzo-condensation; and Q represents a linking group for linking $RED_6$ and Y.

Chemical Reaction Formula (1)

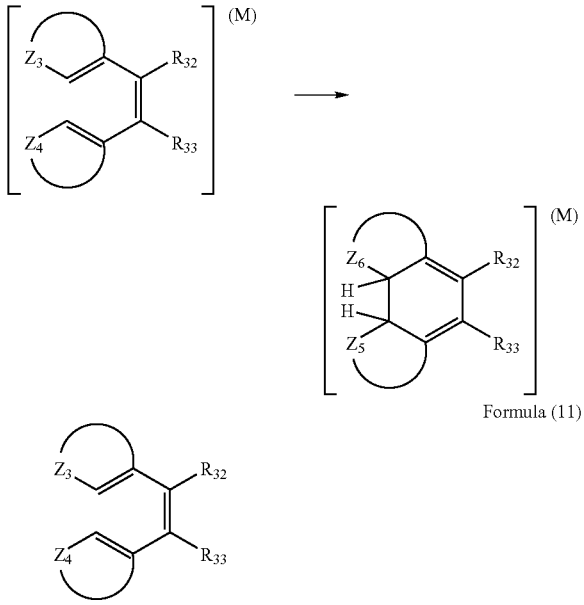

Formula (11)

The compound represented by formula (11) is a compound causing bond-forming reaction represented by chemical reaction formula (1) by being oxidized. In chemical reaction formula (1), $R_{32}$ and $R_{33}$ each represents a hydrogen atom or a substituent; $Z_3$ represents a group forming a 5- or 6-membered heterocyclic ring together with C═C; $Z_4$ represents a group forming a 5- or 6-membered aryl group or heterocyclic group together with C═C; $Z_5$ and $Z_6$ each represents a group forming a 5- or 6-membered cyclic aliphatic hydrocarbon group together with C—C; and M represents a radical, a radical cation, or a cation. In formula (II), $R_{32}$, $R_{33}$, $Z_3$ and $Z_4$ respectively have the same meaning as those in chemical reaction formula (1).

Of the compounds of types 1 and 2, preferred compounds are "compounds having an adsorptive group to silver halide in the molecule" or "compounds having a partial structure of a spectral sensitizing dyestuff in the molecule". As the adsorptive group to silver halide, the groups disclosed in JP-A-2003-156823, page 16, line 1 on the right to page 17, line 12 on the right are representative. The partial structure of a spectral sensitizing dyestuff is the structure disclosed in the same patent, page 17, line 34 on the right to page 18, line 6 on the left.

Of the compounds of types 1 and 2, more preferred compounds are "compounds having at least one adsorptive group to silver halide in the molecule", and still more preferred compounds are "compounds having two or more adsorptive groups to silver halide in one and the same molecule". When two or more adsorptive groups are present in one and the same molecule, these adsorptive groups may be the same or different from each other.

The examples of preferred adsorptive groups include mercapto-substituted nitrogen-containing heterocyclic groups (e.g., a 2-mercaptothiadiazole group, a 3-mercapto-1,2,4-triazole group, a 5-mercaptotetrazole group, a 2-mercapto-1,3,4-oxadiazole group, a 2-mercaptobenzoxazole group, a 2-mercaptobenzothiazole group, and 1,5-dimethyl-1,2,4-triazolium-3-thiolate group), and nitrogen-containing heterocyclic groups having an —NH— group capable of forming imino silver (>NAg) as the partial structure of a heterocyclic ring (e.g., a benzotriazole group, a benzimidazole group, and an indazole group). Especially preferred adsorptive groups are a 5-mercaptotetrazole group, a 3-mercapto-1,2,4-triazole group, and a benzotriazole group and the most preferred groups are a 3-mercapto-1,2,4-triazole group and a 5-mercapto-tetrazole group.

As adsorptive groups, groups having two or more mercapto groups in the molecule as the partial structure are also especially preferred. A mercapto group (—SH) may be a thione group when the mercapto group can be tautomerized. The preferred examples of adsorptive groups having two or more mercapto groups as the partial structures (dimercapto-substituted nitrogen-containing heterocyclic group and the like) include a 2,4-dimercaptopyrimidine group, a 2,4-dimercaptotriazine group, and a 3,5-dimercapto-1,2,4-triazole group.

Quaternary salt structures of nitrogen or phosphorus are also preferably used as adsorptive groups. As the quaternary salt structures of nitrogen, an ammonium group (a trialkylammonium group, a dialkylaryl- (or hetero aryl)ammonium group, and an alkyldiaryl- (or hetero aryl)ammonium group), and a group containing a nitrogen-containing heterocyclic group containing, a quaternized nitrogen atom are specifically exemplified. As the quaternary salt structures of phosphorus, a phosphonium group (a trialkylphosphonium group, a dialkyl-aryl- (or hetero aryl)phosphonium group, an alkyldiaryl- (or hetero aryl)phosphonium group, and a triaryl- (or hetero aryl)phosphonium group) are specifically exemplified. More preferably, quaternized salt structures of nitrogen are used. Still more preferably, 5- or 6-membered nitrogen-containing aromatic heterocyclic group containing a quaternized nitrogen atom are used. Especially preferably, a pyridinium group, a quinolinium group, and an isoquinolinium group are used. These nitrogen-containing heterocyclic groups containing a quaternized nitrogen atom may contain an arbitrary substituent.

As the examples of counter anions of quaternary salts, a halogen ion, a carboxylate ion, a sulfonate ion, a sulfate ion, a perchlorate ion, a carbonate ion, a nitrate ion, $BF_4^-$, $PF_6^-$ and $Ph_4B^-$ exemplified. When a group having negative electric charge in the molecule is present in a carboxylate group and the like, inner salt may be formed therewith. As counter anions not present in the molecule, a chlorine ion, a bromine ion and a methanesulfonate ion are especially preferred.

A preferred structure of a compound of type 1 or 2 having a quaternary salt structure of nitrogen or phosphorus as the adsorptive group is represented by the following formula (X).

$$(P\text{-}Q_1\text{-})_i\text{-}R(\text{-}Q_2\text{-}S)_j \qquad \text{Formula (X)}$$

In formula (X), P and R each represents a quaternary salt structure of nitrogen or phosphorus not the partial structure of a sensitizing dyestuff; and $Q_1$ and $Q_2$ each represents a linking group, and specifically a single group of each group or a group comprising combination of these groups of a single bond, an alkylene group, an arylene group, a heterocyclic group, —O—, —S—, —NRN—, —C(═O)—, —$SO_2$—, —SO—, —P(═O)—. RN represents a hydrogen atom, an alkyl group, an aryl group, or a heterocyclic group; S represents a residue obtained by removing one atom from the compound of type 1 or 2; i and j each represents an integer of 1 or more, and they are selected from the range of i+j being from 2 to 6, preferably i is from 1 to 3 and j is 1 or 2, more preferably i is 1 or 2 and j is 1, and especially preferably i is 1 and j is 1. The compound represented by formula (X) preferably has a total number of carbon atoms of from 10 to 100, more preferably from 10 to 70, still more preferably from 11 to 60, and especially preferably from 12 to 50.

The specific examples of the compounds of type 1 and type 2 are shown below, but the invention is not restricted to these examples.
1
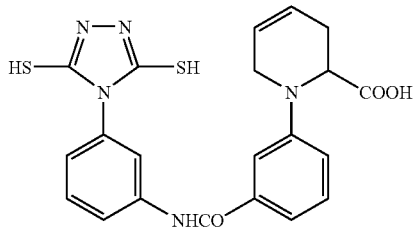
2
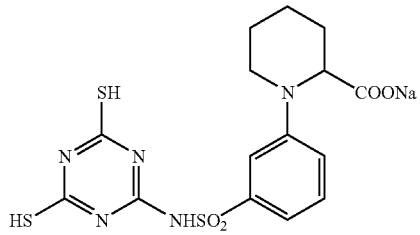
3
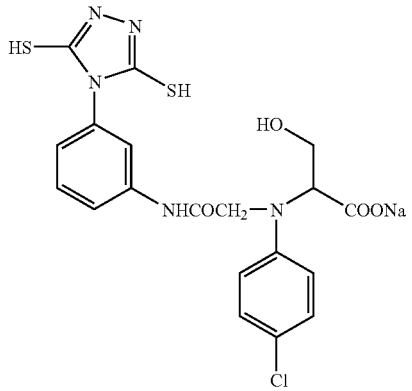
4
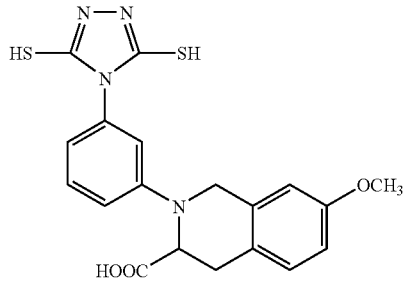
5
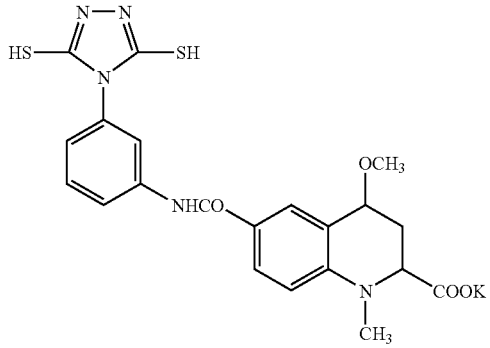
6
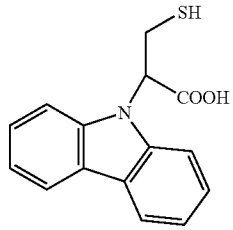
7
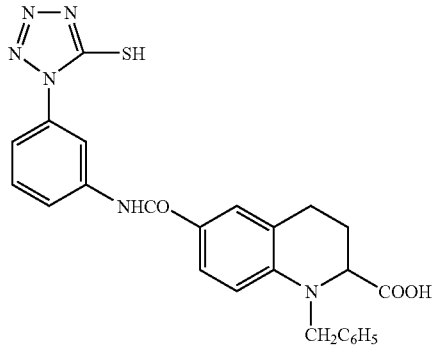
8
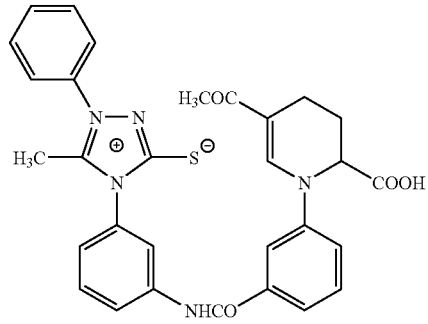

-continued
9
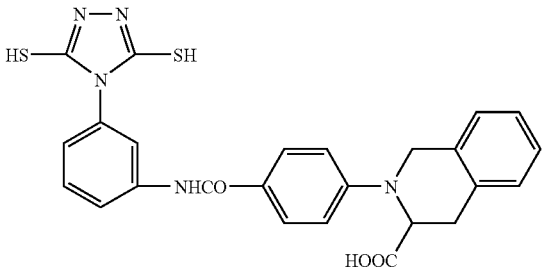
10
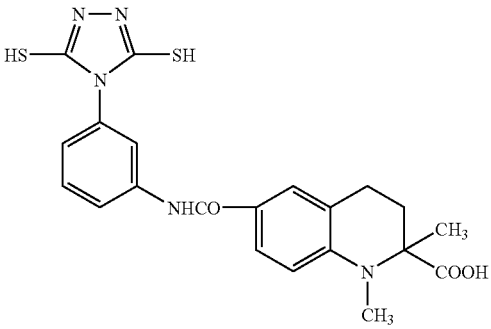
11
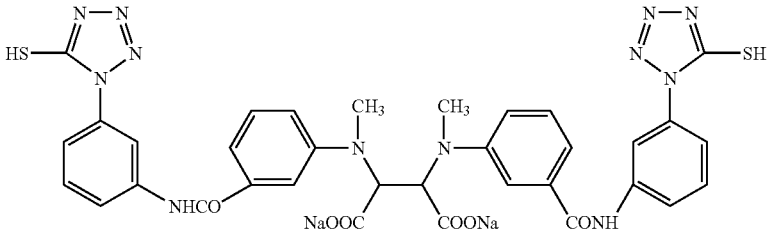
12
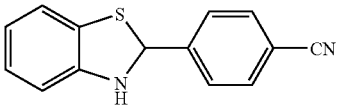
13
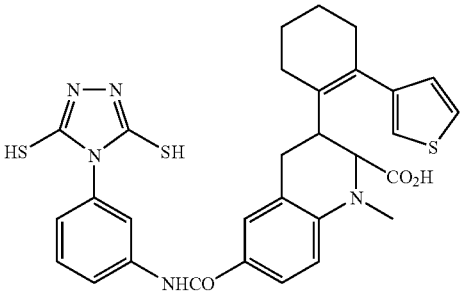
14
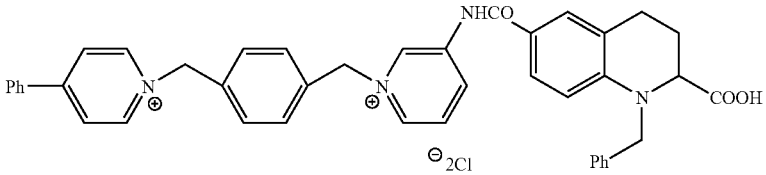
15
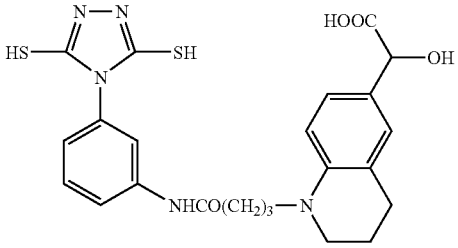
16
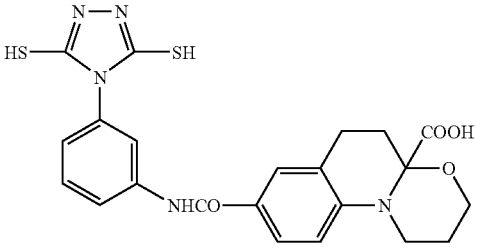

-continued
17
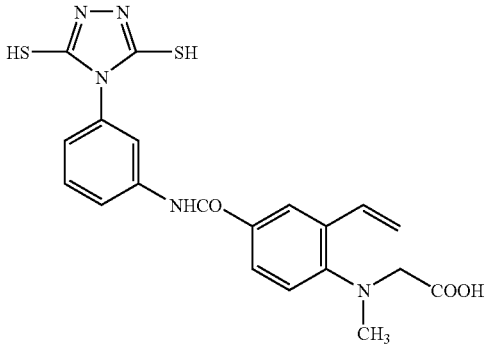
18
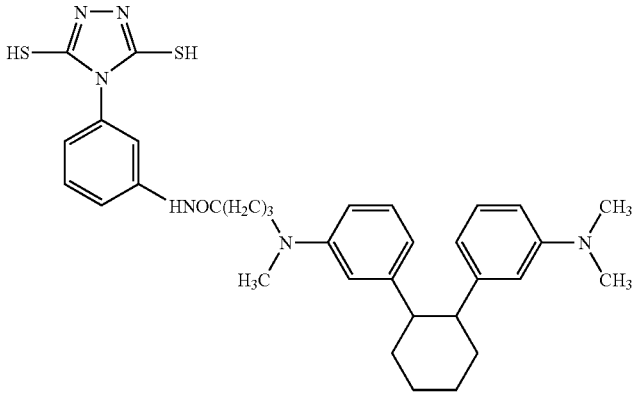
19
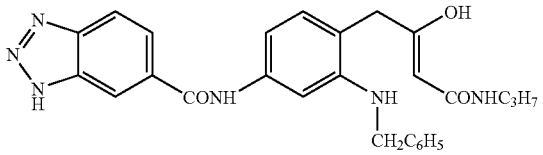
20
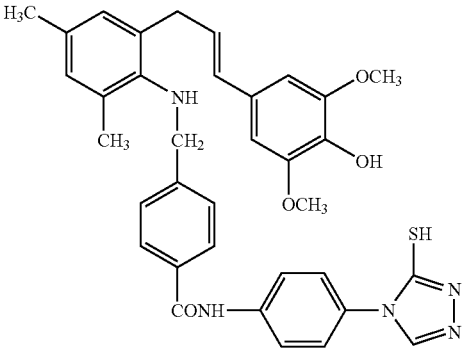
21
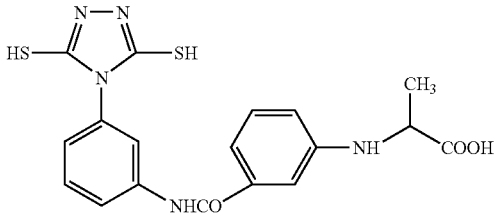
22
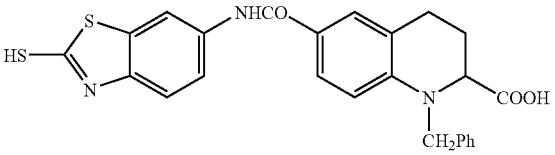

-continued
23
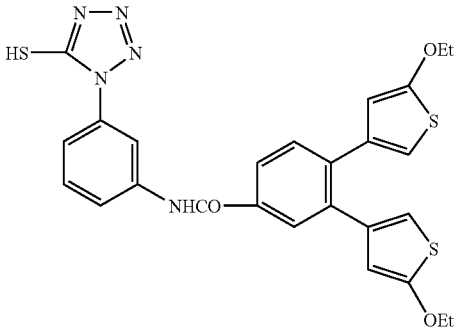
24
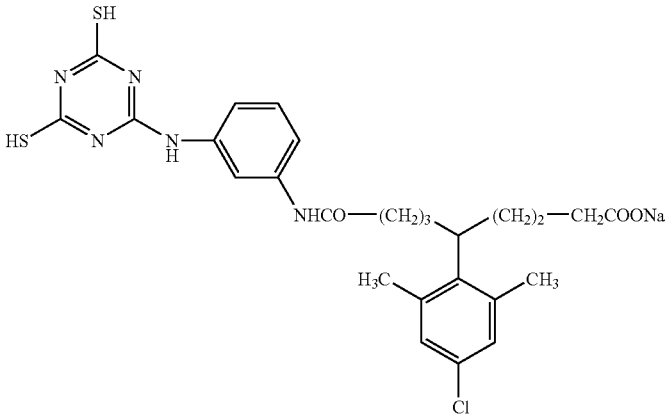
25
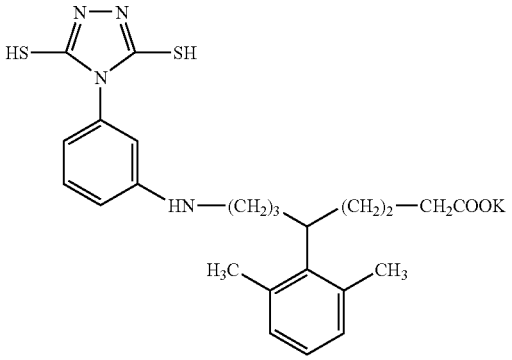
26
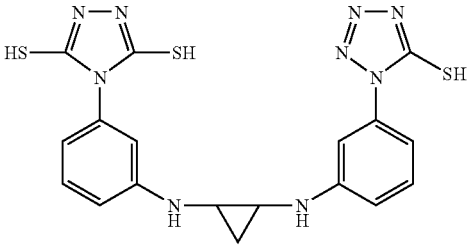
27
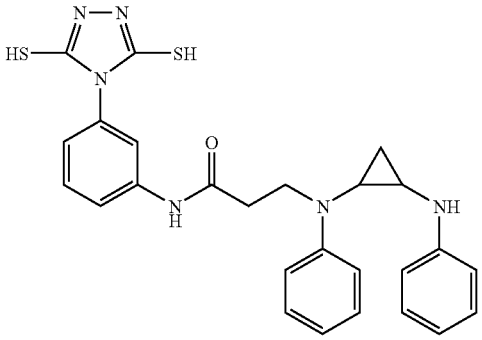
28
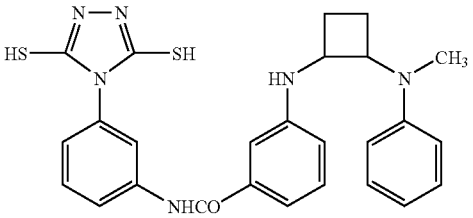

-continued
29
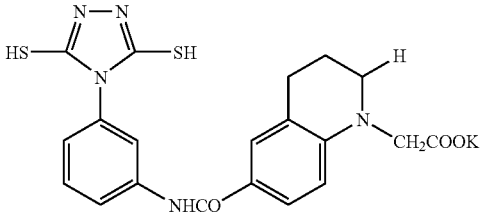
30
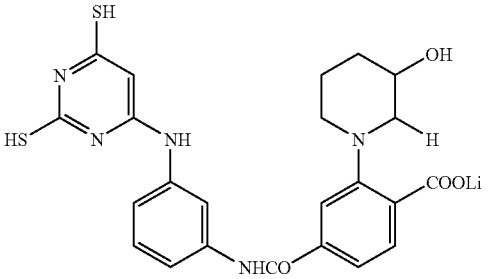
31
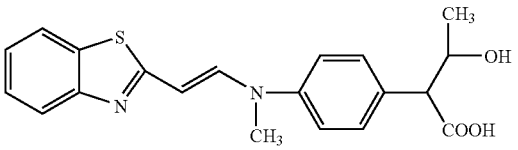
32
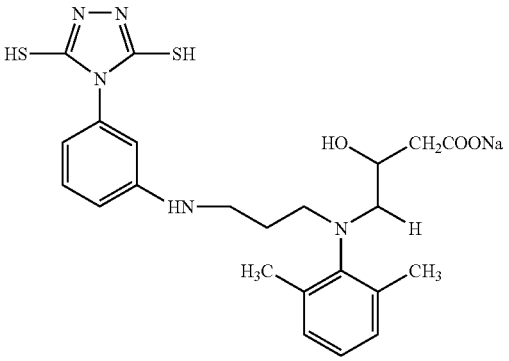
33
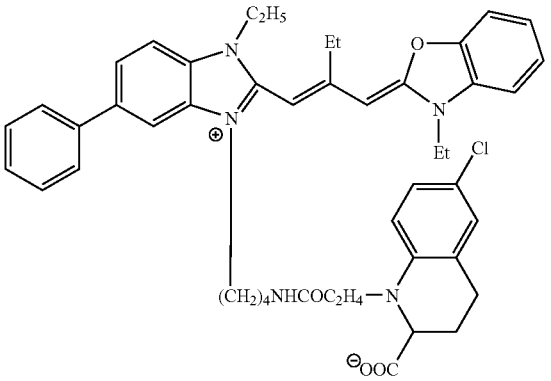
34
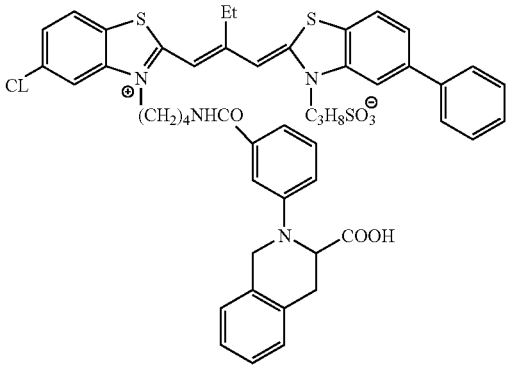
35
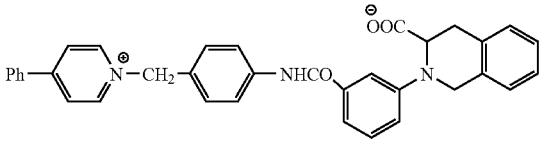

-continued
36
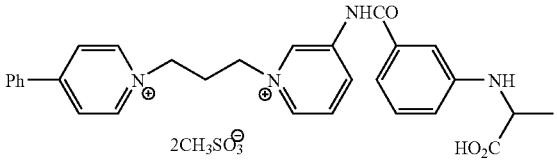
37
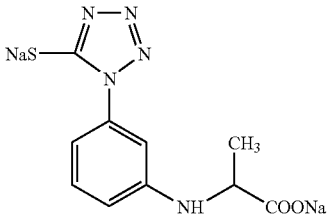
38
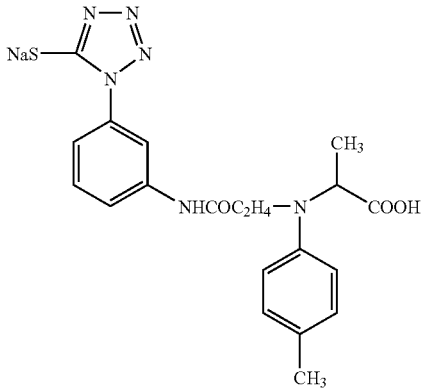
39
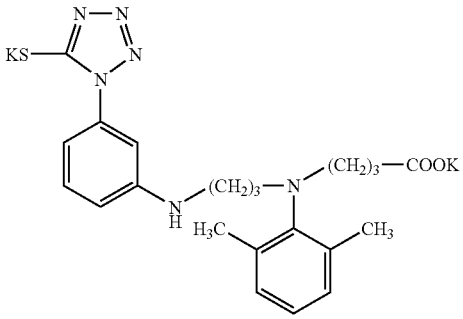
40
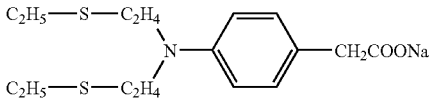
41
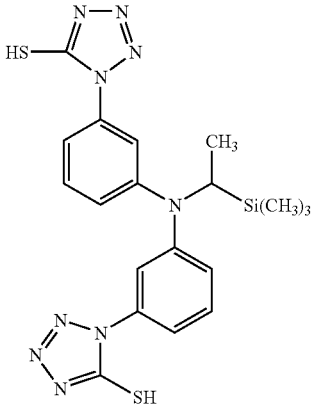
42
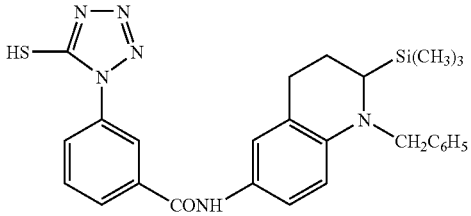

-continued

43

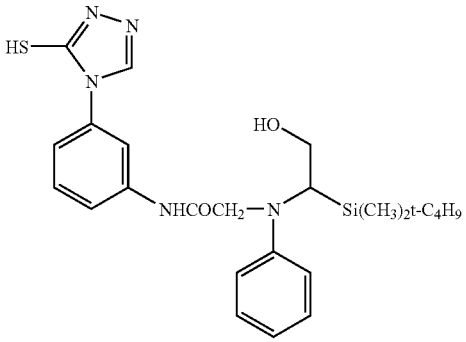

44

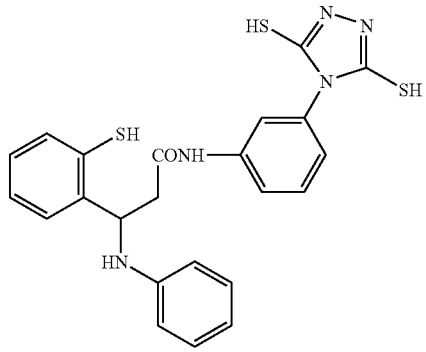

45

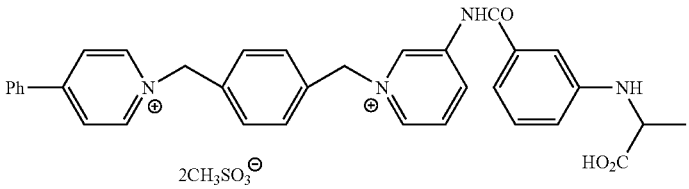

46

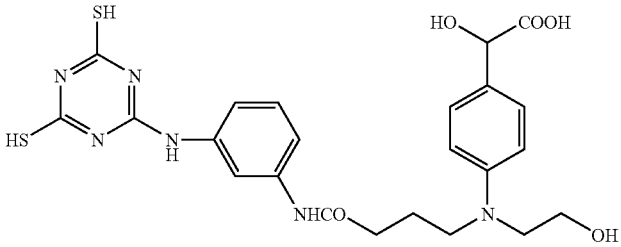

47

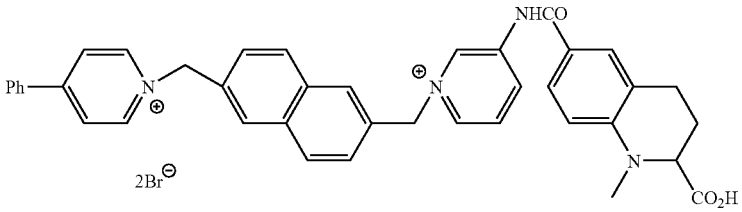

Compounds of type 1 and type 2 for use in the invention may be used in any case of preparation of an emulsion and during manufacturing processes of a photographic material. For example, they can be used at the time of forming grains, in a desalting process, at the time of chemical sensitization, or before coating. They can be added in several times separately during these processes. Preferably they are added during the time from termination of grain forming and before desalting process, at the time of chemical sensitization (from immediately before start of chemical sensitization to just after termination), and before coating, and more preferably at the time of chemical sensitization, and before coating.

The compounds of type 1 and type 2 for use in the invention are preferably added by being dissolved in a water-soluble solvent, e.g., methanol or ethanol, or mixed solvents of these solvents. For dissolution in water, with respect to compounds easily soluble at high pH or low pH, they may be dissolved at high pH or low pH and then added.

In the invention, the compounds of type 1 and/or type 2 have an equivalent-sphere diameter of 0.35 μm or less, and they are contained in all emulsion layer containing reduction sensitized silver halide grains. The compounds may be added to a protective layer and an intermediate layer besides the emulsion layer in advance and may be diffused at coating time. The compounds for use in the invention may be added at any time before or after the addition of sensitizing dyestuffs, and they are added to a silver halide emulsion layer in the proportion of preferably from $1\times10^{-9}$ to $5\times10^{-2}$ mol per mol of the silver halide, and more preferably from $1\times10^{-8}$ to $2\times10^{-3}$ mol.

The silver halide emulsions for use in the invention will be described in detail below.

The silver halide grains in a photographic emulsion may be grains having regular crystal forms (three-dimensionally anisotropic), such as cubic, octahedral, and tetradecahedral grains, grains having irregular crystal forms, such as spherical and tabular grains, grains having crystal defects such as twin planes, or composites of these grains, but cubic grains and octahedral grains are preferably used in the invention, and cubic grains are more preferably used.

The grain size of the silver halide grains for use in the invention can be evaluated with an electron microscope. Specifically, in the case of a grain having a regular crystal form a projected area-corresponding diameter (taking the projected area of the grain being equivalent to the area of the circle, the diameter of the circle) is found by observation with an electron microscope, the volume of the grain is computed from the projected area-corresponding diameter by making use of the grain being regular crystal and the grain size can be found by computing the diameter of the sphere taking the volume of the grain being equivalent to the volume of the sphere. In the case of an irregular grain (not three-dimensionally anisotropic) such as a tabular grain, the volume is computed from the projected area-corresponding diameter and the grain thickness obtained by observation with an electron microscope, from which the equivalent-sphere diameter can be found. The equivalent-sphere diameter can also be found by the turbidity measuring method described in Particle Characterization, $2^{nd}$ Edition, items 14 to 19 (1985).

Any grain size of silver halide grains from fine grains to large size grains can be used in the invention, but the average equivalent-sphere diameter preferably used in the invention is 0.35 μm or smaller, more preferably 0.3 μm or smaller, and especially preferably 0.2 μm or smaller.

The silver halide preferably used in a photosensitive layer in the invention is silver iodobromide, silver iodochloride or silver iodochlorobromide containing 30 mol % or less of silver iodide, and especially preferably silver iodobromide or silver iodochlorobromide containing from about 2 mol % to about 10 mol % of silver iodide.

The silver halide photographic emulsions usable in the invention can be prepared according to the methods described, e.g., in Research Disclosure (hereinafter abbreviated to RD) No. 17643 (December, 1978), pp. 22-23, I. Emulsion preparation and types, ibid., No. 18716 (November, 1979), p. 648, ibid., No. 307105 (November, 1989), pp. 863-865, P. Glafkides, Chimie et Physique Photographiques, Paul Montel (1967), G. F. Duffin, Photographic Emulsion Chemistry, Focal Press (1966), and V. I. Zelikman, et al., Making and Coating Photographic Emulsion, Focal Press (1964).

The monodispersed emulsions disclosed in U.S. Pat. Nos. 3,574,628, 3,655,394, and British Patent 1,413,748 can also be preferably used.

Crystal structure may be homogeneous, or the inside and outside of crystal structure may consist of heterogeneous halide compositions, or may take a laminar structure. Silver halides having different compositions may conjugate by epitaxial conjugation, or silver halide may conjugate with compounds other than silver halide, e.g., silver rhodanate or lead oxide. Alternatively, mixtures of grains of various crystal forms may be used.

The emulsions may have dislocation. For introducing dislocation, a method of forming a high silver iodide layer by the addition of an aqueous solution such as alkali iodide, a method of adding AgI line grains, and the method disclosed in JP-A-5-323487 can be used.

The emulsions may be a surface latent image type emulsion forming a latent image mainly on the surface of grains, may be an internal latent image type emulsion forming a latent image on the inside of grains, or may be the type having latent images both on the surface and inside of grains, but negative emulsions are preferred. Of internal latent image type emulsions, the core/shell type internal latent image type emulsion as disclosed in JP-A-63-264740 may be used, and the preparing method of the emulsion is disclosed in JP-A-59-133542. The thickness of the shell of this type of emulsion differs dependent upon development processing and the like, but the thickness is preferably from 3 to 40 nm, and especially preferably from 5 to 20 nm.

The emulsions for use in the invention are generally described below.

As reduction sensitization preferably used in the invention, any of the following methods can be used, for example, a method of adding a reduction sensitizer to silver halide, a method of growing or ripening silver halide grains in low pAg atmosphere of pAg of 1 to 7 called silver ripening, and a method of growing or ripening silver halide grains in high pH atmosphere of pH of 8 to 11 called high pH ripening. Two or more of these methods can be used in combination.

The method of adding a reduction sensitizer is especially preferred for capable of delicately regulating the stage of reduction sensitization.

As reduction sensitizers, stannous salt, ascorbic acid and derivatives thereof, hydroquinone and derivatives thereof, catechol and derivatives thereof, hydroxylamine and derivatives thereof, amine and polyamines, hydrazine and derivatives thereof, paraphenylenediamine and derivatives thereof, formamidinesulfinlic acid (thiourea dioxide), silane compounds, and borane compounds can be exemplified. These reduction sensitizers can be selectively used in the reduction sensitization in the invention, and two or more compounds can be used in combination. In connection with the methods of reduction sensitization, the methods disclosed in U.S. Pat. Nos. 2,518,698, 3,201,254, 3,411,917, 3,779,777 and 3,930,867, and in regarding the using methods of reduction sensitizers, JP-B-57-33572, JP-B-58-1410 and JP-A-57-179835 can be used respectively. As the reduction sensitizers, catechol and derivatives thereof, hydroxylamine and derivatives thereof, and formamidinesulfinic acid (thiourea dioxide) are preferred compounds. The compounds represented by any of the following formulae (II) and (III) are also preferably used as reduction sensitizers.

Formula (II)

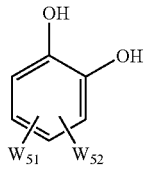

Formula (III)

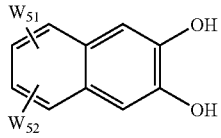

In formulae (II) and (III), $W_{51}$ and $W_{52}$ each represents a sulfo group or a hydrogen atom, provided that at least one of $W_{51}$ and $W_{52}$ represents a sulfo group. A sulfo group is generally an alkali metal salt such as sodium or potassium, or a water-soluble salt such as ammonium salt. As preferred compounds, 3,5-disulfocatechol disodium salt, 4-sulfo-catechol ammonium salt, 2,3-dihydroxy-7-sulfonaphthalene sodium salt, and 2,3-dihydroxy-6,7-disulfonaphthalene potassium salt are specifically exemplified.

Since the addition amount of a reduction sensitizer depends upon the manufacturing conditions of emulsion, it is necessary to select addition amount, but is appropriately from $10^{-7}$ to $10^{-1}$ mol per mol of the silver halide. A reduction sensitizer is dissolved in water or solvents such as alcohols, glycols, ketones, esters, or amides and added to silver halide grains during the grain growth.

As silver halide solvents that can be used in the invention, (a) organic thioethers as disclosed in U.S. Pat. Nos. 3,271,157, 3,531,289, 3,574,628, JP-A-54-1109 and JP-A-54-

158917, (b) thiourea derivatives as disclosed in JP-A-53-32408. JP-A-55-77737 and JP-A-55-2982, (c) silver halide solvents having a thiocarbonyl group between all oxygen or sulfur atom and a nitrogen atom as disclosed in JP-A-53-144319, (d) imidazoles as disclosed in JP-A-54-100717, (e) ammonia, and (f) thiocyanate are exemplified.

Especially preferred solvents are thiocyanate, ammonia and tetramethylthiourea. The amount of solvents used depends upon the kinds of solvents. For example, in the case of thiocyanate, a preferred amount is from $1\times10^{-4}$ to $1\times10^{-2}$ mol per mol of the silver halide.

In the manufacture of the emulsion in the invention, e.g., at the time of forming grains, in desalting process, at chemical sensitization, or before coating, it is preferred to make the salt of a metal ion exist according to purpose. The salt of a metal ion is preferably added at the time of grain formation in the case where grains are doped, and is added after forming grains and before termination of chemical sensitization in the case where grain surface is modified or the salt of a metal ion is used as a chemical sensitizer. As described above, the whole grain may be doped, or the core part of a grain may be doped, or the shell part of a grain may be doped, or an epitaxial part alone may be doped. For example, Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Ti, In, Sn, Pb, and Bi can be used. These metals can be added so longer as they take the form of salts capable of being dissolved at the time of grain formation, such as ammonium salt, acetate, nitrate, sulfate, phosphate, hydroxy acid salt, 6-coordinate complex salt, or 4-coordinate complex salt. For example, $CdBr_2$, $CdCl_2$, $Cd(NO_3)_2$, $Pb(NO_3)_2$, $Pb(CH_3COO)_2$, $K_4[Fe(CN)_4]$, $(H)_4[Fe(CN)_6]$, $K_2IrCl_4$, $(NH_4)_3RhCl_4$, and $K_4Ru(CN)_4$ are exemplified. The ligand of coordination compound can be selected from among halo, aquo, cyano, cyanate, thiocyanate, nitrosyl, thionitrosyl, oxo and carbonyl. Metal compounds can be used alone, or two or three or more may be used in combination.

It is preferred for metal compounds to be added by being dissolved in water or a proper organic solvent such as, methanol or acetone. For the stabilization of the solution, a method of adding an aqueous solution of hydrogen halide (e.g., HCl, HBr) or alkali halide (e.g., KCl, NaCl, KBr, NaBr) can be used. Further, acid or alkali may be added, if necessary. Metal compounds can be put into a reaction vessel before forming grains, or may be added during forming rains. Metal compounds can also be added to water-soluble silver salt (e.g. $AgNO_3$) or an aqueous solution of alkali halide (e.g., NaCl, KBr, KI) and continuously added during forming silver halide grain. Further, a solution independent from an aqueous solution of water-soluble silver salt or alkali halide may be prepared and continuously added at proper time during grain formation. It is also preferred to combine various addition methods.

There are cases where a method of adding a chalcogen compound during preparation of grains as disclosed in U.S. Pat. No. 3,772,031 is useful. Cyanogen salt, thiocyanogen salt, selenocyanate, carbonate, phosphate, acetate may be present besides S, Se and Te.

The silver halide grains for use in the invention can be subjected to at least any one of sulfur sensitization, selenium sensitization, tellurium sensitization, gold sensitization, palladium sensitization, noble metal sensitization, and reduction sensitization in an arbitrary process of the manufacturing processes of a silver halide emulsion. It is preferred to use two or more kinds of sensitization methods in combination. Depending upon the process wherein silver halide grains are chemically sensitized, various types of emulsions can be prepared. There are emulsions of a type having a chemically sensitized speck buried inside a grain, of a type having a chemically sensitized speck buried at the shallow place from the surface of a grain, and of a type having a chemically sensitized speck formed on the surface of a grain. The emulsion for use in the invention can select the place of a chemically sensitized speck, according to purposes. An emulsion having formed at least one chemically sensitized speck in the vicinity of the surface of a grain is generally preferred.

One chemical sensitization that can be preferably carried out in the invention is alone or combination of chalcogen sensitization and noble metal sensitization, which chemical sensitization can be performed with activated gelatin as described in T. H. James, The Theory of the Photographic Process, $4^{th}$ Ed., pp. 67-76. Macmillan (1977), and sulfur, selenium, tellurium, gold, platinum, palladium or iridium, or a combination of a plurality of these sensitizers can be used at pAg of from 5 to 10, pH of from 5 to 8 and temperature of from 30 to 50° C. as described in Research Disclosure, Vol. 120, 12008 (April, 1974), Research Disclosure, Vol. 34, 13452 (June, 1975), U.S. Pat. Nos. 2,642,361, 3,297,446, 3,772,031, 3,857,711, 3,901,714, 4,266,018, and 3,904,415, and British Patent 1,315,755. In noble metal sensitization, noble metal salts of gold, platinum, palladium and iridium can be used, and gold sensitization, palladium sensitization and combination of both sensitizations are especially preferred.

In gold sensitization, gold salts described in P. Glafkides, Chimie et Physique Photographique, $5^{th}$ Ed., Paul Montel (1987) and Research Disclosure, Vol. 307, No. 307105 can be used.

As specific examples, chloroauric acid potassium chloroaurate, potassium aurithiocyanate, and the compounds disclosed in the following patents can be used: U.S. Pat. No. 2,642,361 (gold sulfide and gold selenide), U.S. Pat. No. 3,503,749 (gold thiolate having a water-soluble group), U.S. Pat. No. 5,049,484 (bis(methylhydantoinate) gold complex), U.S. Pat. No. 5,049,485 (meso-ionic thiolate gold complex, e.g., 1,4,5-trimethyl-1,2,4-triazolium-3-thiolate gold complex), U.S. Pat. Nos. 5,252,455 and 5,391,727 (macrocyclic hetero-cyclic gold complexes), and gold compounds disclosed in U.S. Pat. Nos. 5,620,841, 5,700,631, 5,759,760, 5,759,761, 5,912,111, 5,912,112, 5,939,245, JP-A-1-147537, JP-A-8-69074, JP-A-8-69075, JP-A-9-269554, JP-B-45-29274, German Patents DD-264,524A, 264,525A, 265,474A, 298,321A, JP-A-2001-75214, JP-A-2001-75215, JP-A-2001-75216, JP-A-2001-75217, and JP-A-2001-75218 can also be used.

The palladium compound means divalent or tetravalent salts of palladium. A preferred palladium compound is represented by $R_2PdX_6$ or $R_2PdX_4$, where R represents a hydrogen atom, an alkali metal atom or an ammonium group; and X represents a halogen atom. e.g., a chlorine, bromine or iodine atom.

Specifically, $K_2PdCl_4$, $(NH_4)_2PdCl_6$, $Na_2PdCl_6$, $(NH_4)_2PdCl_4$, $Li_2PdCl_4$, $Na_2PdCl_6$ and $K_2PdBr_4$ are preferred. It is preferred to use gold compounds and palladium compounds in combination of thiocyanate or selenocyanate.

In sulfur sensitization, labile sulfur compounds are used. Labile sulfur compounds as described in P. Glafkides, Chimie et Physique Photographique, $5^{th}$ Ed., Paul Montel (1987) and Research Disclosure, Vol. 307, No. 307105 can be used.

Specifically, known sulfur compounds, such as thiosulfate (e.g., hypo), thioureas (e.g., diphenylthiourea, triethylthiourea, N-ethyl-N-(4-methyl-2-thiazolyl)thiourea, dicarboxymethyl-dimethylthiourea, carboxymethyl-trimethylthiourea), thioamides (e.g., thioacetamide), rhodanines (e.g., diethylrhodanine, 5-benzylidene-N-ethylrhodanine), phosphine sulfides (e.g., trimethylphosphine sulfide), thiohydantoins, 4-oxo-oxazolidine-2-thiones, disulfides, polysulfides (e.g., dimorpholine disulfide, cystine, hexathiocan-thione), mercapto compounds (e.g., cysteine), polythionate, and elemental sulfur, and activated gelatin can be used in sulfur sensitization. Of these compounds, thiosulfate, thioureas, phosphine sulfides, and rhodanines are especially preferred.

In selenium sensitization, labile selenium compounds are used, e.g., the compounds disclosed in JP-B-43-113489, JP-B-44-15748, JP-A-4-25832, JP-A-4-109340, JP-A-4-271341, JP-A-5-40324, JP-A-5-11385, JP-A-6-51415, JP-A-6-175258, JP-A-6-180478, JP-A-6-208186, JP-A-6-208184, JP-A-6-317867, JP-A-7-92599, JP-A-7-98483, and JP-A-7-140579 can be used.

Specifically, colloidal metal selenium, selenoureas (e.g., N,N-dimethylselenourea, trifluoromethylcarbonyl-trimethylselenourea, acetyl-trimethylselenourea), seleno-amides (e.g. selenoamide, N,N-diethylphenylselenoamide), phosphine selenides (e.g., triphenylphosphine selenide, pentafluorophenyl-triphenylphosphine selenide), seleno-phosphates (e.g., tri-p-tollylselenophosphate, tri-n-butyl-selenophosphate), selenoketones (e.g., selenobenzophenone), isoselenocyanates, selenocarboxylic acids, seleno esters (e.g., methoxyphenylselenocarboxy-2,2-dimethoxycyclohexane ester), and diacyl selenides will suffice for selenium sensitization. Further, non-labile selenium compounds disclosed in JP-B-46-4553 and JP-B-52-34492, e.g., selenious acid, selenocyanic acid (e.g., potassium selenocyanate), selenazoles, and selenides can also be used. Phosphine selenides, selenoureas, seleno esters and selenocyanic acids are especially preferred.

In tellurium sensitization, labile tellurium compounds are used, and the labile tellurium compounds disclosed in JP-A-4-224595, JP-A-4-271341, JP-A-4-333043, JP-A-5-303157, Japanese Patent Application Nos. 4-185004, 4-330495, 4-333030, 5-4203, 5-4204, 5-106977, and 5-286916 can be used.

Specifically, it will be sufficient for tellurium sensitization to use phosphine tellurides (e.g., butyl-diisopropylphosphine telluride, tributylphosphine telluride, tributoxyphosphine telluride, ethoxydiphenylphosphine telluride), diacyl(di)tellurides (e.g., bis(diphenyl-carbamoyl)ditelluride, bis(N-phenyl-N-methylcarbamoyl)ditelluride, bis-(N-phenyl-N-methylcarbamoyl)telluride, bis(N-phenyl-N-benzylcarbamoyl)telluride, bis(ethoxy-carbonyl)telluride), telluroureas (e.g., N,N'-dimethyl-ethylenetellurourea, N,N'-diphenylethylenetellurourea), telluroamides, and telluro esters.

As useful chemical sensitizer assistants, compounds known to restrain fog during chemical sensitization and increase sensitivity such as azaindene, azapyridazine and azapyrimidine are used. The examples of chemical sensitizer assistant modifiers are described in U.S. Pat. Nos. 2,131,038, 3,411,914, 3,554,757, JP-A-58-126526, and G. F. Duffin, Photographic Emulsion Chemistry, pp. 138 to 143.

The amount of gold sensitizers and chalcogen sensitizers for use in the invention varies according to the silver halide grains used and the conditions, of chemical sensitization, but the amount is preferably from $-10^{-8}$ to $10^{-2}$ mol per mol of the silver halide, and more preferably from $10^{-7}$ to $10^{-3}$ mol or so.

The conditions of chemical sensitization in the invention are not especially restricted, but pAg is preferably from 6 to 11, more preferably from 7 to 10, pH is preferably from 4 to 10, more preferably from 5 to 8, and temperature is preferably from 40 to 95° C., and more preferably from 45 to 85° C.

It is preferred to use an oxidizing agent to silver during the manufacture of emulsion. The oxidizing agent to silver means a compound having function of capable of acting on a metallic silver to convert it to a silver ion. Compounds capable of converting very minute silver grains by-produced in the forming process of silver halide grains and a chemical sensitization process into silver ions are particularly effective. The silver ions formed may be hardly water-soluble silver salts, such as silver halide, silver sulfide, and silver selenide, or easily water-soluble silver salts, such as silver nitrate. The oxidizing agent to silver may be inorganic or organic. The examples of inorganic oxidizing agents include, e.g., ozone, hydrogen peroxide and adducts thereof (e.g., $NaBO_2.H_2O_2.3H_2O$, $2NaCO_3.3H_2O_2$, $Na_4P_2O_7.2H_2O_2$, $2Na_2SO_4.H_2O_2.2H_2O$), peroxy acid salts (e.g., $K_2S_2O_8$, $K_2C_2O_6$, $K_2P_2O_8$), peroxy complex compounds (e.g., $K_2[Ti(O_2)C_2O_4].3H_2O$, $4K_2SO_4.Ti(O_2)OH.SO_4.2H_2O$, $Na_3[VO(O_2)(C_2H_4)_2]6H_2O$), permanganates (e.g., $KMnO_4$), oxyacid salts such as chromates (e.g., $K_2Cr_2O_7$), halogen elements, e.g., iodine and bromine, halogen peracid salt (e.g., potassium periodate), the salts of high valency metals (e.g., potassium hexacyanoferrate(III)), and thiosulfonate.

The examples of organic oxidizing agents include quinones, e.g., p-quinone, organic peroxides, e.g., peracetic acid and perbenzoic acid, and compounds releasing activated halogen (e.g., N-bromosuccinimide, chloramine T, and chloramine B).

The oxidizing agents preferably used in the invention are inorganic oxidizing agents such as ozone, hydrogen peroxide and adducts thereof, halogen elements, and thiosulfonate, and organic oxidizing agents such as quinones. It is preferred to use in combination of the reduction sensitization with the oxidizing agents to silver. Reduction sensitization may be performed after using oxidizing agents, or ice versa, or both may coincide with each other. These methods can be used selectively in a grain forming process or a chemical sensitization process.

The photographic emulsion for use in the invention can contain various compounds for the purpose of preventing fogging and stabilizing photographic performances in the process of manufacturing, during preservation or photographic processing of a photographic material. That is, many compounds know as antifoggants and stabilizers can be added to the photographic emulsion, such as thiazoles, e.g., benzothiazolium salt, nitroimidazoles, nitrobenzimidazoles, chlorobenzimidazoles, bromobenzimidazoles, mercaptothiazoles, mercaptobenzo-thiazoles, mercaptobenzimidazoles, mercaptothiadiazoles, aminotriazoles, benzotriazoles, nitrobenzotriazoles, mercaptotetrazoles (in particular, 1-phenyl-5-mercapto-tetrazole); mercaptopyrimidines; mercaptotriazines; thioketo compounds, e.g., oxazolinethione; azaindenes, e.g., triazaindenes, tetraazaindenes (in particular, 4-hydroxy-substituted-(1,3,3a,7)tetraazaindenes), and pentaazaindenes. For example, the compounds disclosed in U.S. Pat. Nos. 3,954,474, 3,982,947, and JP-B-52-28660 can be used. As one preferred compound, the compound disclosed in JP-A-63-212932 is exemplified. Antifoggants and stabilizers can be added at various times according to purposes, e.g., before grain formation, during grain formation, after grain formation, in a water washing process, at the time of dispersion after water washing, before chemical sensitization, during chemical sensitization, after chemical sensitization, and before coating. In addition to manifestations of original prevention of fogging and stabilization effect by the addition during preparation of emulsion antifoggants and stabilizers can be used for various purposes, such as controlling the crystal habits of grains, lessening a grain size, reducing the solubility of grains, restraining chemical sensitization, controlling the arrangement of dyestuffs, and the like.

It is preferred for the photographic emulsion for use in the invention to be spectrally sensitized with methine dyestuffs and the like in view of revealing the effect of the intention. The dyestuffs that are used include cyanine dyestuffs, merocyanine dyestuffs, complex cyanine dyestuffs, complex merocyanine dyestuffs, holopolar cyanine dyestuffs, hemicyanine dyestuffs, styryl dyestuffs, and hemioxonol dyestuffs. Especially useful dyestuffs are dyestuffs belonging to cyanine dyestuffs, merocyanine dyestuffs and complex merocyanine dyestuffs. Every nucleus of basic heterocyclic nuclei generally used in cyanine dyestuffs can be applied to these dyestuffs. That is, e.g., a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus; nuclei obtained by condensing an alicyclic hydrocarbon ring on these nuclei; and nuclei obtained by condensing an aromatic hydrocarbon ring on these nuclei, e.g., an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, and a quinoline nucleus can be applied. These nuclei may have a substituent on the carbon atoms.

As the nuclei having a ketomethylene structure, 5- or 6-membered heterocyclic nuclei, e.g., a pyrazolin-5-one nucleus, a thiohydantoin nucleus, a 2-thiooxazolidine-2,4-dione nucleus, a thiazolidine-2,4-dione nucleus, a rhodanine nucleus, a thiobarbituric acid nucleus can be applied to merocyanine dyestuffs or complex merocyanine dyestuffs.

These sensitizing dyestuffs may be used alone, or may be used in combination, and combination of sensitizing dyestuffs is often used for the purpose of supersensitization. The representative examples thereof are disclosed in U.S. Pat. Nos. 2,688,545, 2,977,229, 3,397,060, 3,522,052, 3,527,641, 3,617,293, 3,628,964, 3,666,480, 6712898, 3,679,428, 3,703,377, 3,769,301, 3,814,609, 3,837,862, 4,026,707, British Patents 1,344,281, 1,507,803, JP-B-43-4936. JP-B-53-12-375. JP-A-52-110618 and JP-A-52-109925.

There may be contained in an emulsion together with sensitizing dyestuffs, a dyestuff having no spectral sensitizing action by itself or a material not substantially absorbing visible rays but showing supersensitization. The time of addition of sensitizing dyestuffs to an emulsion may be at any stage of the preparation of the emulsion recognized as useful hitherto. Sensitizing dyestuffs are most generally added during the period after termination of chemical sensitization and before coating but, as disclosed in U.S. Pat. Nos. 3,628,969 and 4,225,666, they may be added at the same time with a chemical sensitizer, and spectral sensitization may be performed simultaneously with chemical sensitization. Alternatively, as disclosed in JP-A-58-113928, spectral sensitization can be carried out prior chemical sensitization, and it is also possible to add sensitizing dyestuffs before completion of precipitation formation of silver halide grains to initiate spectral sensitization. Further, as disclosed in U.S. Pat. No. 4,225,666, sensitizing dyestuffs can be divided and added separately, for example, one part is added prior to chemical sensitization and the remaining after completion of chemical sensitization, and they may be added in any stage of silver halide grain formation including the method disclosed in U.S. Pat. No. 4,183,756. The addition amount of sensitizing dyestuffs is from $4\times10^{-6}$ to $8\times10^{-3}$ mol per mol of the silver halide.

It is sufficient that photographic materials to which the method of the invention is applicable have at least one blue-sensitive silver halide emulsion layer, at least one green-sensitive silver halide emulsion layer, at least one red-sensitive silver halide emulsion layer, and a photo-insensitive layer on a support. A representative example is a silver halide photographic material comprising a support having thereon photosensitive layers of blue-sensitive green-sensitive and red-sensitive layers of a plurality of silver halide emulsion layers having substantially the same color sensitivity and different in photosensitivity, and at least one photo-insensitive layer. The photosensitive layers are unit photosensitive layers having color sensitivity to any of blue light green light and red light. In a multilayer silver halide color photographic material, the unit photo-sensitive layers are generally arranged in the order of a red-sensitive layer, a green-sensitive layer and a blue-sensitive layer from the support side. However, the order of arrangement can be reversed depending upon purposes, alternatively, the photosensitive layers may be arranged in such a way that a layer having different photosensitivity is interposed between layers having the same color sensitivity. Photo-insensitive layers may be provided between and on the uppermost layer and beneath the lowermost layer of the silver halide photosensitive layers. These photo-insensitive layers may contain the couplers, DIR compounds and color mixing preventives described later. As the plurality of silver halide emulsion layers constituting each unit photosensitive layer, a two-layer structure of a high sensitivity emulsion layer and a low sensitivity emulsion layer can be preferably used with the emulsion layers being arranged so as to decrease in sensitivity toward the support in turn as disclosed in German Patent 1,121,470 and British Patent 923,045. In addition, a low sensitivity emulsion layer may be provided farther from the support and a high sensitivity emulsion layer may be provided nearer to the support as disclosed in JP-A-57-112751, JP-A-62-200350, JP-A-62-206541 and JP-A-62-206543.

As a specific example, a low sensitivity blue-sensitive layer (BL)/a high sensitivity blue-sensitive layer (BH)/a high sensitivity green-sensitive layer (GH)/a low sensitivity green-sensitive layer (GL)/a high sensitivity red-sensitive layer (RH)/a low sensitivity red-sensitive layer (RL), or BH/BL/GL/GH/RH/RL, or BH/BL/GH/GL/RL/RH can be arranged in this order from the side farthest from the support.

As disclosed in JP-B-55-34932, a blue-sensitive layer/GH/RH/GL/RL can be arranged in this order from the side farthest from the support. Further, a blue-sensitive layer/GL/RL/GH/RH can be arranged in this order from the side farthest from the support as disclosed in JP-A-56-25738 and JP-A-62-63936.

Further, arrangements include the arrangement in which there are three layers having different degrees of sensitivities with the sensitivity being lower towards the support such that the uppermost layer is a silver halide emulsion layer having the highest sensitivity, the middle layer is a silver halide emulsion layer having a lower sensitivity than that of the uppermost layer, and the lowermost layer is a silver halide emulsion layer having a lower sensitivity than that of the middle layer, as disclosed in JP-B-49-15495. In the case of the structure of this type comprising three layers having different degrees of sensitivities, the layers in the unit layer of the same color sensitivity may be arranged in the order of a middle sensitivity emulsion layer/a high sensitivity emulsion layer/a low sensitivity emulsion layer from the side farthest from the support, as disclosed in JP-A-59-202464.

Alternatively, the layers can be arranged in the order of a high sensitivity emulsion layer/a low sensitivity emulsion layer/a middle sensitivity emulsion layer, or a low sensitivity emulsion layer/a middle sensitivity emulsion layer/a high sensitivity emulsion layer.

Moreover, the arrangement may be varied as indicated above in the case where there are four or more layers.

A silver halide photographic material for use in the method of the invention comprises a transparent support having provided thereon at least one blue-sensitive silver halide emulsion layer, at least one green-sensitive silver halide emulsion layer, and at least one red-sensitive silver halide emulsion layer, and it is preferred that at least one layer that is a layer on the opposite side to the support with the green-sensitive silver halide emulsion layer as the center and not the green-sensitive silver halide emulsion layer contains a fixed magenta dye, and/or at least one layer that is a layer on the side of the support with the green-sensitive silver halide emulsion layer as the center and not the green-sensitive silver halide emulsion layer contains a fixed magenta dye, and it is also preferred that at least one layer that is a layer on the opposite side to die support with the red-sensitive silver halide emulsion layer as the center and not the red-sensitive silver halide emulsion layer contains a fixed cyan dye.

Further, in a silver halide photographic material comprising a transparent support having provided thereon at least one blue-sensitive silver halide emulsion layer, at least one green-sensitive silver halide emulsion layer, and at least one red-sensitive silver halide emulsion layer, it is also preferred that at least one layer that is a layer on the opposite side to the support with the red-sensitive silver halide emulsion layer as the center and not the red-sensitive silver halide emulsion layer contains a fixed cyan dye.

In the photographic material of the invention, two or more types of emulsions that are different in terms of at least one of the characteristics of grain size, grain size distribution, halide composition, shape of the grains, and sensitivity of the photosensitive silver halide emulsion can be used in admixture in one and the same layer.

It is preferred to use the silver halide grains having a fogged grain surface as disclosed in U.S. Pat. No. 4,082,553, the silver halide grains having a fogged grain interior as disclosed in U.S. Pat. No. 4,626,498 and JP-A-59-214852, or colloidal silver in photosensitive silver halide emulsion layers and/or substantially photo-insensitive hydrophilic colloid layers. Silver halide grains having a fogged grain interior or surface are silver halide grains that can be developed uniformly (not imagewise) irrespective of whether these grains are in an unexposed area or an exposed area of the photographic material, and methods of the preparation of these silver halide grains are disclosed in U.S. Pat. No. 4,626,498 and JP-A-59-214852. The silver halide that forms the internal nuclei of core/shell type silver halide grains having a forged grain interior may have different halide compositions. The silver halide having a fogged grain interior or surface may be any of silver chloride, silver bromide, silver iodobromide, or silver chloroiodobromide. Further, the form of the grains may be regular grains and may be a polydispersed emulsion, but a monodispersed emulsion (at least 95% of which have a grain size within ±40% of the average equivalent-sphere diameter in terms of the mass or number of silver halide grains) is preferred.

It is preferred to use photo-insensitive fine grained silver halides in the invention. Photo-insensitive fine grained silver halides are fine grained silver halides that are not sensitive to light upon imagewise exposure for obtaining color images and do not substantially undergo development in development processing and they are preferably not pre-fogged. The content of silver bromide of fine-grained silver halides is from 0 to 100 mol %, and at least one of silver chloride and silver iodide may be contained, if necessary. Fine-grained silver halides having a silver iodide content of from 0.5 to 10 mol % are preferred.

Fine-grained silver halide can be prepared by the same methods as the preparation of generally used photosensitive silver halides. In the preparation of fine-grained silver halide, the surfaces of the silver halide grains may be or may not be spectrally or chemically sensitized. Further, it is preferred that known stabilizers such as triazole-based, azaindene-based, benzothiazolium-based, or mercapto-based compounds, or zinc compounds are previously added to the fine-grained silver halide before addition to a coating solution. Colloidal silver can be contained in the layer containing the fine-grained silver halide grains.

For the improvement of sharpness, the coating weight of silver in the photographic material of the invention is preferably 8.0 g/m$^2$ or less, more preferably from 5.0 g/m$^2$ or less, and most preferably 3.0 g/m$^2$ or less.

The photographic additives usable in the invention are also described in RD and locations related thereto are indicated in the following table.

| Type of Additives | RD 17643 | RD 18716 | RD 307105 |
|---|---|---|---|
| 1. Chemical sensitizers | page 23 | page 648, right column | page 866 |
| 2. Sensitivity increasing agents | — | page 648, right column | — |
| 3. Spectral sensitizers and supersensitizers | pages 23 and 24 | page 648, right column to page 649, right column | pages 866 to 868 |
| 4. Brightening agents | page 24 | page 647, right column | page 868 |
| 5. Light absorbers, filter dyes, and UV absorbers | pages 25 and 26 | page 649, right column to page 650, left column | page 873 |
| 6. Binders | page 26 | page 651, left column | pages 873 to 874 |
| 7. Plasticizers and lubricants | page 27 | page 650, right column | page 876 |
| 8. Coating aids and surfactants | pages 26 and 27 | page 650, right column | pages 875 and 876 |
| 9. Antistatic agents | page 27 | page 650, right column | pages 876 and 877 |
| 10. Matting agents | — | — | pages 878 and 879 |

Various dyestuff-forming couplers can be used in the invention, and the following couplers are especially preferred.

Yellow Couplers:

The couplers represented by formula (I) or (II) disclosed in EP 502,424A; the couplers represented by formula (1) or (2) disclosed in EP 513,496A (in particular, Y-28 on page 18); the couplers represented by formula (1) disclosed in claim 1 of EP 568,037A; the couplers represented by formula (1), column 1, lines 45 to 55 disclosed in U.S. Pat. No. 5,066,576; the couplers represented by formula (1), paragraph 0008 disclosed in JP-A-4-274425; the couplers disclosed in claim 1 on page 40 in EP 498,381 A (in particular, D-35 on page 18); the couplers represented by formula (Y) on page 4 disclosed in EP 447,969A (in particular, Y-1 (page 17) and Y-54 (page 41)); and the couplers represented by any of formulae (II) to (IV), column 7, lines 36 to 58 disclosed in U.S. Pat. No. 4,476,219 (in particular, II-17 and II-19 (column 17), and II-24 (column 19))

Magenta Couplers Other than the Couplers Represented by any of Formulae (J) and (Z):

L-57 (page 11, right lower column), L-68 (page 12, right lower column), and L-77 (page 13, right lower column) disclosed in JP-A-3-39737; [A-4]-63 (page 134), and [A-4]-73 to [A-4]-75 (page 139) disclosed in EP 456,257; M-4 at M-6 (page 26) and M-7 (page 27) disclosed in EP 486,965; M-45 (page 19) disclosed in EP 571,959A; (M-1) (page 6) disclosed in JP-A-5-204106; and M-22, paragraph 0237 disclosed in JP-A-4-362631

Cyan Couplers:

CX-1, CX-3, CX-4, CX-5, CX-11, CX-12, CX-14 and CX-15 (pages 14 to 16) disclosed in JP-A-4-204843; C-7 and C-10 (Page 35), C-34 and C-35 (page 37), and (I-1) and (I-17) (pages 42 and 43) disclosed in JP-A-4-43345, and the couplers represented by formula (Ia) or (Ib) disclosed in claim 1 of JP-A-6-67385

Polymer Couplers:

P-1 and P-5 (page 11) disclosed in JP-A-2-44345

The couplers disclosed in U.S. Pat. No. 4,366,237, British Patent 2,125,570, EP 96,873B and German Patent 3,234,533 are preferred as couplers the colored dyestuffs of which have an appropriate diffusibility.

The examples of preferred couplers for correcting the unnecessary absorption of colored dyestuffs include the yellow colored cyan couplers represented by formula (CI), (CII), (CIII) or (CIV) disclosed on page 5 of EP 456,257A (in particular, YC-86 on page 84); the yellow colored magenta couplers ExM-7 (page 202), EX-1 (page 249), and EX-7 (page 251) disclosed in EP 456,257A; the magenta colored cyan couplers CC-9 (column 8) and CC-13 (column 10) disclosed in U.S. Pat. No. 4,833,069; the coupler (2) (column 8) disclosed in U.S. Pat. No. 4,837,136; and the colorless masking couplers represented by formula (A) disclosed in claim 1 of WO 92/11575 (in particular, the compounds disclosed on pages 36 to 45).

The examples of compounds (inclusive of couplers) that release photographically useful residual groups of compounds upon reacting with the oxidation product of a developing agent include the following:

Development Inhibitor Releasing Compounds:

The compounds represented by formula (I), (II), (III) or (IV) disclosed on page 11 of EP 378,236A (in particular, T-101 (page 30), T-104 (pane 31), T-113 (page 36), T-131 (page 45) T-144 (page 51), and T-158 (page 58); the compounds represented by formula (I) disclosed on page 7 of EP 436,938A (in particular, D-49 (page 51)); the compounds represented by formula (1) disclosed in EP 568,037A (in particular, (23) (page 11); and the compounds represented by formula (I), (II) or (III) disclosed on pages 5 and 6 in EP 440,195A (in particular, I-(1) on page 29)

Bleaching Accelerator Releasing Compounds:

The compounds represented by formula (I) or (I') disclosed on page 5 in EP 310,125A (in particular, (60) and (61) on page 1); and the compounds represented by formula (I) disclosed in claim 1 in JP-A-6-59411 (in particular, (7) on page 7)

Ligand Releasing Compounds:

The compounds represented by LIG-X disclosed in claim 1 in U.S. Pat. No. 4,555,478 (in particular, the compounds in lines 21 to 41 column 12)

Leuco Dyestuff Releasing Compounds:

Compounds 1 to 6, columns 3 to 8 disclosed in U.S. Pat. No. 4,749,641

Fluorescent Dyestuff Releasing Compounds:

The compounds represented by COUP-DYE disclosed in claim 1 in U.S. Pat. No. 4,774,181 (in particular, Compounds 1 to 11 in columns 7 to 10)

Development Accelerator Releasing or Fogging Agent Releasing Compounds:

The compounds represented by formula (1), (2) or (3), column 3 in U.S. Pat. No. 4,656,123 (in particular, Compound (1-22) in column 25); and Compound ExZK-2, lines 36 to 38, page 75 in EP 450,637A Compounds Releasing Groups the Color of which is Restored after Elimination:

The compounds represented by formula (I) disclosed in claim 1 of U.S. Pat. No. 4,857,447 (in particular, Y-1 to Y-19 in columns 25 to 36)

Preferred additives other than the couplers are listed below:

Dispersion Media of Oil-Soluble Organic Compound:

P-3, P-5, P-16, P-19, P-25, P-30, P-42, P-49, P-54, P-55, P-66, P-81, P-85, P-86, and P-93 (paces 140 to 144) disclosed in JP-A-62-215272

Latexes for Impregnation of Oil-Soluble Organic Compound:

The latexes disclosed in U.S. Pat. No. 4,199,363

Scavengers of the Oxidant of a Developing Agent:

The compounds represented by formula (1), lines 54 to 62, column 2 of U.S. Pat. No. 4,978,606 (in particular, I-(1), I-(2), I-(6), and I-(12), columns 4 and 5); and the compounds represented by the formula disclosed in lines 5 to 10, column 2 of U.S. Pat. No. 4,923,787 (in particular, Compound 1, column 3)

Stain Inhibitors:

The compounds represented by formula (I), (II) or (III), lines 30 to 33, page 4 of EP298,321A (in particular, I-47, I-72, III-1, and III-27, pages 24 to 48)

Discoloration Inhibitors:

A-6, A-7, A-20, A-21, A-23, A-24, A-25, A-26, A-30, A-37, A-40, A-42, A-48, A-63, A-90, A-92, A-94, and A-164 (pages 69 to 118) disclosed in EP 298,321A; II-1 to III-23, columns 25 to 38 disclosed in U.S. Pat. No. 5,122,444 (in particular, III-10); I-1 to III-4, pages 8 to 12 of EP 471,347A (in particular, II-2); and A-1 to A-48, columns 32 to 40 in U.S. Pat. No. 5,139,931 (in particular, A-39 and A-42)

Compounds for Reducing the Using Amounts of Color Intensifiers and Color Mixing Preventives:

I-1 to II-15, pages 5 to 24 in EP 411,324A (in particular, I-46)

Formaldehyde Scavengers:

SCV-1 to SCV-28, pages 24 to 29 of EP 477,932A (in particular, SCV-8)

Hardening Agents:

H-1, H-4, H-6, H-8 and H-14 page 17 of JP-A-1-214845; the compounds represented by any of formulae (VII) to (XII), columns 13 to 23 in U.S. Pat. No. 4,618,573 (H-1 to H-54); the compounds represented by formula (6) right lower column, page 8 of JP-A-2-214852 (H-1 to H-76) (in particular, H-14); and the compounds disclosed in claim 1 of U.S. Pat. No. 3,325,287

Development Inhibitor Precursors:

P-24, P-37 and P-39 on pages 6 and 7 of JP-A-62-168139; and the compounds disclosed in claim 1 of U.S. Pat. No. 5,019,492 (in particular, Compounds 28 and 29 in column 7)

Antiseptics and Mildewproofing Agents:

I-1 to III-43 in columns 3 to 15 of U.S. Pat. No. 4,923,790 (in particular, II-1, II-9, II-10, II-18 and III-25)

Stabilizers and Antifoggants:

I-1 to (14), columns 6 to 16 of U.S. Pat. No. 4,923,793 (in particular, I-1, 60, (2) and (13)); and Compounds 1 to 65 in columns 25 to 32 of U.S. Pat. No. 4,952,483 (in particular, Compound 36)

Chemical Sensitizers:

Triphenylphosphine selenide; and Compound 50 disclosed in JP-A-5-40324

Dyes:

a-1 to b-20, pages 15 to 18 (in particular, a-1, a-12, a-18, a-27, a-35, a-36, and b-5), and V-1 to V-23, pages 27 to 29 (in particular, V-1) of JP-A-3-156450; F-I-1 to F-II-43, pages 33 to 55 of EP 445,627A (in particular, F-I-11 and F-II-8); III-1 to III-36, pages 17 to 28 of EP 457,153A (in particular, III-1 and III-3); crystallite dispersions of Dye-1 to Dye-124 on pages 8 to 26 of WO 88/04794; Compounds 1 to 22 on pages 6 to 11 of EP 319,999A (in particular, Compound 1); Compounds D-1 to D-87 represented by any of formulae (1) to (3), pages 3 to 28 of EP 519,306A; Compounds 1 to 22 represented by formula (I), columns 3 to 10 of U.S. Pat. No. 4,268,622; and Compounds (1) to (31) represented by formula (I) on columns 2 to 9 of U.S. Pat. No. 4,923,788

UV Absorbers:

Compounds (18b) to (18r) represented by formula (1), 101 to 427 on pages 6 to 9 of JP-A-46-3335; Compounds (3) to (66) represented by formula (I) on paces 10 to 44, and Compounds HBT-1 to HBT-10 represented by formula (III) on page 14 of EP 520,938A; and Compounds (1) to (31) represented by formula (1) in columns 2 to 9 of EP 521,823A Suitable supports usable in the invention are described, e.g., in RD, No. 17643, page 28, ibid., No. 18716, from right column on page 647 to left column on page 648, and ibid., No. 307105, page 879.

The total thickness from the photosensitive silver halide layer nearest to the support to the surface of the photographic, material of the invention is preferably 24 μm or less, more preferably 22 μm or less, and most preferably 20 μm or less. Further, the film swelling rate T1/2 is preferably 30 seconds or less, and more preferably 20 seconds or less. Taking 90% of the maximum swollen film thickness reached when a film is processed at 30° C. for 3 minutes and 15 seconds in a color developing solution as the saturated film thickness, T1/2 is defined as the time to reach ½ of the saturated film thickness. The film thickness means the film thickness measured under conditions of 25° C. relative humidity of 55% (stored for 2 days), and T1/2 can be measured using a swellometer of the type described in A. Green, Photogr. Sci. Eng., Vol. 19, No. 2, pages 124 to 129. T1/2 can be adjusted by adding hardening agents to gelatin that is used as a binder, or by changing the aging conditions after coating. Further, a swelling factor of from 150% A to 400% is preferred. The swelling factor can be computed from the maximum swollen film thickness obtained under the conditions described above according to the expression: (maximum swollen film thickness−film thickness)/film thickness.

As polyester supports preferably used in the invention, for example, polyethylene terephthalite, polyethylene-2,6-dinaphthalate, polypropylene terephthalate, polybutylene terephthalate, and polytrimethylene terephthalate are exemplified and polyethylene terephthalate is especially preferred. Biaxially oriented and thermally fixed polyethylene terephthalate is especially preferred for its stability and toughness.

The thickness of a support is not especially restricted, but is generally in the range of from 15 to 500 μm, and a support having a thickness of from 40 to 200 μm is especially advantageous and preferred for easiness of handling and in the point of general purpose properties. A support may be transparent, and may contain an anthraquinone dye, silicon used as dye, silicon dioxide, alumina sol, chromium salt, zirconium salt, or titanium oxide.

An antistatic layer having electric conductivity that is preferably used in the invention will be described below. Antistatic agents for the antistatic layer having electric conductivity are not especially restricted, and both high molecular electrolyte and metallic oxide may be used, but metallic oxide capable of obtaining antistatic property after development process is especially preferred. As metallic oxide, for example, at least one kind of electrically conductive metallic oxide selected from ZnO, $TiO_2$, $SnO_2$, $Al_2O_3$, $Sb_2O_5$, $In_2O_3$, $SiO_2$, MgO, BaO, $MoO_3$ and $V_2O_5$, or composite oxide of these metallic oxides, and fine particles of metallic oxides of these metallic oxides further containing dissimilar atoms are exemplified. At least one kind of electrically conductive metallic oxide of ZnO, $TiO_2$, $SnO_2$, $Al_2O_3$, $In_2O_3$, MgO and $V_2O_5$, or composite oxide of these metallic oxides, and metallic oxides of these metallic oxides further containing dissimilar atoms are more preferred. As the examples containing a small amount of dissimilar atoms, doping Al or In to ZnO, Nb or Ta to $TiO_2$, Sn to $In_2O_3$, and Sb, Nb or a halogen element to $SnO_2$ respectively in an amount of from 0.01 to 30 mol % (preferably from 0.1 to 10 mol %) can be exemplified. When the addition amount of dissimilar element is less than 0.01 mol %, sufficient electric conductivity cannot be given to the oxide or composite oxide, while when the amount exceeds 30 mmol %, the degree of blackening of the grains increases and the antistatic layer is blackened, so that not suitable as a photographic material. Accordingly, as the materials of electrically conductive metallic oxide in the invention, metallic oxides or composite metallic oxides containing a small amount of dissimilar element are preferably used. Those containing oxygen detect in the crystal structure are also preferred. The fine particles of these metallic oxides or composite metallic oxides have a volume resistivity of preferably $10^7$ Ω·cm or less, and more preferably $10^5$ Ω·cm or less. The primary particle size of metallic oxides or composite metallic oxides is preferably from 0.002 to 0.7 μm, and especially preferably from 0.005 to 0.3 μm. The resistance of the obtained antistatic layer is preferably $10^{12}\Omega$ or less, more preferably $10^{10}\Omega$ or less, and still more preferably $10^{9}\Omega$ or less.

In a protective layer preferably used in the invention are used diacetyl cellulose as a binder and polyacrylonitrile as a malting agent, by which a silver halide photographic material having desired scratch resistance and capable of preventing falling off of the matting agent can be obtained. The coating amount of the matting agent is preferably from 1 to 50 mg/m$^2$, and when the amount is less than 1 mg/m$^2$, the above object cannot be obtained concerning scratch resistance. Further, the matting agent may not be spherical, but a particle size in the direction parallel to the support surface is preferably from 0.1 to 6 μm. When the particle size is smaller than 0.1 μm, the effect as the matting agent is inefficacious, and when it exceeds 6 μm, the matting agent falls off and transparency is lost.

The thickness of the protective layer is preferably from 0.2 to 1 μm. When the thickness is 0.2 μm or less, scratch resistance is insufficient, and when 1 μm or more, transparency is lost and the above objects cannot be achieved. The film thickness in the invention is not based on the convexities of the matting agent opened on the surface of a film but is based on the surface in parallel with a support.

The antistatic layer having electric conductivity and the protective layer preferably used in the invention are generally described in the next place. As the binder for use in the antistatic layer having electric conductivity, hydrophilic binders described in Research Disclosure, No. 17643, page 26, and ibid., No. 18716, page 651 may be used, or well-known thermoplastic resins, thermosetting resins, radiation-curing resins, and hydrophobic binders represented by reactive resins that are used in various films may be used, but hydrophilic binders are preferred. As hydrophilic binders, gelatin, gelatin derivatives, casein, agar, starch, water-soluble polymers such as polyvinyl alcohol, cellulose ester and water-soluble polyester are exemplified. Gelatin is most preferred, and gelatin derivatives may be used in combination. Lime-processed gelatin and acid-processed gelatin are preferably used as gelatins.

The antistatic layer having electric conductivity for use in the invention may contain various kinds of hardening agents. As hardening agents, e.g., aldehyde compounds such as formaldehyde and glutaraldehyde, ketone compounds such as diacetyl and cyclopentanedione, bis(2-chloroethylurea), 2-hydroxy-4,6-dichloro-1,3,5-triazine, compounds having reactive halogen, divinylsulfone, 5-acetyl-1,3-diacryloyl-hexahydro-1,3,5-triazine, compounds having reactive olefin, N-hydroxylmethylphthalimide, N-methylol compound, isocyanates, aziridine compounds, acid derivatives, epoxy compounds, and halogen carboxy aldehydes such as mucochloric acid can be exemplified.

Isocyanate can be used in a protective layer. As usable aromatic isocyanates, e.g., toluenediisocyanate (TDI) and adducts of the isocyanate and active hydrogen compounds are exemplified, and those having average molecular weight in the range of from 100 to 3,000 are preferably used. As aliphatic isocyanates, hexamethylenediisocyanate (HMDI) and adducts of the isocyanate and active hydrogen compounds are exemplified. Of these adducts of the isocyanate and active hydrogen compounds, those having molecular weight in the range of from 100 to 3,000 are preferably used. Of aliphatic isocyanates, non-alicyclic isocyanate and adducts of the isocyanate and active hydrogen compounds are preferred. As the amount of isocyanates to be used, the amount of from 5 to 75 weight parts per 100 weight parts of the binder is preferred, and from 10 to 40 weight parts is more preferred.

In the next place, solvents and swelling agents for both of the antistatic layer having electric conductivity and the protective layer preferably used in the invention are described. The solvents and swelling agents are not especially limited so long as they can dissolve or swell the binder to be used. As those that can be used for many binders, e.g., benzoic acid, salicylic acid, salicylic acid ester, monochloroacetic acid, dichloroacetic acid, trichloroacetic acid, trifluoroacetic acid, 2-nitropropanol, benzyl alcohol, benzaldehyde, acetonyl acetone, acetophenone, benzamide, benzonitrile, benzylamine, methyl nicotinate, phenol, orthochlorophenol, parachloro-phenol, cresol, resorcin, and other phenolic compounds are preferred. Of these compounds, phenolic compounds are more preferred, and phenol, orthochlorophenol, parachlorophenol and resorcin are especially preferred. These phenolic compounds are preferably used in the range of from 0.01 to 1,000% based on the binder of the layer to be added, and more preferably in the range of from 0.1 to 100%. When the amount is 1,000% or more, the sensitivity and conservation stability of the photographic material are adversely influenced. When the proportion is less than 0.01%, sufficient adhesion required in the invention cannot be obtained. The solvents and swelling agents for use in the invention may be used for either the antistatic layer or the protective layer or for both layers.

Other components such as surfactants and sliding agents may be used in combination in both of the antistatic layer having electric conductivity and the protective layer preferably used in the invention according to necessity in the range not impairing the effect of the invention.

As the surfactants, e.g., well-known anionic surfactants, cationic surfactants, amphoteric surfactants and nonionic surfactants are exemplified.

As the sliding agents, e.g., phosphoric acid ester of higher alcohols having from 8 to 22 carbon atoms, and amino salts thereof; palmitic acid, stearic acid, behenic acid, and esters thereof; and silicone compound are exemplified.

The coating solutions for the autistatic layer having electric conductivity and the protective layer are coated on the surface of a polyester support (on the side on which the photosensitive layer is not provided) according to well-known coating methods and dried to form the layers.

As well-known coating methods, e.g., a dip coating method, an air knife coating method, a curtain coating method, a wire bar coating method, a gravure coating method, and an extrusion coating method are exemplified.

Polyester supports preferably used in the invention are described in detail below. For the purpose of firmly adhering each layer to the support, it is preferred for both surfaces of the polyester support to be subjected to surface activation treatment, such as chemical treatment, mechanical treatment, corona discharge treatment, flame treatment, ultraviolet treatment, high frequency treatment, glow discharge treatment, active plasma treatment, laser treatment, mixed acid treatment, and ozone oxidation treatment, in advance.

For example, when a silver halide photographic material is manufactured by coating the coating solutions for forming silver halide photosensitive layers (hereinafter sometimes referred to as "coating solutions for silver halide photosensitive layers"), for ensuring an adhering property between the support and layers, (1) a method of coating the coating solutions for silver halide photosensitive layers directly on the support after performing the surface activation treatment to obtain adhering strength, and (2) a method of, after once performing the surface activation treatment, providing an undercoat layer, and coating the coating solutions for silver halide photosensitive layers on the undercoat layer are exemplified. The method of (2) is more effective and widely carried out.

Undercoating method is described. The undercoat layer may be a single layer or may comprise two or more layers. As the binder for the undercoat layer, copolymers using monomers selected from vinyl chloride, vinylidene chloride, butadiene, methacrylic acid, acrylic acid, itaconic acid, and maleic acid anhydride as starting materials, and polyethyleneimine, epoxy resins, grafted gelatin, nitrocellulose, and gelatin are exemplified. As compounds for swelling the support, resorcin and p-chlorophenol are exemplified. As gelatin hardening agents for the undercoat layer, chromium salt (chrome alum), aldehydes (formaldehyde, glutaraldehyde, etc.), isocyanates, activated halogen compounds (2,4-dichloro-6-hydroxy-S-triazine), epichlorohydrin resins, and active vinylsulfone compounds can be exemplified. SiO2. TiO2, fine particles of inorganic materials, or fine particles of polymethyl methacrylate copolymer (0.01 to 10 μm) may be contained in the coating solution of the undercoat layer as matting agent.

In the invention, as the image-forming method for recording on a silver halide photographic material according to an analog system, there is known a contact printing method of performing exposure by closely adhering a silver halide photographic material on which a digital image is recorded to a silver halide photographic material on which a digital image is not recorded or an unexposed silver halide photographic material. As the apparatus for use for the contact printing method, e.g., Model C Printer (manufactured by BELL and HOWELL) can be used.

EXAMPLE

The invention will be described in detail with reference to examples, but the invention should not be construed as being restricted thereto.

Example 1

Preparation of Emulsion Em-A:

An AgBrI monodispersed cubic emulsion is prepared according to the following method. In the first place, the following solutions are prepared.

Solution A:

An aqueous solution containing 30 g of lime-processed ossein gelatin, 0.4 g of KBr, and 1.3 liters of water Solution B:

An aqueous solution (0.2 liters) containing 20 g of $AgNO_3$

Solution C:

An aqueous solution (0.2 liters) containing 15 g of KBr and 0.6 g of KI

Solution D:

An aqueous solution (0.65 liters) containing 162.5 of AgNO3

Solution E:

An aqueous solution (0.7 liters) containing 124.8 g of KBr, 5.4 g of KI, and 0.6 g of NaCl Solution A is put into a reaction vessel and stirred with maintaining the temperature at 68° C. Solution B (150 ml) is added to the above solution over 5 minutes. Solution C is added to the solution by controlling the addition amount so as to maintain pBr in the reaction vessel during the time at 3.5. After termination of the addition, the temperature of the solution in the reaction vessel is raised to 70° C. After that, 540 ml of solution D is added to the reaction solution over 15 minutes. Solution E is added thereto by controlling the addition amount so as to maintain pBr in the reaction vessel during the time at 3.5. During the addition, 0.005 g of thiourea dioxide, 0.005 g of sodium benzenesulfonate, and 0.0003 g of $K_2IrCl_6$ are added into the reaction vessel.

After completion of the addition, the emulsion is desalted by flocculation. After termination of desalting process, the solution is subjected to the following chemical sensitization and spectral sensitization. The emulsion after being desalted is maintained at 60° C., and sensitizing dyestuffs, potassium thiocyanate, chloroauric acid, sodium thiosulfate, N,N-dimethylselenourea, 4-hydroxy-6-methyl-1,3,3a,7-tetra-azaindene (TAI), Compound 1, Compound 2, and Compound 3 are added and the emulsion is optimally spectrally and chemically sensitized. The sensitizing dyestuffs shown in Table 1 below are added in optimal amounts by arbitrarily varying the addition ratio. The obtained grains are cubic grains having an average equivalent-sphere diameter of 0.40 μm and the coefficient of variation of equivalent-sphere diameter of 11%.

Preparation of Emulsions Em-A2, A3 and A4:

Emulsions Em-A2, A3 and A4 are prepared in the same manner as in the preparation of Em-A except for properly changing the temperature of the solution in the reaction vessel, the compositions and concentrations of Solutions A to E, the addition rates of Solutions B to E, pBr of the solution in the reaction vessel, the addition amounts of thiourea dioxide, sodium benzenesulfonate, and $K_2IrCl_6$, the kinds of the sensitizing dyestuffs after desalting, and the condition of chemical sensitization. The emulsions are all reduction sensitized cubic grains and average equivalent-sphere diameters of emulsions Em-A2, A3 and A4 are respectively 0.33 μm, 0.28 μm and 0.18 μm.

Preparation of Emulsions Em-B, D and G:

Reduction sensitized Emulsions Em-B, D and G are prepared in the same manner as in the preparation of Em-A except for properly changing the temperature of the solution in the reaction vessel, the compositions and concentrations of Solutions A to E, the addition rates of Solutions B to E, pBr of the solution in the reaction vessel, the addition amounts of thiourea dioxide, sodium benzenesulfonate, and $K_2IrCl_6$, the kinds of the sensitizing dyestuffs after desalting, and the condition of chemical sensitization.

Preparation of Emulsion Em-C:

An AgBrI monodispersed cubic emulsion is prepared according to the following method. In the first place, the following solutions are prepared.

Solution A:

An aqueous solution containing 30 g of lime-processed ossein gelatin, 0.4 g of KBr, and 1.5 liters of water Solution B:

An aqueous solution (0.65 liters) containing 162.5 g $AgNO_3$

Solution C:

An aqueous solution (0.7 liters) containing 125.4 g of KBr, 4.5 g of KI, and 0.3 g of NaCl Solution A is put into the reaction vessel and stirred with maintaining the temperature at 55° C. Solution B (540 ml) is added to the above solution over 10 minutes. Solution C is added to the solution by controlling the addition amount so as to maintain pBr in the reaction vessel during the time at 3.5. During the addition, 0.007 g of thiourea dioxide, 0.007 g of sodium benzenesulfonate, and 0.0005 g of $K_2IrCl_6$ are added into the reaction vessel.

After completion of the addition, the emulsion is desalted by flocculation. After termination of desalting process, the solution is subjected to the following chemical sensitization and spectral sensitization. The emulsion after being desalted is maintained at 62° C., and sensitizing dyestuffs, chloroauric acid, sodium thiosulfate, 4-hydroxy-6-methyl-1,3,3a,7-tetraazaindene (TAI), Compound 1, Compound 2, and Compound 3 are added and the emulsion is optimally spectrally and chemically sensitized. The addition amounts of the sensitizing dyestuffs are as shown in Table 1 below. The obtained grains are reduction sensitized cubic grains having an average equivalent-sphere diameter of 0.09 μm and the coefficient of variation of equivalent-sphere diameter of 13%.

Preparation of Emulsions Em-E, F, H and I:

Reduction sensitized Emulsions Em-E, Em-F, Em-H and Em-I are prepared in the same manner as in the preparation of Emulsion Em-C, except for properly changing the temperature of the solution in the reaction vessel, the compositions and concentrations of Solutions A to E, the addition rates of Solutions B to E, pBr of the solution in the reaction vessel, the addition amounts of thiourea dioxide, sodium benzene-sulfonate, and $K_2IrCl_6$, the kinds of the sensitizing dyestuffs after desalting, and the condition of chemical sensitization.

Preparation of Emulsions Em-D2, E2 and F2:

Emulsions Em-D2, E2 and F2 are prepared in the same manner as in the preparation of Emulsions Em-D, Em-E and Em-F, except for changing the sensitizing dyestuffs to Compounds ExS-21 and ExS-22 according to the invention.

TABLE 1

| Name of Emulsion | Shape of Grain | Average Grain Size (μm) | Variation Coefficient (%) | Content of I (mol %) | Content of Cl (mol %) | Sensitizing Dyestuffs |
|---|---|---|---|---|---|---|
| Em-A | Cube | 0.40 | 11 | 3.5 | 1 | ExS-1 ($3.4 \times 10^{-5}$)/ExS-2 ($1.7 \times 10^{-4}$)/ExS-3 ($1.4 \times 10^{-4}$) |
| Em-B | Cube | 0.15 | 12 | 3.2 | 0 | ExS-1 ($1.4 \times 10^{-4}$)/ExS-2 ($7.3 \times 10^{-4}$)/ExS-3 ($5.8 \times 10^{-4}$) |
| Em-C | Cube | 0.09 | 13 | 2.5 | 0.5 | ExS-1 ($2.0 \times 10^{-1}$)/ExS-2 ($1.0 \times 10^{-3}$)/ExS-3 ($8.0 \times 10^{-4}$) |
| Em-D | Cube | 0.11 | 12 | 3.3 | 0.5 | ExS-4 ($1.9 \times 10^{-3}$) |
| Em-E | Cube | 0.09 | 12 | 2.8 | 0 | ExS-4 ($2.1 \times 10^{-3}$) |
| Em-F | Cube | 0.08 | 14 | 2.2 | 0 | ExS-4 ($1.7 \times 10^{-3}$) |
| Em-G | Cube | 0.34 | 13 | 3.5 | 1 | ExS-8 ($8.8 \times 10^{-5}$)/ExS-9 ($2.8 \times 10^{-5}$)/ExS-10 ($1.4 \times 10^{-5}$) |
| Em-H | Cube | 0.15 | 15 | 3.5 | 0 | ExS-8 ($4.5 \times 10^{-4}$)/ExS-9 ($1.4 \times 10^{-4}$)/ExS-10 ($6.8 \times 10^{-5}$) |
| Em-I | Cube | 0.10 | 15 | 3.5 | 0 | ExS-8 ($1.0 \times 10^{-3}$)/ExS-9 ($3.0 \times 10^{-4}$)/ExS-10 ($1.5 \times 10^{-4}$) |
| Em-A2 | Cube | 0.33 | 12 | 3.5 | 1 | ExS-1 ($4.2 \times 10^{-5}$)/ExS-2 ($2.1 \times 10^{-4}$)/ExS-3 ($1.7 \times 10^{-4}$) |
| Em-A3 | Cube | 0.23 | 12 | 3.5 | 1 | ExS-1 ($6.0 \times 10^{-5}$)/ExS-2 ($2.9 \times 10^{-4}$)/ExS-3 ($2.3 \times 10^{-4}$) |
| Em-A4 | Cube | 0.18 | 12 | 3.5 | 1 | ExS-1 ($7.5 \times 10^{-5}$)/ExS-2 ($3.8 \times 10^{-4}$)/ExS-3 ($3.0 \times 10^{-4}$) |
| Em-D2 | Cube | 0.11 | 12 | 3.3 | 0.5 | ExS-21 ($1.0 \times 10^{-3}$)/ExS-22 ($1.1 \times 10^{-3}$) |
| Em-E2 | Cube | 0.09 | 12 | 2.8 | 0 | ExS-21 ($1.1 \times 10^{-3}$)/ExS-22 ($1.2 \times 10^{-3}$) |
| Em-F2 | Cube | 0.08 | 14 | 2.2 | 0 | ExS-21 ($8.1 \times 10^{-4}$)/ExS-22 ($8.9 \times 10^{-4}$) |

*Average grain size means an average equivalent-sphere diameter. Variation coefficient means the variation coefficient of the equivalent-sphere diameter.
*In parentheses of sensitizing dyestuffs is the addition amount (unit: mol/mol Ag).

Manufacture of Multilayer Color Photographic Material Sample 101:

A backing layer shown below is coated on a cellulose triacetate film support having an undercoat layer to prepare a support.

Backing Layer:

| | |
|---|---|
| Methyl methacrylate/methacrylic acid copolymer (copolymerization molar ratio: 1/1) | 1.5 mass parts |
| Cellulose acetate hexahydrophthalate (a hydroxypropyl group: 4%, a methyl group: 15%, an acetyl group: 8%, a phthalyl group: 36%) | 1.5 mass parts |
| Acetone | 50 mass parts |
| Methanol | 25 mass parts |
| Methyl cellosolve | 25 mass parts |
| Colloidal carbon | 1.2 mass parts |

A coating solution is prepared by the above ratio, and coated so as to reach the density of 1.0 against white light.

An undercoat layer is coated on the side of the support opposite to the side on which the backing layer is coated, and each layer having the composition shown below is coated on the undercoat layer to manufacture a multilayer color photographic material sample 101.

Composition of Photographic Material:

The coating amounts of the silver halide and colloidal silver are shown as the coating amount of silver in the unit of $g/m^2$, and the amounts of the coupler, additive and gelatin are shown in the unit of $g/m^2$.

| | | |
|---|---|---|
| **First Layer (antihalation layer)** | | |
| Black colloidal silver | coating amount of silver | 0.108 |
| Gelatin | | 0.908 |
| **Second Layer (intermediate layer)** | | |
| Gelatin | | 1.150 |
| ExF-4 | | 0.980 |

-continued

| | | |
|---|---|---|
| **Third Layer (low sensitivity red-sensitive emulsion layer)** | | |
| EM-1 | coating amount of silver | 0.260 |
| Gelatin | | 1.745 |
| ExC-1 | | 0.110 |
| ExC-2 | | 0.164 |
| ExC-3 | | 0.065 |
| ExC-5 | | 0.036 |
| Cpd-2 | | 0.092 |
| Solv-1 | | 0.380 |
| **Fourth Layer (middle sensitivity red-sensitive emulsion layer)** | | |
| Em-H | coating amount of silver | 0.223 |
| Gelatin | | 0.870 |
| ExC-1 | | 0.085 |
| ExC-2 | | 0.115 |
| ExC-3 | | 0.030 |
| ExC-4 | | 0.025 |
| ExC-5 | | 0.010 |

-continued

| | | |
|---|---|---|
| Cpd-2 | | 0.065 |
| Solv-1 | | 0.270 |
| Fifth Layer (high sensitivity red-sensitive emulsion layer) | | |
| Em-G | coating amount of silver | 0.210 |
| Gelatin | | 0.790 |
| ExC-1 | | 0.055 |
| ExC-2 | | 0.080 |
| ExC-4 | | 0.005 |
| Cpd-2 | | 0.050 |
| Solv-1 | | 0.165 |
| Sixth Layer (intermediate layer) | | |
| Gelatin | | 1.489 |
| Cpd-1 | | 0.124 |
| ExF-5 | | 0.074 |
| Solv-1 | | 0.239 |
| Seventh Layer (low sensitivity green-sensitive emulsion layer) | | |
| Em-F | coating amount of silver | 0.409 |
| Gelatin | | 1.690 |
| ExM-1 | | 0.309 |
| ExM-3 | | 0.102 |
| Solv-1 | | 0.499 |
| Solv-2 | | 0.052 |
| Eighth Layer (middle sensitivity green-sensitive emulsion layer) | | |
| Em-E | coating amount of silver | 0.220 |
| Gelatin | | 0.502 |
| ExM-1 | | 0.086 |
| ExM-2 | | 0.033 |
| ExM-3 | | 0.022 |
| Solv-1 | | 0.162 |
| Solv-2 | | 0.017 |
| Ninth Layer (high sensitivity green-sensitive emulsion layer) | | |
| Em-D | coating amount of silver | 0.195 |
| Gelatin | | 0.410 |
| ExM-1 | | 0.063 |
| ExM-2 | | 0.025 |
| ExM-3 | | 0.016 |
| Solv-1 | | 0.135 |
| Solv-2 | | 0.009 |
| Tenth Layer (yellow filter layer) | | |
| Yellow colloidal silver | coating amount of silver | 0.058 |
| Gelatin | | 0.950 |
| Cpd-1 | | 0.105 |
| Solid dispersion dye ExF-9 | | 0.135 |
| Solv-1 | | 0.121 |
| Eleventh Layer (low sensitivity blue-sensitive emulsion layer) | | |
| Em-C | coating amount of silver | 0.105 |
| Em-B | coating amount of silver | 0.030 |
| Gelatin | | 1.514 |
| ExY-1 | | 0.056 |
| ExY-2 | | 0.580 |
| ExC-2 | | 0.008 |
| Solv-1 | | 0.260 |
| Twelfth Layer (middle sensitivity blue-sensitive emulsion layer) | | |
| Em-B | coating amount of silver | 0.120 |
| Gelatin | | 0.859 |
| ExY-1 | | 0.039 |
| ExY-2 | | 0.373 |
| ExC-3 | | 0.009 |
| Solv-1 | | 0.159 |
| Thirteenth Layer (high sensitivity blue-sensitive emulsion layer) | | |
| Em-A | coating amount of silver | 0.105 |
| Gelatin | | 0.202 |
| ExY-1 | | 0.005 |
| ExY-2 | | 0.049 |
| Solv-1 | | 0.022 |
| Fourteenth Layer (first protective layer) | | |
| Silver iodobromide emulsion grains | coating amount of silver | 0.200 |

-continued

| | |
|---|---|
| (average equivalent-sphere diameter: 0.07 μm, content of silver iodide: 2 mol %) | |
| Gelatin | 0.683 |
| Solid dispersion dye ExF-9 | 0.054 |
| ExF-1 | 0.073 |
| H-1 | 0.160 |
| Fifteenth Layer (second protective layer) | |
| Gelatin | 0.727 |
| B-1 (diameter: 2.0 μm) | 0.007 |
| B-2 (diameter: 2.0 μm) | 0.005 |
| B-3 | 0.047 |
| H-1 | 0.170 |

To the thus manufactured Sample 101 are added 1,2-benzisothiazolin-3-one (200 ppm on average to gelatin) n-butyl-p-hydroxybenzoate (about 1,000 ppm, the same as above), and 2-phenoxyethanol (about 10,000 ppm, the same as above), in addition to the above.

Cpd-3 to Cpd-7, B-4, B-5, W-1 to W-13, F-1 to F-21, ExF-2, ExF-3, ExF-6, UV-1 to UV-5 are further added.

Preparation of Dispersion of Organic Solid Dispersion Dye:

Solid dispersion dye ExF-9 in the tenth layer is dispersed by the following method.

| | |
|---|---|
| Wet cake of ExF-9 (containing 17.6 mass % of water) | 1.210 kg |
| W-11 | 0.400 kg |
| F-15 | 0.006 kg |
| Water | 8.384 kg |
| Total | 10.000 kg |

(pH is adjusted to 7.2 with NaOH)

The slurry having the above composition is coarsely dispersed by stirring with a dissolver, and then dispersed with agitator mill LMK-4 at a peripheral speed of 10 m/sec, discharge amount of 0.6 kg/min, and packing rate of 80% of zirconia beads having a diameter of 0.3 mm to obtain solid fine particle dispersion. The average equivalent-sphere diameter of the dye fine particles is 0.15 μm.

The structural formulae of the materials used in the photosensitive material are shown below.

ExS-1
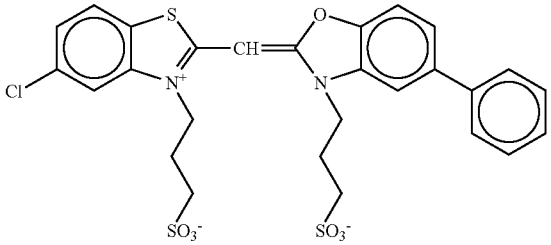
ExS-2
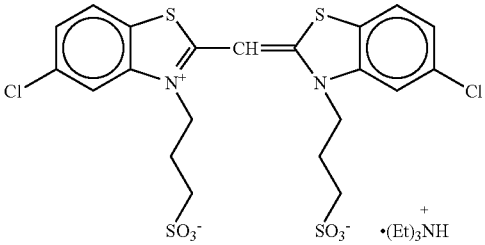
ExS-3
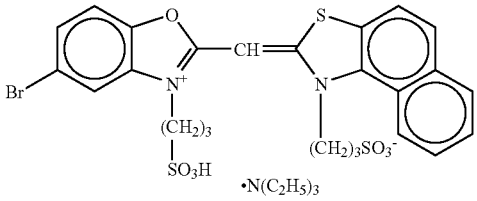
ExS-4
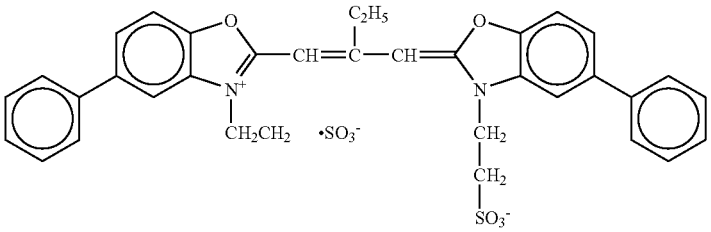
ExS-8
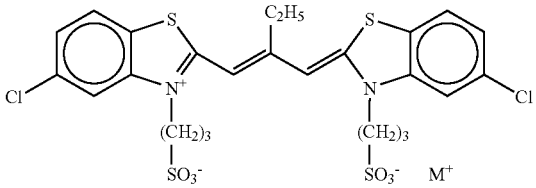
ExS-9
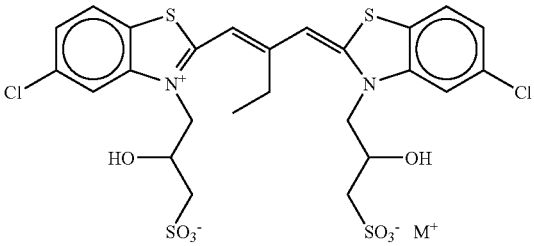
ExS-10
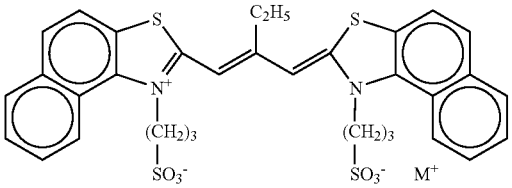
Compound 1
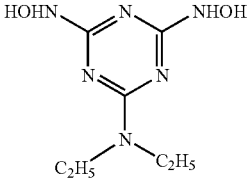
Compound 2
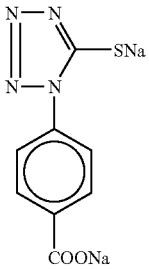
Compound 3
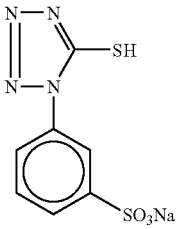

-continued
ExC-1
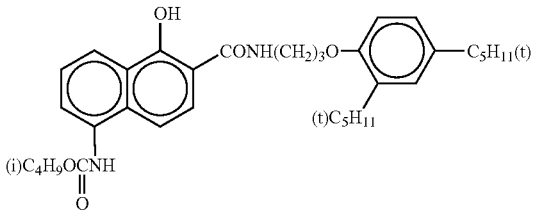
ExC-2
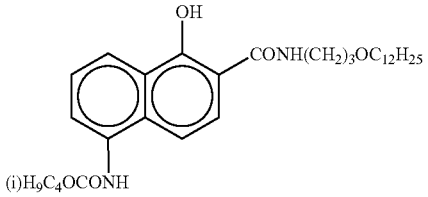
ExC-3
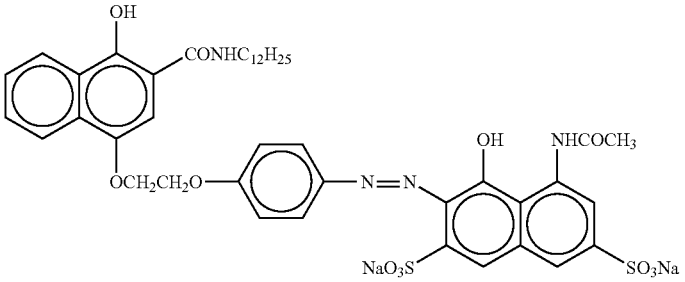
ExC-4
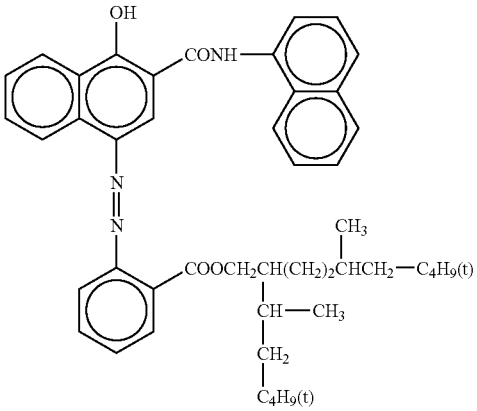
ExC-5
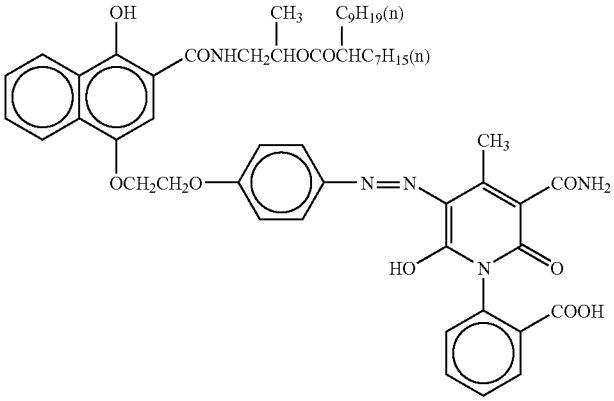

-continued
ExM-1
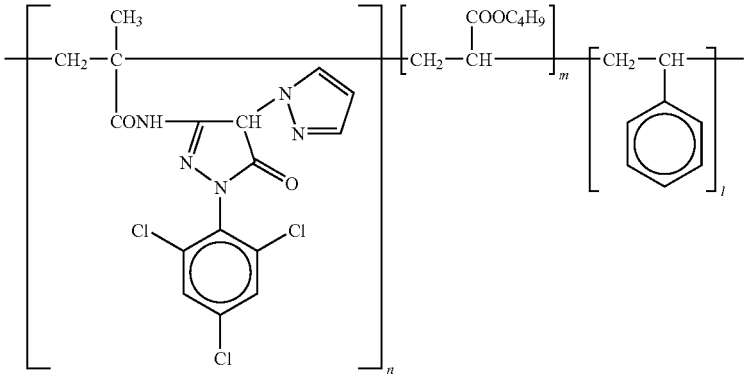
n/m/l: 2/1/1
(weight ratio)
Average molecular weight: 20,000
ExM-2
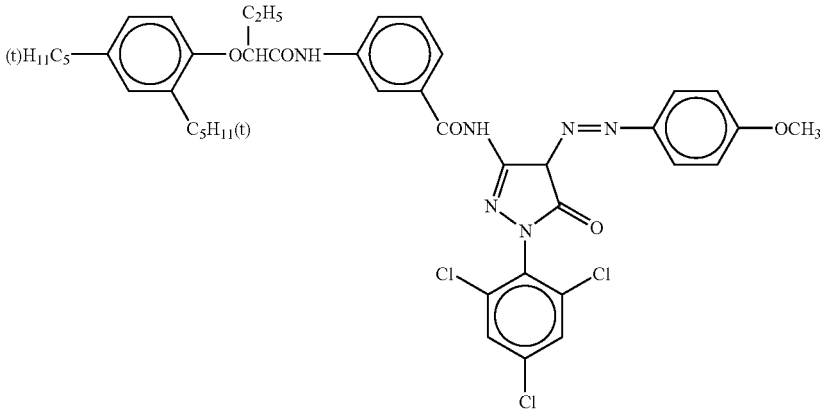
ExM-3
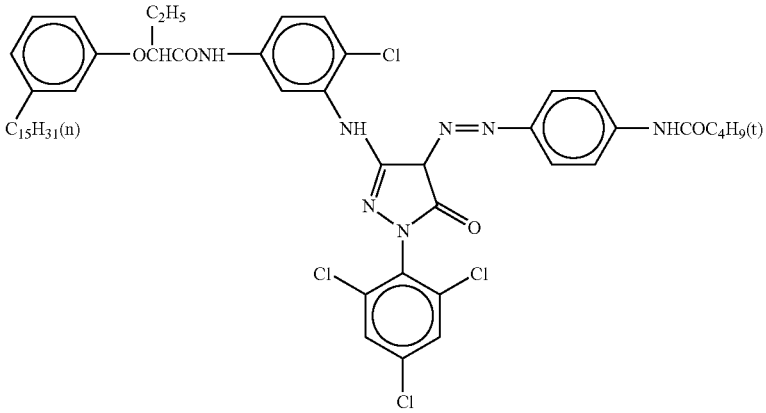
ExY-1
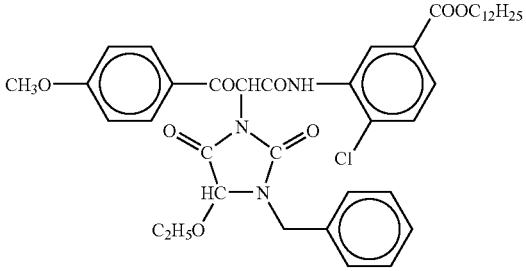
ExY-2
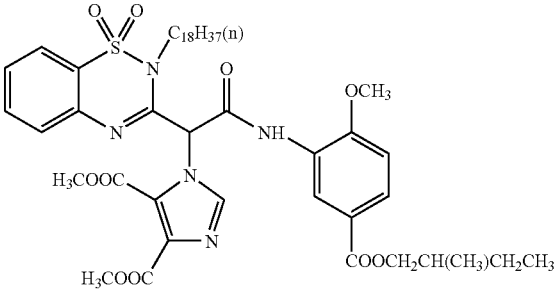

-continued
Solv-1
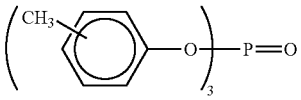
Solv-2
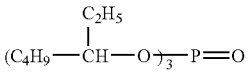
Cpd-1
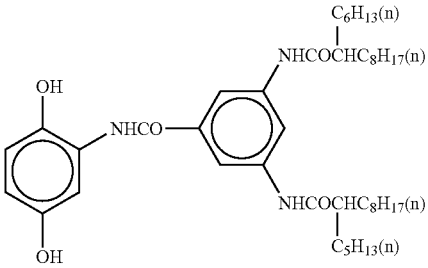
Cpd-2
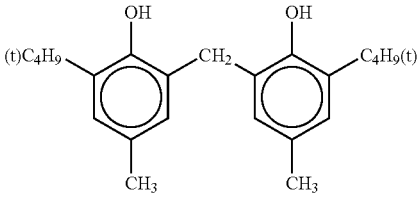
Cpd-3
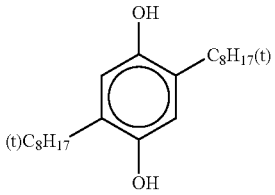
Cpd-4
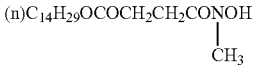
Cpd-5
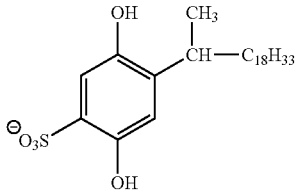
Cpd-6
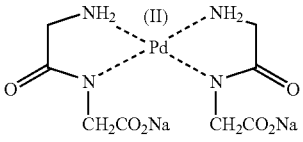
Cpd-7
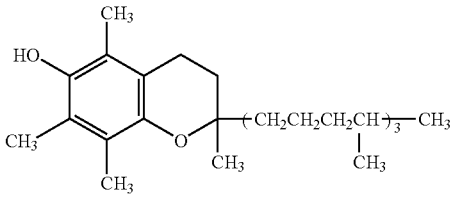
B-1
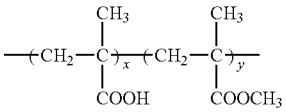
x/y = 10/90
B-2
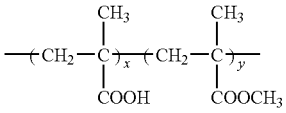
x/y = 40/60
B-3
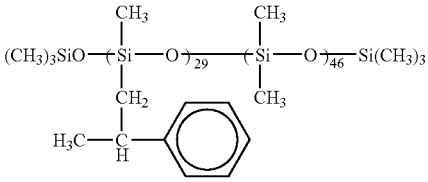
B-4
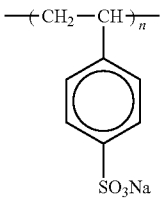
B-5
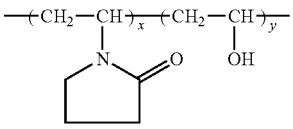
x/y = 70/30
UV-1
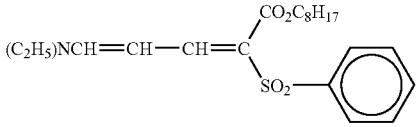
UV-2
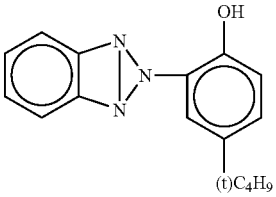

-continued
UV-3
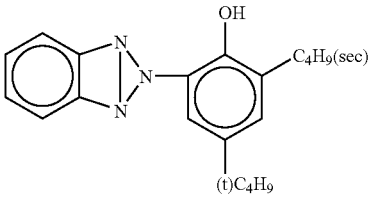
UV-4
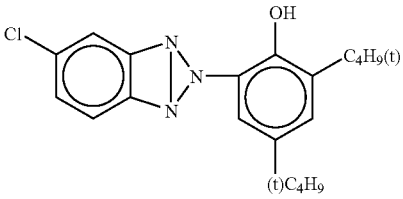
UV-5
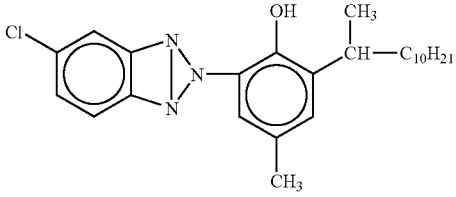
W-1
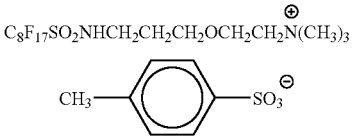
W-2
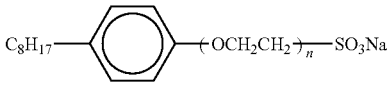
n = 2-4
W-3
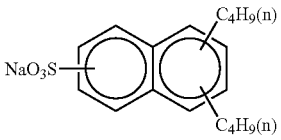
W-4
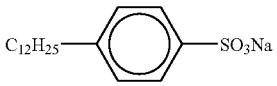
W-5
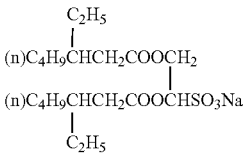
W-6
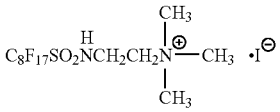
W-7
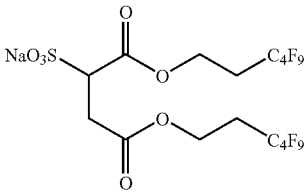
W-8
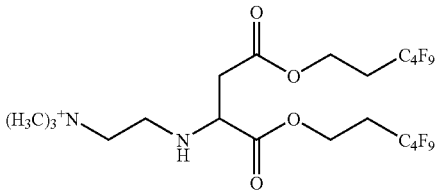
W-9
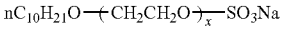
x = 1-3
W-10
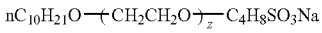
z = 1-3
W-11
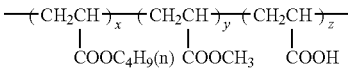
x/y/z: 20/60/20
(weight ratio)
Average molecular weight: about 36,000
W-12
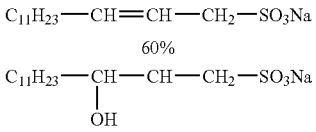
60%
40%
W-13
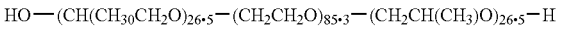

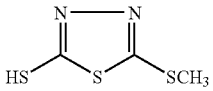
-continued
F-1
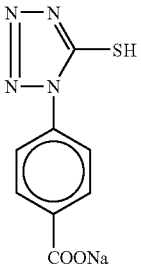
F-2
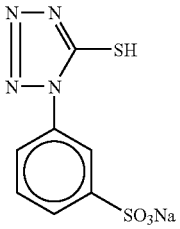
F-3
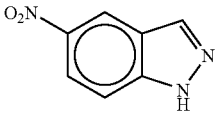
F-4
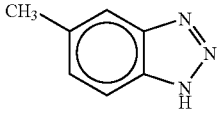
F-5
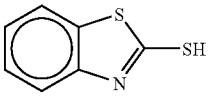
F-6
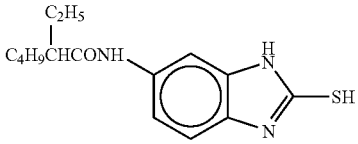
F-7
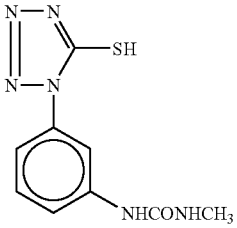
F-8
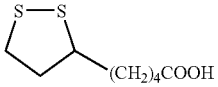
F-9
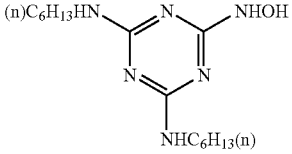
F-10
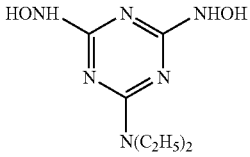
F-11
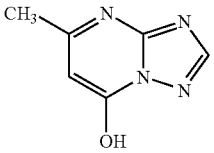
F-12
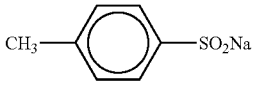
F-13
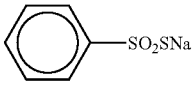
F-14
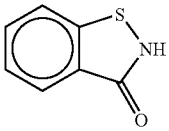
F-15
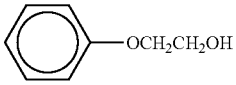
F-16
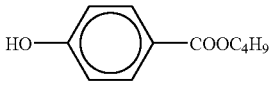
F-17
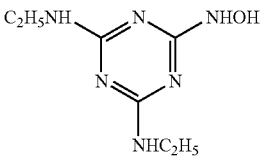
F-18

-continued
F-19
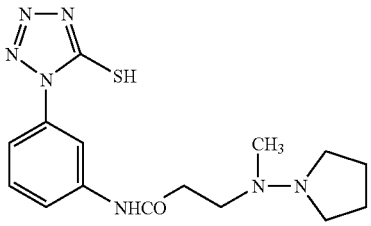
F-20
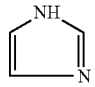
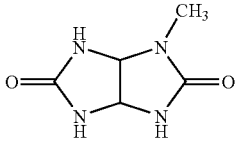
F-21
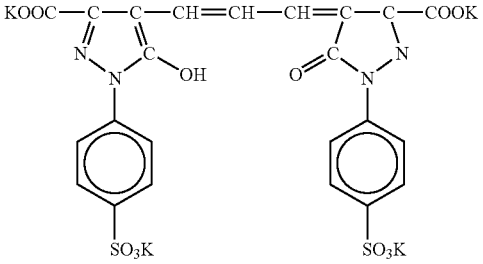
ExF-1
ExF-2
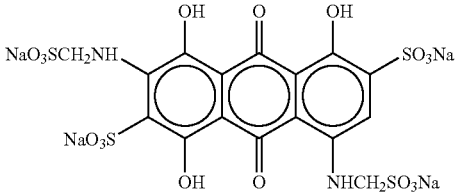
ExF-3
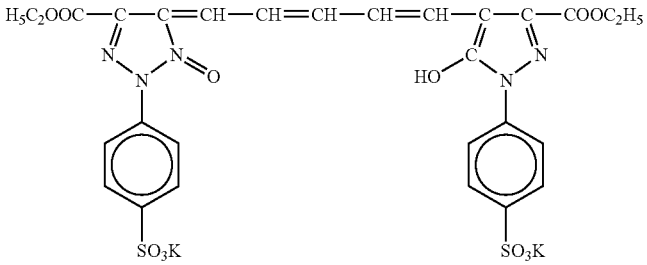
ExF-4
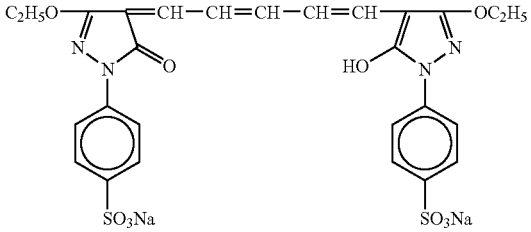
ExF-5
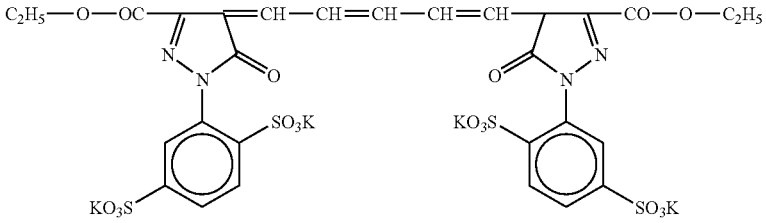

-continued

ExF-6

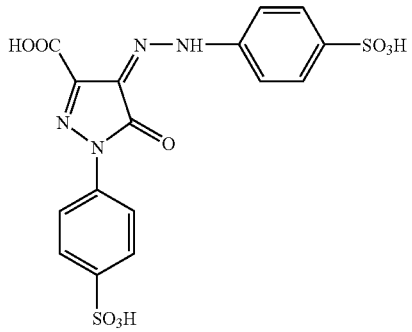

ExF-9

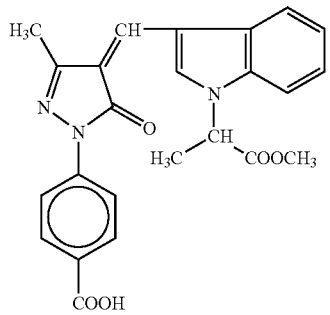

H-1

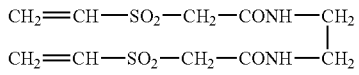

Sample 102 is manufactured in the same manner as in the manufacture of Sample 101, except for changing Em-A in $13^{th}$ layer to Em-A2, and the coating amount of silver from 1.05 to 1.03. Sample 103 is manufactured in the same manner except for changing Em-A to Em-A3, and the coating amount of silver to 1.47. Sample 104 is manufactured by changing Em-A to Em-A4, and the coating amount of silver to 1.55. The change of coating amount of silver is to compensate for sensitivity change due to alteration of emulsion.

Sample 111 is manufactured in the same manner as in Sample 101 by adding 0.06 g/m$^2$ of cyan dye D-11 in the invention to the $6^{th}$ layer (corresponding to optical density of 0.20), and adding 0.03 g/m$^2$ of magenta dye D-8 according to the invention to the $10^{th}$ layer (corresponding to optical density of 0.15). Samples 102 to 104 are subjected to similar change to obtain Samples 112 to 114.

Sample 121 is manufactured in the same manner as in Sample 111 except for changing ExM-1 in the $7^{th}$ to $9^{th}$ layers to M-36 and Z-1 as shown below. Samples 112 to 114 are subjected to similar change to obtain Samples 122 to 124.

Sample 121

| | | |
|---|---|---|
| Seventh Layer (low sensitivity green-sensitive emulsion layer) | | |
| Em-F | coating amount of silver | 0.409 |
| Gelatin | | 1.690 |
| M-36 | | 0.195 |
| Z-1 | | 0.107 |
| ExM-3 | | 0.102 |
| Solv-1 | | 0.499 |
| Solv-2 | | 0.052 |
| Eighth Layer (middle sensitivity green-sensitive emulsion layer) | | |
| Em-E | coating amount of silver | 0.220 |
| Gelatin | | 0.502 |
| M-36 | | 0.054 |
| Z-1 | | 0.035 |
| ExM-2 | | 0.033 |
| ExM-3 | | 0.022 |
| Solv-1 | | 0.162 |
| Solv-2 | | 0.017 |
| Ninth Layer (high sensitivity green-sensitive emulsion layer) | | |
| Em-D | coating amount of silver | 0.195 |
| Gelatin | | 0.410 |
| M-36 | | 0.040 |
| Z-1 | | 0.022 |
| ExM-2 | | 0.025 |

-continued

| | |
|---|---|
| ExM-3 | 0.016 |
| Solv-1 | 0.135 |
| Solv-2 | 0.009 |

Sample 131 is manufactured in the same manner as in Sample 121 except for changing Em-F Em-E and Em-D in $7^{th}$ to $9^{th}$ layers to Em-F2, Em-E2 and Em-D) respectively. Samples 122 to 124 are subjected to similar change to obtain Samples 132 to 134.

Sample 141 is manufactured in the same manner as in Sample 134 by adding compound 7 according to the invention to the $13^{th}$ layer. Sample 142 is manufactured by adding compound 37 according to the invention to the $13^{th}$ layer of Sample 134. The addition amount is $3.3\times10^{-5}$ mol/mol Ag in both samples.

The contents of color development process of the samples are as follows.

| Processing | Temperature (° C.) | Time |
|---|---|---|
| (1) Prebath | 27 ± 1 | 10 sec |
| (2) Elimination of backing and spray washing | 27-38 | 5 sec |
| (3) Color development | 41.1 ± 0.1 | 3 min |
| (4) Stopping | 27-38 | 30 sec |
| (5) Water washing | 27-38 | 30 sec |
| (6) Bleaching | 27 ± 1 | 3 min |
| (7) Water washing | 27-38 | 1 min |
| (8) Fixing | 38 ± 1 | 2 min |
| (9) Water washing | 27-38 | 2 min |
| (10) Stabilization | 27-38 | 10 sec |

The prescriptions of the processing solutions used in the processing steps are as follows.

Prescription of Each Processing Solution:

| | Prescription |
|---|---|
| (1) Prebath | |
| Water at 27 to 38° C. | 800 ml |
| Borax (decahydrate) | 20.0 g |
| Sodium sulfate (anhydrous) | 100 g |
| Sodium hydroxide | 1.0 g |

-continued

| | Prescription |
|---|---|
| Water to make | 1.00 liter |
| pH (at 27° C.) | 9.25 |
| (2) Color development | |
| Water at 21 to 38° C. | 850 ml |
| Kodak Anticalcium No. 4 | 2.0 ml |
| Sodium sulfite (anhydrous) | 2.0 g |
| Eastman Antifog No. 9 | 5.0 ml |
| Sodium bromide (anhydrous) | 1.20 g |
| Sodium carbonate (anhydrous) | 25.6 g |
| Sodium bicarbonate | 2.7 g |
| Color developing agent 4-Amino-3-methyl-N-ethyl-N-(β-methane-sulfonamidoethyl)-aniline | 4.0 g |
| Water to make | 1.00 liter |
| pH (at 27° C.) | 10.20 |
| (3) Stopping | |
| Water at 21 to 38° C. | 900 ml |
| 7.0N sulfuric acid | 50 ml |
| Water to make | 1.00 liter |
| pH (at 27° C.) | 0.9 |
| (4) Bleaching | |
| Water at 24 to 38° C. | 700 ml |
| Proxel GXL | 0.07 ml |

-continued

| | Prescription |
|---|---|
| Kodak Chelating Agent No. 1 | 24.2 g |
| 28% Ammonium hydroxide | 30.0 ml |
| Ammonium bromide | 32.5 g |
| Glacial acetic acid | 10.0 ml |
| Ferric nitrate (nonahydrate) | 28.8 g |
| Water to make | 1.0 liter |
| pH (at 27° C.) | 5.0 ± 0.2 |
| (5) Fixing | |
| Water at 20 to 38° C. | 700 ml |
| Kodak Anticalcium No. 4 | 2.0 ml |
| A 58% ammonium thiosulfate solution | 185 ml |
| Sodium sulfite (anhydrous) | 10.0 g |
| Sodium bisulfite (anhydrous) | 8.4 g |
| Water to make | 1.0 liter |
| pH (at 27° C.) | 6.5 |
| (6) Stabilization | |
| Water at 21 to 27° C. | 1.00 liter |
| Kodak Stabilizer Additive | 0.14 ml |
| Formaldehyde (a 37.5% solution) | 1.5 ml |

The above-prepared samples are evaluated as follows. The results obtained are shown in Table A below.

TABLE A

| Sample | Sample No. | Emulsion in 13th Layer (equivalent-sphere diameter (μm)) | Additive to 13th Layer | Magenta Dye in 10th Layer | Cyan Dye in 6th Layer | Magenta Coupler in 7th to 9th Layers | Emulsion in 7th to 9th Layers | Conservation Stability of Latent Image of Green-Sensitive Layer, Variation Width at Dmin + 0.2 |
|---|---|---|---|---|---|---|---|---|
| 1 (Comparison) | 101 | Em-A (0.40) | — | — | — | ExM-1 | Em-D, E, F | 0.09 |
| 2 (Comparison) | 102 | Em-A2 (0.33) | — | — | — | ExM-1 | Em-D, E, F | 0.09 |
| 3 (Comparison) | 103 | Em-A3 (0.23) | — | — | — | ExM-1 | Em-D, E, F | 0.10 |
| 4 (Comparison) | 104 | Em-A4 (0.18) | — | — | — | ExM-1 | Em-D, E, F | 0.10 |
| 5 (Comparison) | 111 | Em-A (0.40) | — | D-8 | D-11 | ExM-1 | Em-D, E, F | 0.09 |
| 6 (Comparison) | 112 | Em-A2 (0.33) | — | D-8 | D-11 | ExM-1 | Em-D, E, F | 0.10 |
| 7 (Comparison) | 113 | Em-A3 (0.23) | — | D-8 | D-11 | ExM-1 | Em-D, E, F | 0.10 |
| 8 (Comparison) | 114 | Em-A4 (0.18) | — | D-8 | D-11 | ExM-1 | Em-D, E, F | 0.10 |
| 9 (Comparison) | 121 | Em-A (0.40) | — | D-8 | D-11 | M-36, Z-1 | Em-D, E, F | 0.07 |
| 10 (Invention) | 122 | Em-A2 (0.33) | — | D-8 | D-11 | M-36, Z-1 | Em-D, E, F | 0.03 |
| 11 (Invention) | 123 | Em-A3 (0.23) | — | D-8 | D-11 | M-36, Z-1 | Em-D, E, F | 0.04 |
| 12 (Invention) | 124 | Em-A4 (0.18) | — | D-8 | D-11 | M-36, Z-1 | Em-D, E, F | 0.04 |
| 13 (Comparison) | 131 | Em-A (0.40) | — | D-8 | D-11 | M-36, Z-1 | Em-D2, E2, F2 | 0.07 |
| 14 (Invention) | 132 | Em-A2 (0.33) | — | D-8 | D-11 | M-36, Z-1 | Em-D2, E2, F2 | 0.03 |
| 15 (Invention) | 133 | Em-A3 (0.23) | — | D-8 | D-11 | M-36, Z-1 | Em-D2, E2, F2 | 0.03 |
| 16 (Invention) | 134 | Em-A4 (0.18) | — | D-8 | D-11 | M-36, Z-1 | Em-D2, E2, F2 | 0.03 |
| 17 (Invention) | 141 | Em-A4 (0.18) | 7 | D-8 | D-11 | M-36, Z-1 | Em-D2, E2, F2 | 0.03 |
| 18 (Invention) | 142 | Em-A4 (0.18) | 37 | D-8 | D-11 | M-36, Z-1 | Em-D2, E2, F2 | 0.03 |

| | Blur of Green Color Value of $k/(D-0.2)^2$ | | Color Purity of Green Color | Blur of Red Color Value of $k/(D-0.2)^2$ | | Color Purity of Red Color | Functional Evaluation Sharpness | | |
|---|---|---|---|---|---|---|---|---|---|
| Sample | Dmin + 1.0 | Dmin + 2.0 | (Dmax) (%) | Dmin + 1.0 | Dmin + 2.0 | (Dmax) (%) | Negative Image | Positive Image | Color Saturation |
| 1 (Comparison) | 5.2 | 5.7 | 74 | 5.4 | 6.2 | 88 | 3.0 | 3.0 | 3.0 |
| 2 (Comparison) | 5.1 | 5.6 | 75 | 5.2 | 5.8 | 87 | 3.1 | 3.2 | 3.1 |
| 3 (Comparison) | 4.8 | 5.3 | 74 | 4.9 | 5.5 | 88 | 3.7 | 3.8 | 3.0 |
| 4 (Comparison) | 4.8 | 5.2 | 74 | 4.5 | 5.2 | 89 | 3.8 | 3.8 | 3.1 |
| 5 (Comparison) | 4.7 | 5.2 | 77 | 4.3 | 4.9 | 88 | 3.9 | 3.8 | 3.2 |
| 6 (Comparison) | 3.7 | 4.3 | 78 | 3.7 | 4.4 | 88 | 4.3 | 4.3 | 3.2 |
| 7 (Comparison) | 3.3 | 3.9 | 79 | 3.2 | 3.9 | 89 | 4.9 | 4.9 | 3.3 |
| 8 (Comparison) | 2.7 | 3.3 | 78 | 2.9 | 3.4 | 88 | 5.3 | 5.4 | 3.2 |
| 9 (Comparison) | 4.7 | 5.1 | 80 | 4.3 | 5.0 | 90 | 3.9 | 3.8 | 3.6 |
| 10 (Invention) | 3.8 | 4.3 | 81 | 3.8 | 4.5 | 91 | 4.2 | 4.3 | 3.8 |

TABLE A-continued

| | | | | | | | | | |
|---|---|---|---|---|---|---|---|---|---|
| 11 (Invention) | 3.4 | 3.9 | 81 | 3.3 | 4.0 | 91 | 4.9 | 4.9 | 3.8 |
| 12 (Invention) | 2.6 | 3.3 | 81 | 2.9 | 3.4 | 91 | 5.3 | 5.4 | 3.8 |
| 13 (Comparison) | 4.0 | 4.6 | 92 | 4.3 | 4.9 | 92 | 3.9 | 3.9 | 5.1 |
| 14 (Invention) | 3.3 | 3.9 | 93 | 3.8 | 4.5 | 92 | 4.4 | 4.4 | 5.0 |
| 15 (Invention) | 3.0 | 3.5 | 92 | 3.3 | 4.0 | 93 | 5.0 | 5.1 | 5.1 |
| 16 (Invention) | 2.5 | 2.9 | 93 | 2.9 | 3.4 | 93 | 5.4 | 5.5 | 5.0 |
| 17 (Invention) | 2.8 | 3.3 | 93 | 3.1 | 3.7 | 93 | 5.2 | 5.3 | 5.1 |
| 18 (Invention) | 2.0 | 2.7 | 93 | 2.6 | 3.1 | 92 | 5.6 | 5.7 | 5.1 |

Evaluation of Blurring Value K and Color Purity:

A digital data of the number of pixels of (2,048×1,556) is exposed in a size of 0.8×0.6 inches with B, G, R lasers, and then development processed. Blurring and color purity are evaluated according to the methods described above in the specification.

Functional Evaluation:

The image of a landscape having digital data of the number or pixels of (2,048×1,556) is exposed in a size of 0.8×0.6 inches with B, G, R lasers, and the obtained negative images are screened and appreciated by twenty panelists. Evaluation is performed by relative evaluation with the evaluation value of the time using Sample 101 being 3 (standard). Further, the negative images are exposed on Fuji Color Positive Film F-CP, and development processed according to the method described in FUJI FILM PROCESSING MANUAL, Motion Picture Films to obtain positive images. The obtained images were screened and evaluated in the same manner as above.

Sharpness is evaluated as to the negative images, and sharpness and color saturation as to the positive images by the following seven grades, and the values of evaluation by twenty panelists are averaged.

0: Very inferior
1: Inferior
2: A little inferior
3: (Standard)
4: A little superior
5: Superior
6: Very superior Evaluation of Latent Image Conservation:

Gray sensitometry exposure is carried out with red, green and blue lasers, and the samples are preserved at 30° C. 70% for 1 hour and 20 hours, respectively. After the above development process is performed, magenta density is measured. The magenta density measured is the density of Dmin+0.2, and variation widths in 1 hour and 20 hours are measured.

From the results in Table A, it is known that silver halide photographic materials excellent in sharpness and little in fluctuation of latent image conservation can be obtained in laser recording a digital image data by using silver halide emulsion grains having an average equivalent-sphere diameter of 0.35 μm or less, fixed magenta dyes according to the invention, and the couplers according to the invention. Further, silver halide photographic materials showing more excellent sharpness can be obtained by further combining the dyestuffs and compounds according to the invention.

To record a digital image of high pixel number such as the number of pixels of (2,041×1,556) in a limited image plane size (for example, 0.8×0.6 inches (45.2 mm×20.3 mm)) has conventionally been a main cause of the degradation of image quality ascribable to the deterioration of sharpness in recording on silver halide photographic materials. However, sharpness can be conspicuously improved by combining each technique as above. In addition, change in tint that conventionally arises during recording on account of the degradation of latent images can also be restrained at the same time. As a result, according to the invention, it has been possible to provide images of high quality by making use of digital images of high pixel number that has been completely impossible.

Example 2

The same experiment as in Example 1 is made by changing the cellulose triacetate film support to a polyethylene terephthalate support as described below to obtain the same results as in Example 1. Since the support has an antistatic layer remaining even after processing, dusts hardly adhere to the photographic material at the time of printing, and preferable in the point of practicability.

Preparation of a Support:

A polyethylene terephthalate film (PET film) having a thickness of 125 μm is prepared by biaxial orientation (3.3 times both in length and width) and thermal fixation at 240° C. for 10 minutes, and then corona discharge treatment on both surfaces.

Preparation of an Undercoat Layer of a Support, an Antistatic Layer and a Protective Layer:

1) Adhesive (Undercoat) Layer

Both surfaces of the polyethylene terephthalate support having a thickness of 125 nm are subjected to ultraviolet (UV) irradiation treatment, and an adhesive layer having the composition shown below is provided on the emulsion layer side. The coating amount is 10 ml/m$^2$. Ultraviolet irradiation is performed according to the method disclosed in the example of JP-B-45-3828.

| | |
|---|---|
| Gelatin | 4 weight parts |
| Distilled water | 4 weight parts |
| Salicylic acid | 1 weight part |
| Methanol | 363 weight parts |
| Epoxidized polyamide | 3 weight parts |
| p-Chlorophenol | 75 weight parts |

2) First Backing Layer

The coating solution of a first backing layer of the prescription shown below is coated simultaneously with the undercoat layer.

| | |
|---|---|
| Gelatin | 5 weight parts |
| Distilled water | 82 weight parts |
| Acetic acid | 1 weight part |
| Methanol | 1,133 weight parts |
| Epoxidized polyamide | 3 weight parts |
| p-Chlorophenol | 243 weight parts |

3) Second Backing Layer

A homogeneous solution is prepared by dissolving 230 weight parts of stannic chloride hydrate and 23 weight parts of antimony trichloride in 3,000 weight parts of ethanol. A 1N sodium hydroxide aqueous solution is dropped to the above solution until the solution reaches pH of 3 to thereby obtain co-precipitate of colloidal stannic oxide and antimony oxide. The obtained co-precipitate is allowed to stand at 50° C. for 24 hours to obtain red brownish colloidal precipitate. The red brownish colloidal precipitate is separated by centrifugation. For removing excessive ions, water is added to the precipitate to wash by centrifugation. This operation is repeated three times to remove excessive ions. Colloidal precipitate (200 weight parts) from which excessive ions are removed is re-dispersed in 1,500 weight parts of water, sprayed to a kiln heated at 500° C. to obtain bluish fine particles of the composite of stannic oxide and antimony oxide having an average particle size or 0.005 μm. The resistivity of the fine particle powder is 25 Ω·cm. A mixed solution comprising 40 weight parts of the fine particle powder and 60 weight parts of water having pH of 7.0 is prepared, crudely dispersed with a stirrer, and then dispersed with a horizontal sand mill (DYNO-MILL, manufactured by Willy A. Backfen AG) until the residence time of 30 minutes to obtain dispersion comprising secondary agglomerates of partial agglomeration of primary particles having a particle size of 0.05 μm.

A solution of the prescription shown below is coated in a dry film thickness of 0.2 μm, and dried at 110° C. for 30 seconds.

| | |
|---|---|
| The above electrically conductive fine particle dispersion ($SnO_2/Sb_2O_3$, 0.15 μm) | 1,806 weight parts |
| Gelatin | 35 weight parts |
| Water | 314 weight parts |
| Methanol | 3,945 weight parts |
| NaOH | 10 weight parts |
| Isopropyl alcohol | 1,092 weight parts |
| Higher alcohol nonionic surfactant | 1 weight part |
| Epoxy hardening agent | 9 weight parts |

4) Third Backing Layer

A solution having the prescription shown below is coated in a dry film thickness of 0.42 μm, and dried at 70° C.

| | |
|---|---|
| Diacetyl cellulose | 118 weight parts |
| Acetone | 6,428 weight parts |
| Polyacrylonitrile | 1 weight part |
| Methyl ethyl ketone | 8 weight parts |
| Cyclohexanone | 364 weight parts |
| Isocyanate crosslinking agent | 7 weight parts |

For the problem of deterioration of images recorded on an intermediate film (a silver halide photographic material), analog images using negative films for photographing alone can be conventionally used as original images. However, according to the invention, it has become possible to use digital images as original images. That is, even when digital images are used as original images, images recorded on an intermediate film (a silver halide photographic material) according to the invention are free from occurrence of blur, deterioration of sharpness and degradation of color reproduction, and conservation stability of latent images can be secured. Further, according to the invention, it becomes possible to manufacture movies positively getting digital image data, which contributes to further development of cinema industry.

The entire disclosure of each and every foreign patent application from which the benefit of foreign priority has been claimed in the present application is incorporated herein by reference, as if fully set forth.

What is claimed is:

1. A silver halide photographic material, comprising:

a transparent support; and a plurality of layers comprising a first photosensitive layer, a second photosensitive layer and a third photosensitive layer directly or indirectly on the transparent support, the first photosensitive layer consisting of at least one blue-sensitive layer, the second photosersitive layer consisting of at least one green-sensitive layer and the third photosensitive layer consisting of at least one red-sensitive layer, wherein all silver halide grains contained in the first, second and third photosensitive layers each has an average equivalent-sphere diameter of 0.35 μm or less, and wherein at least one layer that is a layer on the opposite side to the transparent support with the at least one green-sensitive layer as a center, and not the at least one green-sensitive layer, contains a fixed magenta dye, at least one layer that is a layer on the opposite side to the transparent support with the at least one red-sensitive layer as a center, and not the at least one red-sensitive layer, contains a fixed cyan dye, and at least one layer of the at least one green-sensitive layer contains a coupler represented by formula (I) and a coupler represented by formula (Z):

Formula (I)

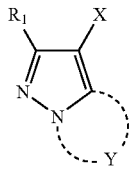

wherein $R_1$ represents a hydrogen atom or a substituent; Y represents a nonmetallic atomic group containing 1 or 2 nitrogen atom(s) and necessary to form a 5-membered azole ring containing 2 or 3 nitrogen atoms, which azole ring may contain a substituent that may form a condensed ring with the azole ring; and X represents a hydrogen atom or a group capable of elimination at a time of coupling reaction with an oxidant of a developing agent:

Formula (Z)

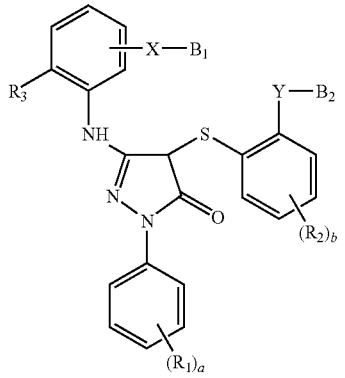

wherein a represents an integer of from 0 to 3; b represents an integer of from 0 to 2; $R_1$ and $R_2$ each independently represents a hydrogen atom, an alkyl group, an alkoxyl group, a halogen group, an aryl group, an aryloxy group, an acylamino group, a sulfonamido group, a sulfamoyl group, a carbamoyl group, an arylsulfonyl group, an aryloxycarbonyl group, an alkoxycabonyl group, an alkoxysulfonyl group, an aryloxysulfonyl group, an alkylureido group, an aryltreido group, a nitro group, a cyano group, a hydroxyl group or a carboxyl group; $R_3$ represents a halogen atom, an alkyl group or an aryl group; X and Y each independently represents a direct bond or a bonding group; and $B_1$ and $B_2$ each independently represents a stabilizing group not to diffuse a coupler.

2. The silver halide photographic material according to claim 1, wherein at least one layer of the at least one green-sensitive layer contains sensitizing dyestuffs represented by formula (A) and formula (B):

Formula (A)

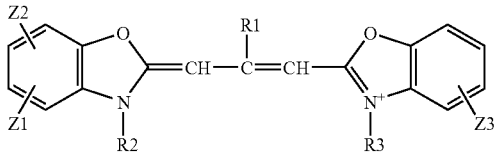

(X1)

wherein R1 represents a hydrogen atom, an alkyl group or an aryl group; R2 and R3 each independently represents an alkyl group which may have a substituent; Z1 and Z2 each independently represents a hydrogen atom, a halogen atom, a hydroxyl group, an alkoxyl group, an amino group, an acyl group, an acylamino group, an acyloxy group, an alkoxycarbonyl group, an alkoxycarbonylamino group, an aryl group, an aryloxy group, an aryloxycarbonyl group, a sulfonyl group, a carbamoyl group, an alkyl group or a cyano group, and Z1 and Z2 may be linked to each other to form a ring; Z3 represents a halogen atom; and X1 represents a cationic counter ion for neutralizing a charge according to necessity;

Formula (B)

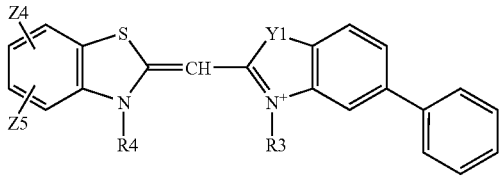

(X2)

wherein Y1 represents a sulfur atom or an oxygen atom; R4 and R5 each independently represents an alkyl group that may have a substituent; Z4 and Z5 each independently represents a hydrogen atom, a halogen atom, a hydroxyl group, an alkoxyl group, an amino group, an acyl group, an acylamino group, an acyloxy group, an alkoxycarbonyl group, an alkoxycarbonylamino group, an aryl group, an aryloxy group, an aryloxycarbonyl group, a sulfonyl group, a carbamoyl group, an alkyl group or a cyano group, and Z4 and Z5 may be linked to each other to form a ring; and X2 represents a cationic counter ion for neutralizing a charge according to necessity.

3. The silver halide photographic material according to claim 1, wherein at least one layer of the first, second and third photosensitive layers contains reduction sensitized silver halide grains and at least one compound selected from the group consisting of the following type 1 and type 2:

type 1:a compound in which one electron oxidant formed by oxidation of one electron is capable of further releasing one electron or more electrons followed by subsequent bond cleavage reaction; and type 2:a compound in which one electron oxidant formed by oxidation of one electron is capable of further releasing one electron or more electrons after having been subjected to subsequent bond-forming reaction.

4. The silver halide photographic material according to claim 1, which is capable of recording digital image data with little deterioration at image-recording time of the digital image data in resolution of 2,000 dpi or more.

5. The silver halide photographic material according to claim 1, which is capable of recording digital image data of 3,000,000 pixels or more with little deterioration.

6. The silver halide photographic material according to claim 1, wherein blur k of a recorded image at a time of digital image recording satisfies the following expression (K):

$$k \leqq 4.5\ \mu m \times (D-0.2)^2 \quad (K)$$

wherein D is a coloring density of the silver halide photographic material; and blur k is a blur (μm) in coloring density D.

7. The silver halide photographic material according to claim 1, wherein a color purity factor of a recorded image is 80% or more at digital image recording time.

8. An image-forming method, comprising: recording a digital image data which is recorded on the silver halide photographic material according to claim 1 on another silver halide photographic material by an analog method.

9. A silver halide photographic material, comprising:

a transparent support; and a plurality of layers comprising a first photosensitive layer, a second photosersitive layer and a third photosensitive layer directly or indirectly on the transparent support, the first photosensitive layer consisting of at least one blue-sensitive layer, the second photosensitive layer consisting of at least one green-sensitive layer and the third photosensitive layer consisting of at least one red-sensitive layer, wherein all silver halide grains contained in the first, second and third photosensitive layers each has an average equivalent-sphere diameter of 0.35 μm or less, and wherein at least one layer that is a layer on the opposite side to the transparent support with the at least one green-sensitive layer as a center, and not the at least one green-sensitive layer, contains a fixed magenta dye, at least one layer that is a layer on the opposite side to the transparent support with the at least one red-sensitive layer as a center, and not the at least one red-sensitive layer, contains a fixed cyan dye, and at least one layer of the at least one green-sensitive layer contains a coupler represented by formula (M-I), formula (M-III) or formula (Z):

[M-I]

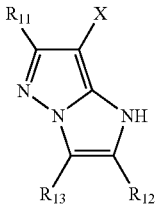

[M-III]

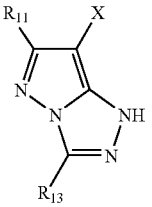

wherein $R_{11}$ represents a hydrogen atom, a halogen atom, an alkyl group, an aryl group a heterocyclic group, a cyano group, a hydroxyl group, a nitro group, a carboxyl group, an amino group, an alkoxyl group, an aryloxy group, an acylamino group, an alkylamino group, an amilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyloxy group, an aryloxycarbonyl-amino group, an mido group, a heterocyclic thio group, a sulfinyl group, a phosphonyl group, an aryloxycarbonyl group, an acyl group or an azolyl group, and $R_{11}$ may be a divalent group to form a bis form;

$R_{12}$ and $R_{13}$ represent the same group as the substituents represented by $R_{11}$; and X represents a hydrogen atom or a group capable of elimination in a reaction with an oxidant of an aromatic primary amine developing agent:

Formula (Z)

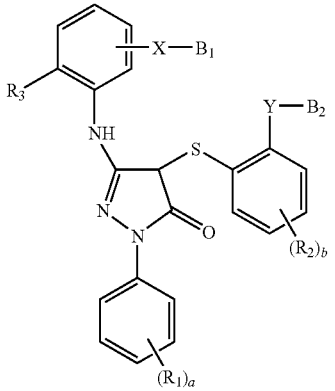

wherein a represents an integer of from 0 to 3; b represents an integer of from 0 to 2; $R_1$ and $R_2$ each independently represents a hydrogen atom, an alkyl group, an alkoxyl group, a halogen group, an aryl group, an aryloxy group, an acylamino group, a sulfonamido group, a sulfamoyl group, a carbamoyl group, an arylsulfonyl group, an aryloxycarbonyl group, an alkoxycarbonyl group, an alkoxysulfonyl group, an aryloxysulfonyl group, an alkylureido group, an arylureido group, a nitro group, a cyano group, a hydroxyl group or a carboxyl group; $R_3$ represents a halogen atom, an alkyl group or an aryl group; X and Y each independently represents a direct bond or a bonding group; and $B_1$ and $B_2$ each independently represents a stabilizing group not to diffuse a coupler.

* * * * *